US012115425B1

(12) United States Patent
Jones et al.

(10) Patent No.: US 12,115,425 B1
(45) Date of Patent: Oct. 15, 2024

(54) STANDALONE AND MULTIGAME MINIATURE GOLF STRUCTURE

(71) Applicant: Puttshack LTD, London (GB)

(72) Inventors: Samuel Nicolas Jones, Scraptoft (GB); Thomas Stephen David Hopkinson, Reading (GB); Stephen Peter Slade, Tonbridge (GB); Adam Camies, Rochester (GB)

(73) Assignee: Puttshack LTD, London (GB)

( * ) Notice: Subject to any disclaimer, the term of this patent is extended or adjusted under 35 U.S.C. 154(b) by 0 days.

(21) Appl. No.: 18/605,267

(22) Filed: Mar. 14, 2024

Related U.S. Application Data

(60) Provisional application No. 63/590,217, filed on Oct. 13, 2023, provisional application No. 63/537,702, filed on Sep. 11, 2023.

(51) Int. Cl.
*A63B 67/02* (2006.01)
*A63B 71/06* (2006.01)

(52) U.S. Cl.
CPC ..... *A63B 67/02* (2013.01); *A63B 71/0622* (2013.01); *A63B 71/0669* (2013.01)

(58) Field of Classification Search
CPC ..... A63B 67/02; A63B 71/0622; A63B 71/0669
See application file for complete search history.

(56) References Cited

U.S. PATENT DOCUMENTS 2,232,569 A 2/1941 Bernays
3,011,791 A 12/1961 Page
3,862,760 A 1/1975 Davis
5,330,188 A * 7/1994 Reimers ..... A63B 69/3614 473/240
5,342,053 A 8/1994 Smith
5,553,859 A 9/1996 Kelly et al.
5,692,966 A * 12/1997 Wash ..... A63B 69/3614 473/409
7,040,998 B2 5/2006 Jolliffe et al.
2011/0201437 A1 8/2011 Fallow et al.

FOREIGN PATENT DOCUMENTS

JP 8-47558 2/1996
WO 9701376 A1 1/1997

* cited by examiner

*Primary Examiner* — Jeffrey S Vanderveen
(74) *Attorney, Agent, or Firm* — Neal, Gerber & Eisenberg LLP

(57) ABSTRACT

Apparatus and methods are disclosed for a standalone and multi-game miniature golf structure. A structure includes a digital display screen positioned to align vertically with a rear end of a putting surface and sensor(s) positioned below the digital display screen. The sensor(s) are configured to detect lateral positions at which balls cross the rear end. The structure includes processor(s), that for each shot of a plurality of miniature golf games, are configured to send command signals to the digital display screen to display putting target(s); identify, via the sensor(s), a lateral position at which a golf ball crosses the rear end of the putting surface; determine whether the lateral position of the golf ball aligns vertically with any of the putting target(s); and generate a score for the shot based on the lateral position of the golf ball relative to the putting target(s).

30 Claims, 50 Drawing Sheets

STANDALONE AND MULTIGAME MINIATURE GOLF STRUCTURE

REFERENCE TO RELATED APPLICATIONS

This application claims the benefit of U.S. Provisional Patent Application Ser. No. 63/590,217, filed on Oct. 13, 2023, and U.S. Provisional Patent Application Ser. No. 63/537,702, filed on Sep. 11, 2023; both of which are incorporated by reference herein in their entirety.

TECHNICAL FIELD

The present disclosure generally relates to miniature golf and, more specifically, to a standalone and multigame miniature golf structure.

BACKGROUND

Miniature golf (also referred to as "minigolf" or "putt-putt") is a game that is typically played on a miniature golf course with a series of holes. Each player is to putt a respective ball into each of the series of holes. Oftentimes, each hole in a miniature golf course includes one or more artificial obstacles and/or unusual geometric arrangements to make putting a ball into the hole more difficult and entertaining. Example obstacles may include ramps, tubes, curved or angled walls, windmills, etc.

Many miniature golf courses include a large number of holes, such as 18 holes, so that each player may be challenged by a number of different obstacles and hole configurations throughout the course. Such holes are spread out and spaced apart from each other to allow different players to maneuver around the course without interfering with each other. To accommodate such an arrangement of holes, many miniature golf courses have a considerably large footprint that can oftentimes be expensive to pay for and maintain.

Additionally, many miniature golf obstacles are large objects that are fixed in place relative to one or more of the holes of the miniature golf course. For instance, a windmill or other rotating structure may be placed between a tee and a corresponding hole. Pipe holes may transport a golf ball from one putting surface level to another to create a multi-tiered miniature golf hole. While these hole configurations are initially entertaining to players, many repeat players of a miniature golf course may tire of facing the same obstacles over and over again. Thus, it may be advantageous to operators of miniature golf courses to change the obstacles and hole configurations throughout the course from time-to-time. However, operators oftentimes do not do so because it is oftentimes expensive and may require significant downtime to replace obstacles/or reconfigure holes of a miniature golf course.

SUMMARY

The appended claims define this application. The present document discloses aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are shown for a standalone and multigame miniature golf structure. An example standalone miniature golf structure disclosed herein includes a putting surface including a front end and a rear end. The standalone miniature golf structure includes one or more sensors configured to detect lateral positions at which balls cross the rear end. The standalone miniature golf structure includes a digital display screen positioned above the one or more sensors and adjacent to the rear end to align vertically with the rear end of the putting surface, memory to store instructions for a plurality of miniature golf games, and one or more processors. For each shot of the plurality of miniature golf games, the one or more processors are configured to send command signals to the digital display screen to display one or more putting targets based on the instructions stored in the memory; identify, via the one or more sensors, a lateral position at which a golf ball crosses the rear end of the putting surface; determine whether the lateral position of the golf ball aligns vertically with any of the one or more putting targets; and generate a score for the shot based on the lateral position of the golf ball relative to the one or more putting targets.

Another example standalone miniature golf structure disclosed herein includes a putting surface including a front end and a rear end, a plurality of ball-detection lanes that are adjacent and extend perpendicular to the rear end of the putting surface, one or more sensors configured to detect into which of the plurality of ball-detection lanes that golf balls are shot, a digital display screen positioned adjacent to and above the rear end to align vertically with the plurality of ball-detection lanes, memory to store instructions for a plurality of miniature golf games, and one or more processors. For each shot of the plurality of miniature golf games, the one or more processors are configured to send command signals to the digital display screen to display one or more putting targets based on the instructions stored in the memory; identify, via the one or more sensors, a putted lane of the plurality of ball-detection lanes into which a golf ball has been shot; determine whether the putted lane aligns vertically with any of the one or more putting targets; and generate a score for the shot based on a position of the putted lane relative to the one or more putting targets.

An example putting structure disclosed herein includes a putting surface including a front end and a rear end. The putting structure includes a tee surface adjacent to the front end of the putting surface, a ball-return surface located underneath the putting surface, and a sensor assembly adjacent to the rear end of the putting surface. The sensor assembly includes a sensor cartridge with one or more sensors configured to detect a lateral position at which a golf ball crosses the rear end. The sensor assembly is configured to direct the golf ball from the rear end of the putting surface and to the ball-return surface to return the golf ball back to the tee surface for a subsequent putt.

An example sensor cartridge for a putting structure is disclosed herein. The sensor cartridge includes a body including a top panel that defines an upper surface along which a golf ball is to travel. The upper surface includes a rear edge and a front edge. The sensor cartridge includes a plurality of walls protruding upwardly from the upper surface of the body. The plurality of walls extend between the rear edge and the front edge of the upper surface. The plurality of walls are parallel to and spaced apart from each other to define a plurality of ball-detection lanes for the golf ball that extend perpendicular to the front edge of the upper surface. The sensor cartridge includes a plurality of sensors each of which corresponds with a corresponding ball-detection lane of the plurality of ball-detection lanes. Each of the plurality of sensors is configured to detect when the golf ball travels through the corresponding ball-detection lane.

Another example sensor cartridge for a putting structure is disclosed herein. The sensor cartridge includes a body including a top panel that defines an upper surface along which a golf ball is to travel. The upper surface includes a rear edge, a front edge, and two opposing ends. Each of the rear edge and the front edge extends between the two opposing ends. The sensor cartridge includes a sensor positioned adjacent to one of the two opposing ends and configured to detect a lateral position of the golf ball travelling along the upper surface toward the front edge.

Another example putting structure disclosed herein includes a putting surface including a front end and a rear end, a tee surface adjacent to the front end of the putting surface, a ball-return surface located underneath the putting surface, a body defining a cartridge chamber that is located adjacent to the rear end of the putting surface and the ball-return surface, and a sensor cartridge configured to be securely housed in and removeable from the cartridge chamber. The sensor cartridge includes one or more sensors configured to detect a lateral position at which a golf ball crosses the rear end of the putting surface. The sensor cartridge is configured to direct the golf ball from the rear end and to the ball-return surface to return the golf ball back to the tee surface for a subsequent putt.

An example ball-dispensing assembly for a putting structure is disclosed herein. The ball-dispensing assembly includes a track along which golf balls are configured to roll. The track extends between an inlet and an outlet. The inlet is downstream of a putting surface of the putting structure. The outlet is positioned to dispense the golf balls onto a tee surface. The ball-dispensing assembly includes a frame adjacent to at least a portion of the track and an actuator including an actuator body and an actuator arm. The actuator body is mounted to the frame. The actuator arm is configured to transition between an extended position and a retracted position. The ball-dispensing assembly includes a pivot arm operatively connected to the actuator arm and configured to transition between a closed position and an open position. The pivot arm is configured to be in the closed position when the actuator arm is in the extended position to block the golf balls from being dispensed. The pivot arm is configured to be in the open position when the actuator arm is in the retracted position to permit the golf balls to be dispensed.

Another example standalone miniature golf structure disclosed herein includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. For each shot of the miniature golf game, the one or more processors are configured to select a primary target based on the instructions stored in the memory; generate an interface to include the primary target; send command signals to the digital display screen to display the interface; identify, via the one or more sensors, a lateral position at which a golf ball crosses the rear end of the putting surface; and award a first point value associated with the primary target to a corresponding player in response to determining that the lateral position of the golf ball aligns vertically with the primary target.

Another example standalone miniature golf structure disclosed herein includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. For each shot of the miniature golf game, the one or more processors are configured to generate an interface with a target based on the instructions stored in the memory; send command signals to the digital display screen to display the interface; identify, via the one or more sensors, a lateral position at which a golf ball crosses the rear end of the putting surface; in response to determining that the lateral position of the golf ball aligns vertically with the target, award a predefined point value associated with the target; and, in response to determining that the lateral position of the golf ball does not align vertically with the target, reduce a number of remaining chances for a corresponding player by one.

Another example standalone miniature golf structure disclosed herein includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. The one or more processors are configured to generate, based on the instructions stored in the memory, an interface with a plurality of targets and a vertical center line of the plurality of targets; send command signals to the digital display screen to display the interface; identify, via the one or more sensors, a lateral position at which a golf ball crosses the rear end of the putting surface; and in response to determining that the lateral position of the golf ball aligns vertically with any of the plurality of targets, move the center line and the plurality of targets laterally on the interface.

Another examples standalone miniature golf structure disclosed herein includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. The one or more processors are configured to generate, based on the instructions stored in the memory, an interface to include moving targets arranged in rows; send command signals to the digital display screen to display the interface; identify, via the one or more sensors, a lateral position at which a golf ball crosses the rear end of the putting surface; determine positions of the moving targets of the interface when the golf ball is detected to have crossed the rear end of the putting surface; and, in response to determining that the lateral position of the golf ball aligns vertically with a first of the moving targets, award a first point value associated with the first of the moving targets to a current player.

Another example standalone miniature golf structure disclosed herein includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. The one or more processors are configured to generate, based on the instructions stored in the memory, an interface to include targets arranged in rows; send command signals to the digital display screen to display the interface; identify, via the one or more sensors, a lateral position at which a golf ball crosses the rear end of the putting surface; and, in response to determining that the lateral position of the golf ball aligns vertically with a first of the targets, award a first point value associated with the first of the targets to a current player.

Another example standalone miniature golf structure disclosed herein includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. The one or more processors are configured to generate, based on the instructions stored in the memory, an interface to include an oscillating target; send command signals to the digital display screen to display the interface; identify, via the one or more sensors, a lateral position at which a golf ball crosses the rear end of the putting surface; determine a position of the oscillating target of the interface when the golf ball is detected to have crossed the rear end of the putting surface; and in response to determining that the lateral position of the golf ball aligns vertically with the position of the oscillating target, award a point value of the oscillating target to a player.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION

Figure 1:
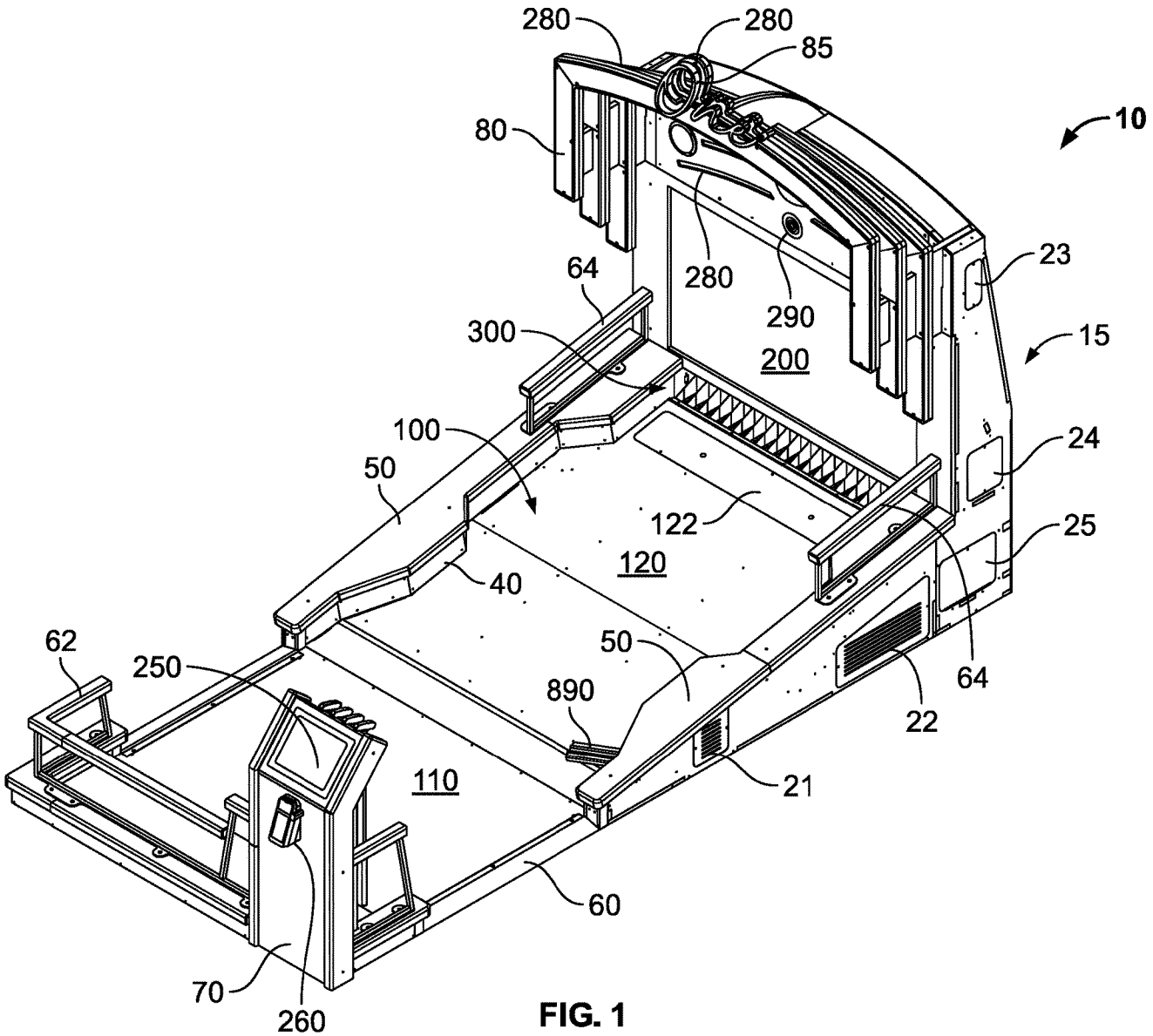
FIGS. 1-2 depict an example standalone miniature-golf structure in accordance with the teachings herein.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Standalone miniature golf structures disclosed herein are configured to conduct various interactive multi-player games (e.g., for 2-6 players) with targets that change, in real-time, from shot-to-shot and/or based on previous events. The multi-player games are user-selectable and may be tailored to multiple user-selectable gameplays, such as an individual mode or a team mode. In turn, standalone miniature golf structure enables a player to have an unlimited number of unrepeated playing experiences so that repeat players do not tire of playing games on the standalone miniature golf structure. New games may be easily uploaded to the standalone miniature golf structure and/or updated over time to further diversify the playing experience of repeat players.

Standalone miniature golf structures disclosed herein include a single tee and putting surface so that the standalone miniature golf structure takes up a relatively small footprint compared to miniature golf courses with multiple holes. The small footprint enables the standalone miniature golf structure to be easily installed in an arcade, a bar, a beercade, a casino flooring, and/or other gaming establishments.

Example standalone miniature golf structures include a tee surface, a digital display screen, and a putting surface that extends from the tee surface and toward the digital display screen. Players are to putt golf balls from the tee surface and along the putting surface in a direction toward the digital display screen. The digital display screen is positioned above a rear end of the putting surface. The digital display screen is configured to present one or more putting targets for a player. Additionally, the digital display screen is aligned vertically with the rear end of the putting surface. For example, if the putting target is in the center of the digital display screen, the putting target aligns with the center of the rear end of the putting surface and the player is to putt a golf ball to the center of the rear end. If the putting target is on the left side of the digital display screen, the putting target aligns with the lefthand side of the rear end of the putting surface and the player is to putt the golf ball to the lefthand side of the rear end. Likewise, if the putting target is on the right side of the digital display screen, the putting target aligns with the lefthand side of the rear end of the putting surface and the player is to putt the golf ball to the righthand side of the rear end.

Example standalone miniature golf structures include one or more sensors (e.g., fork sensors, proximity switches, a lidar sensor, etc.) that are positioned adjacent to the rear end of the putting surface. The sensor(s) are configured to detect a lateral position of a golf ball as it crosses the rear end of the putting surface. That is, the sensor(s) enable detection of whether a player has putted the golf ball to a lateral position along the rear end that aligns vertically with the putting target presented on the digital display screen.

The standalone miniature golf structures may include lanes that facilitate alignment between the target(s) of the digital display screen and the rear end of the putting surface. For example, some standalone miniature golf structures include walls and/or dividers that define a plurality of ball-detection lanes that are adjacent to the rear end of the putting surface. The ball-detection lanes facilitate the sensor(s) in accurately detecting the lateral position at which the golf ball crosses the rear end of the putting surface. Additionally, the digital display screen may present digital lanes that align vertically with the ball-detection lanes adjacent to the putting surface. The digital lanes facilitate players in identifying the location of the target and/or the corresponding lateral position along the rear end of the putting surface.

The standalone miniature golf structures may include a sensor cartridge that is installed in a cartridge chamber. The sensor cartridge is configured to be easily installed and/removed from the cartridge chamber to facilitate an operator in easily servicing sensor(s) and/or other components of the sensor cartridge. The cartridge chamber may include roller conveyor(s) to facilitate the installation and/or removal of the sensor cartridge. Additionally or alternatively, the sensor cartridge may be formed of multiple bodies (e.g., a first body and a second body) that are removable separately. Such a configuration of the sensor cartridge enables the standalone miniature golf structure to be installed in relatively tighter spaces with smaller clearances adjacent to the cartridge chamber.

Example standalone miniature golf structures also include memory and one or more processors that enable the ever-changing gaming experiences. The memory is configured to store instructions for a plurality of miniature golf games to enable player(s) to play any of a number of games at any given time. The processor(s) are configured to control what is being presented on the digital display screen for each shot within each miniature golf game. For example, the processor(s) are configured to select (e.g., randomly) a number of targets, a size of each target, a location of each target, a score corresponding to each target, etc. The processor(s) send command signals to the digital display screen to cause the selected target(s) to be presented in the selected manner. The processor(s) also are configured to detect, based on data collected via the sensor(s), a lateral position of where the golf ball crosses the rear end of the putting surface. The processor(s) are then configured to determine whether the lateral position of the golf ball aligns vertically with any of the target(s) presented on the digital display screen and generate a score for the corresponding shot based on the comparison. For example, if the lateral position of the shot aligns vertically with the target on the digital display screen, the processor(s) are configured to award a predefined number of points associated with the target to the corresponding player.

Example standalone miniature golf structures may also include a ball-dispensing assembly that is configured to dispense a golf ball onto the tee surface for a subsequent shot. An example ball-dispensing assembly includes a track along which golf balls are configured to roll, an actuator including an actuator arm, and a pivot arm. The pivot arm is operatively connected to the actuator arm. The pivot arm is configured to be in a closed position to block the golf balls from being dispensed and is configured to be in an open position to permit the golf balls to be dispensed. In some examples, the ball-dispensing assembly is configured to release a golf ball at a predefined duration (e.g., 1 second, 2 seconds, etc.) after the sensor(s) have detected a preceding shot to keep the miniature golf game moving in a timely and organized manner.

Figure 2:
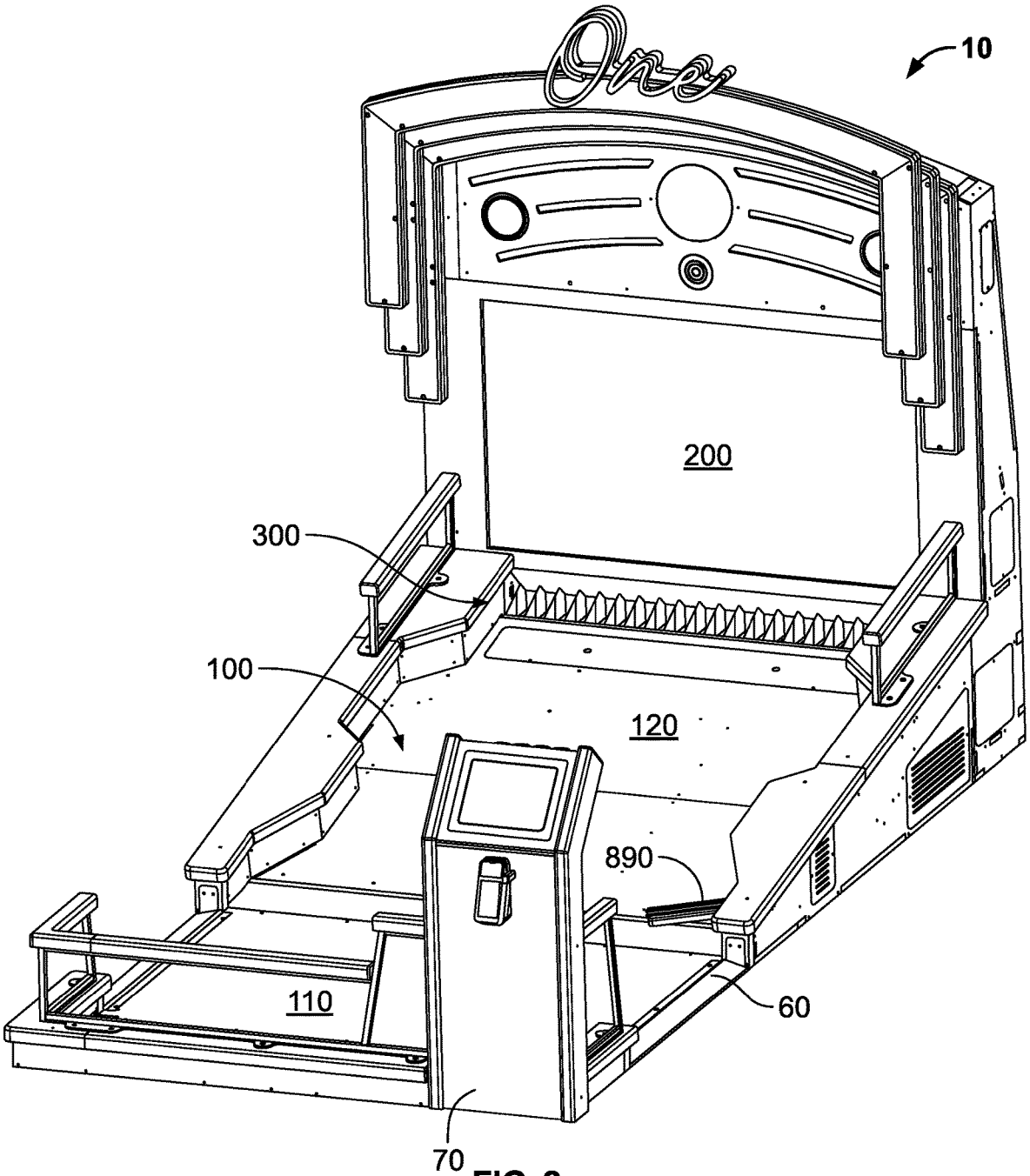
Figure 3:
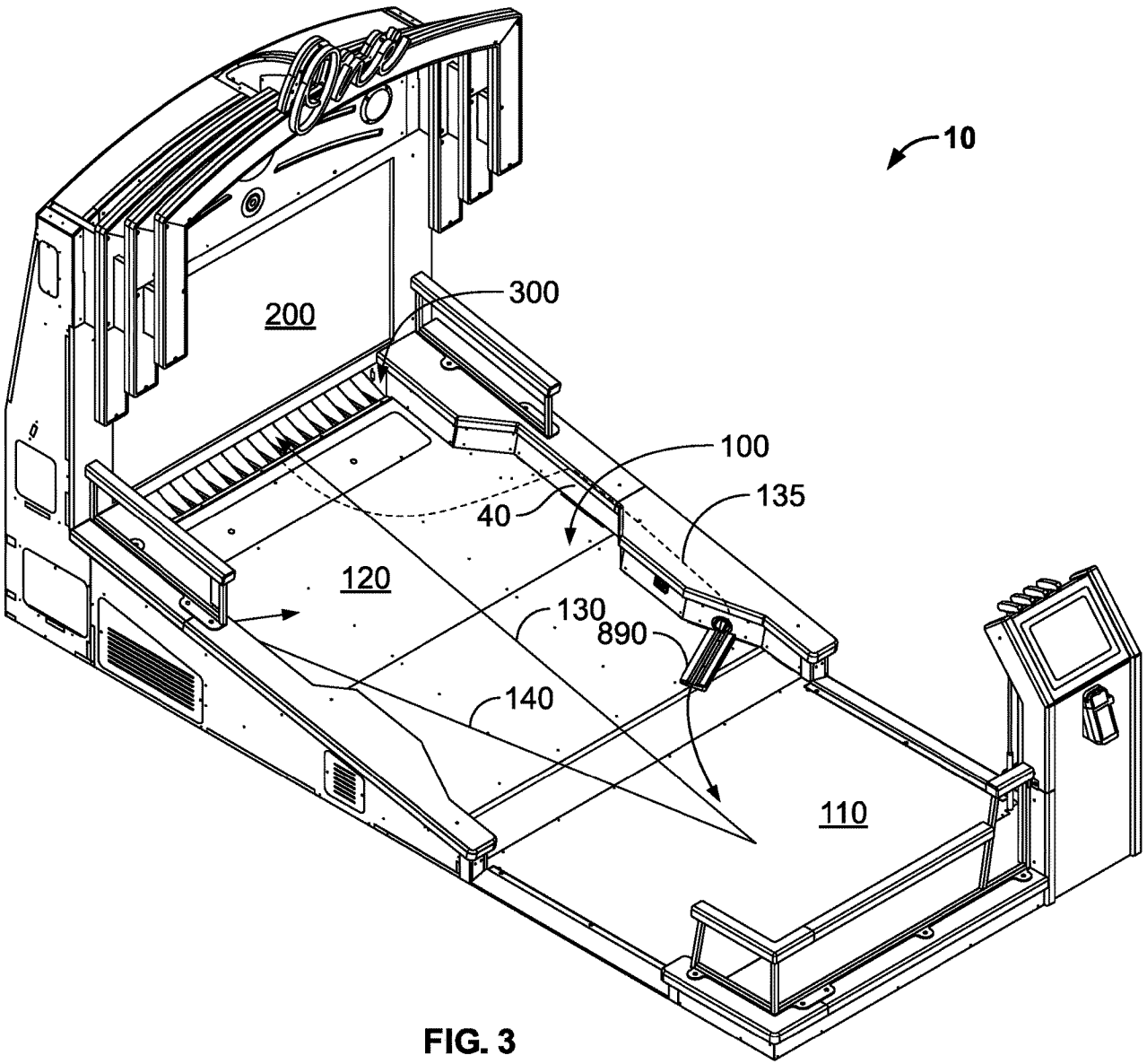
FIG. 3 depicts various shots that may occur on an example putting surface of the standalone miniature-golf structure of FIG. 1.

Turning to the figures, FIGS. 1-3 illustrates an example standalone miniature golf structure 10 in accordance with the teachings herein. The standalone miniature golf structure 10 is a putting structure on which one or more players putt golf balls, for example, to complete one or more miniature golf games. The standalone miniature golf structure 10 (also referred to as a "miniature golf structure," a "golf structure," a "standalone golf structure," a "putting structure" and a "standalone putting structure") includes a tee surface 110, a putting surface 120, a digital display screen 200, and a sensor assembly 300.

Figure 5:
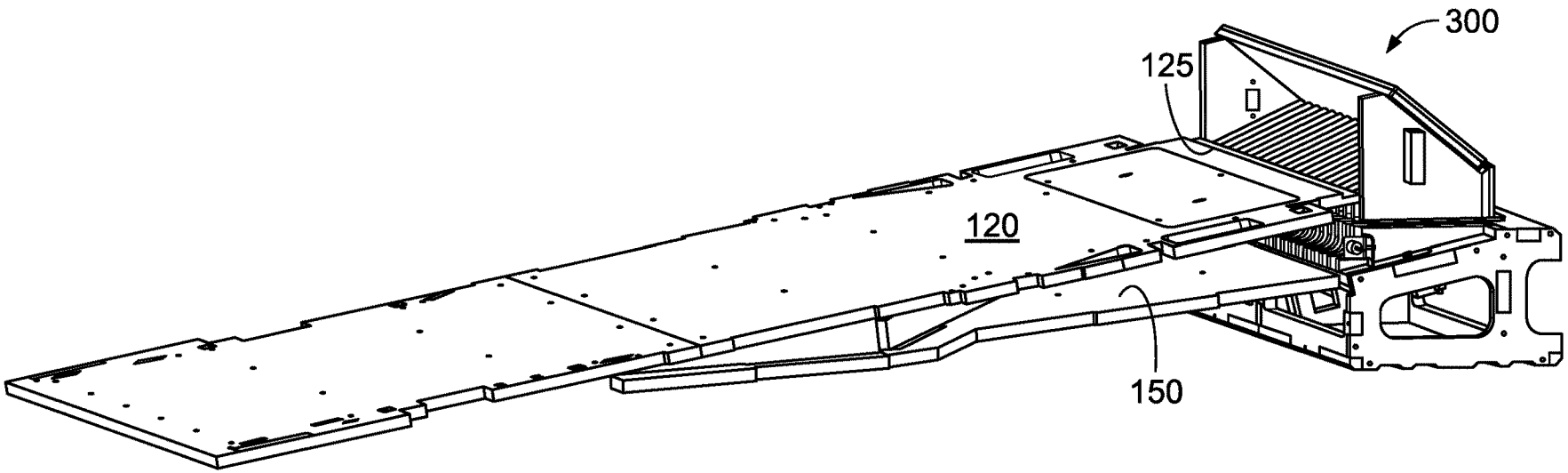
FIG. 5 depicts the putting surface of FIG. 3, an example ball-return surface, and an example sensor assembly of the standalone miniature-golf structure of FIG. 1.
Figure 6:
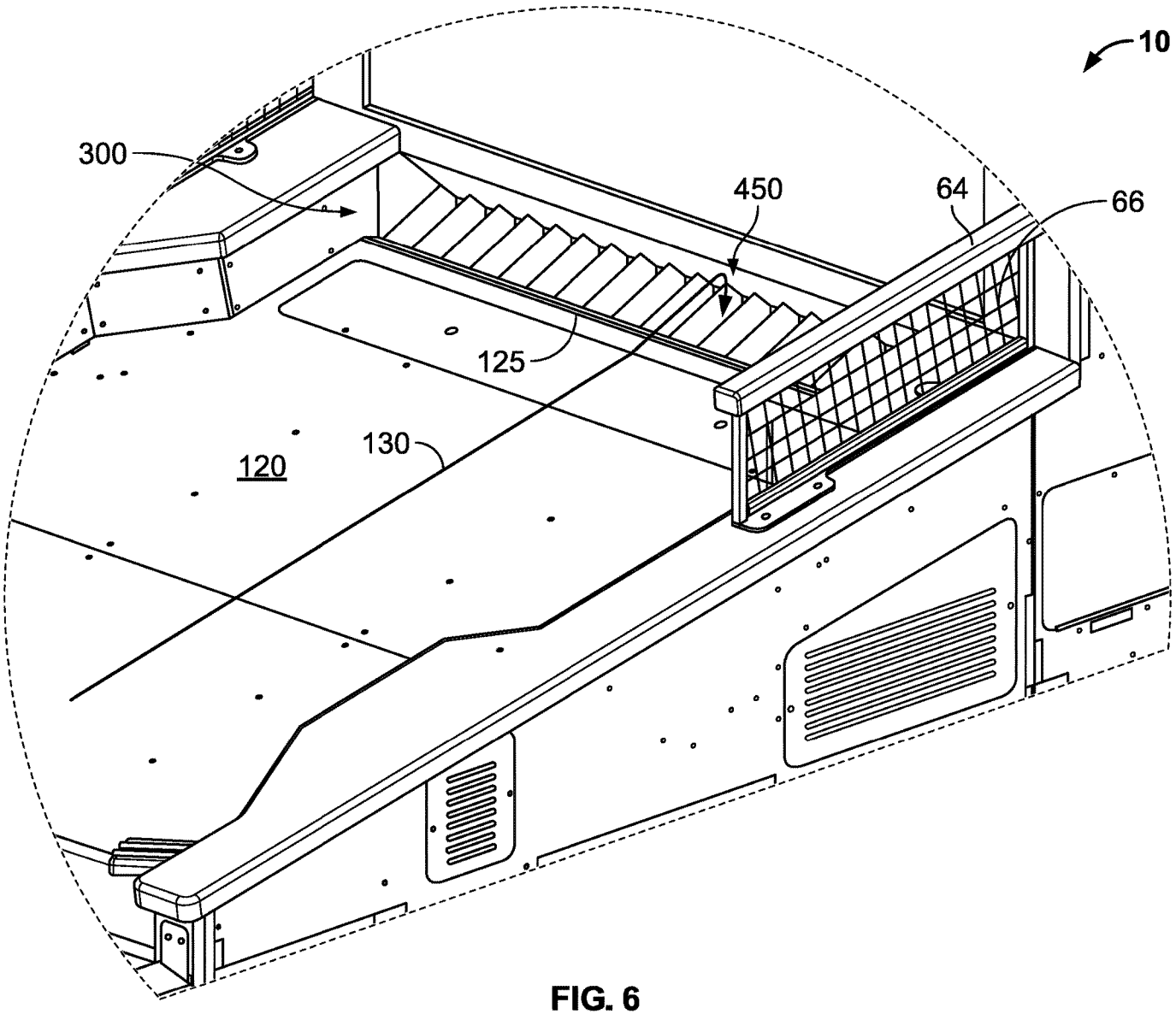
FIG. 6 depicts an example path of a golf ball entering the sensor assembly of FIG. 5.

The putting surface 120 includes a front end and a rear end (a rear end 125 of FIGS. 5-6). The front end of the putting surface 120 is adjacent to and extends from the tee surface 110. The sensor assembly 300 is adjacent to the rear end 125 of the putting surface 120. The digital display screen 200 is positioned above the sensor assembly 300 and/or the rear end 125 of the putting surface 120. Additionally, the digital display screen 200 is aligned vertically with the sensor assembly 300 and/or the rear end 125 of the putting surface 120. The digital display screen 200 is configured to display one or more putting targets and/or hazards. A player is to putt a golf ball from the tee surface 110 and along the putting surface 120 in a direction toward the putting target(s). The sensor assembly 300 is configured to detect whether golf ball was putted to a lateral position along the rear end 125 of the putting surface 120 that aligns with any of the one or more putting targets and/or hazards presented via the digital display screen 200. As disclosed below in greater detail, the sensor assembly 300 includes one or more sensors configured to detect the lateral position at which the golf ball is putted. If the detected lateral position of the shot aligns with a putting target, the player may be awarded a predefined amount of points associated with the putting target. If the detected lateral position of the shot aligns with a hazard, the player may be deducted a predefined amount of points associated with the hazard. In some examples, the putting target(s) and/or hazard(s) presented via the digital display screen 200 are changed (e.g., randomly) for each shot, round, and/or player.

The standalone miniature golf structure 10 also includes a body 15 onto which the putting surface 120, the digital display screen 200, and the sensor assembly 300 are mounted. The body 15 of the illustrated example includes a ramp portion and a rear portion.

The putting surface 120 is secured to a ramp portion of the body 15. The ramp portion includes side boards 40 with each side board 40 extending along a respective side of the putting surface 120. For example, one side board 40 extends along a left side of the putting surface 120, and another side board 40 extends along a right side of the putting surface 120. As illustrated in FIG. 3, an off-target shot 140 may bounce off a side board 40 and return back to the tee surface 110 to enable a player to retry the putt.

Returning to FIG. 1, the ramp portion of the body 15 also includes side covers 50 that are coupled to and cover the respective side boards 40. For example, one side cover 50 is coupled to and covers one side board 40, and another side cover 50 is coupled to and covers the other side board 40. Additionally, the body 15 includes one or more ball-retention rails 64 and one or more ball-retention fencing 66 (FIG. 5). Each ball-retention fencing 66 is coupled to a respective ball-retention rail 64, and the ball-retention rails 64 and the ball-retention fencing 66 are arranged to keep the golf balls on the standalone miniature golf structure 10. For example, each set of a ball-retention rail 64 and a ball-retention fencing 66 is positioned along the putting surface 120 adjacent to the rear portion of the body 15. One set of a ball-retention rail 64 and a ball-retention fencing 66 is coupled to the side cover 50 on the lefthand side, and another set of a ball-retention rail 64 and a ball-retention fencing 66 is coupled to the side cover 50 on the righthand side.

As disclosed below in greater detail, a ball-dispensing assembly 800 (FIGS. 7 and 22) is housed within a cavity formed by a respective side board 40 and side cover 50. In the illustrated example, the ball-dispensing assembly 800 is housed within the righthand side board 40 and side cover 50. The ball-dispensing assembly 800 includes a ramp 890 that extends from the respective side board 40 to the tee surface 110 to enable the ball-dispensing assembly 800 to return a golf ball onto the tee surface 110 for a subsequent shot.

Additionally, the tee surface 110 extends from a front end of the ramp portion of the body 15. In the illustrated example, the tee surface 110 abuts and is connected to the putting surface 120, with the tee surface extending horizontally along the ground surface and the putting surface inclining toward the sensor assembly 300. In other examples, the tee surface 110 may be integrally and monolithically formed with the putting surface 120.

One or more ball-retention rails 62 and fencing extends around a portion of the tee surface 110 to keep the golf balls on the standalone miniature golf structure 10. Additionally, one or more access points 60 are located along the tee surface 110 for ingress onto and egress from the tee surface 110. That is, each access point 60 enables players to enter onto and exit from the tee surface 110 of the standalone miniature golf structure 10. In the illustrated example, the tee surface 110 and the access points 60 are configured to enable people with health conditions or impairments to access the tee surface 110 and play on the standalone miniature golf structure 10. For example, the tee surface 110 and the access points 60 are configured to be compliant with corresponding governmental regulations (e.g., of the Americans with Disabilities Act). For example, each of the access points 60 have a relatively small elevation and the tee surface 110 is large enough to accommodate mobility-assistance tools of such a player.

In the illustrated example, the standalone miniature golf structure 10 includes a check-in station 70 adjacent to the tee surface 110. The check-in station includes a user interface 250, such as a touchscreen, to enable one or more players to select game information. For example, the user interface 250 is configured to enable a player to identify the number of players within a group, provide a name for each player, select one of a plurality of games to play, select a gameplay for the selected game, identify whether any players in the group have health conditions or impairments, etc. Additionally, the check-in station 70 includes a card reader 260 that is configured to enable one or more players to pay for use of the standalone miniature golf structure 10.

As shown in FIG. 1, the digital display screen 200 and the sensor assembly 300 are mounted to the rear portion of the body 15. The digital display screen 200 is mounted to the rear portion of the body 15 to be positioned above and vertically align with the sensor assembly 300 and the rear end 125 of the putting surface 120. In the illustrated example, signage 80, 85 and lighting 280 (e.g., light emitting diodes (LEDs)) are mounted to the rear portion of the body around the digital display screen 200. Additionally, a camera 290 is mounted to the rear portion above the digital display screen 200. The camera 290 is configured to capture images and/or video of the players and/or shots during a game played on the standalone miniature golf structure 10. In some examples, the captured images and/or video are subsequently presented via a display, such as the digital display screen 200, for a replay of the gameplay.

In the illustrated example, one or more access panels 21, 22, 23, 24, 25 are removably coupled to a side surface and/or a rear surface the body 15. The access panels 21, 22, 23, 24, 25 are configured to be removed from the body 15 to provide an operator with access to internal components of the standalone miniature golf structure 10. Additionally, another access panel 122 is located along the putting surface 120 to access internal components of the standalone miniature golf structure 10.

Figure 4:
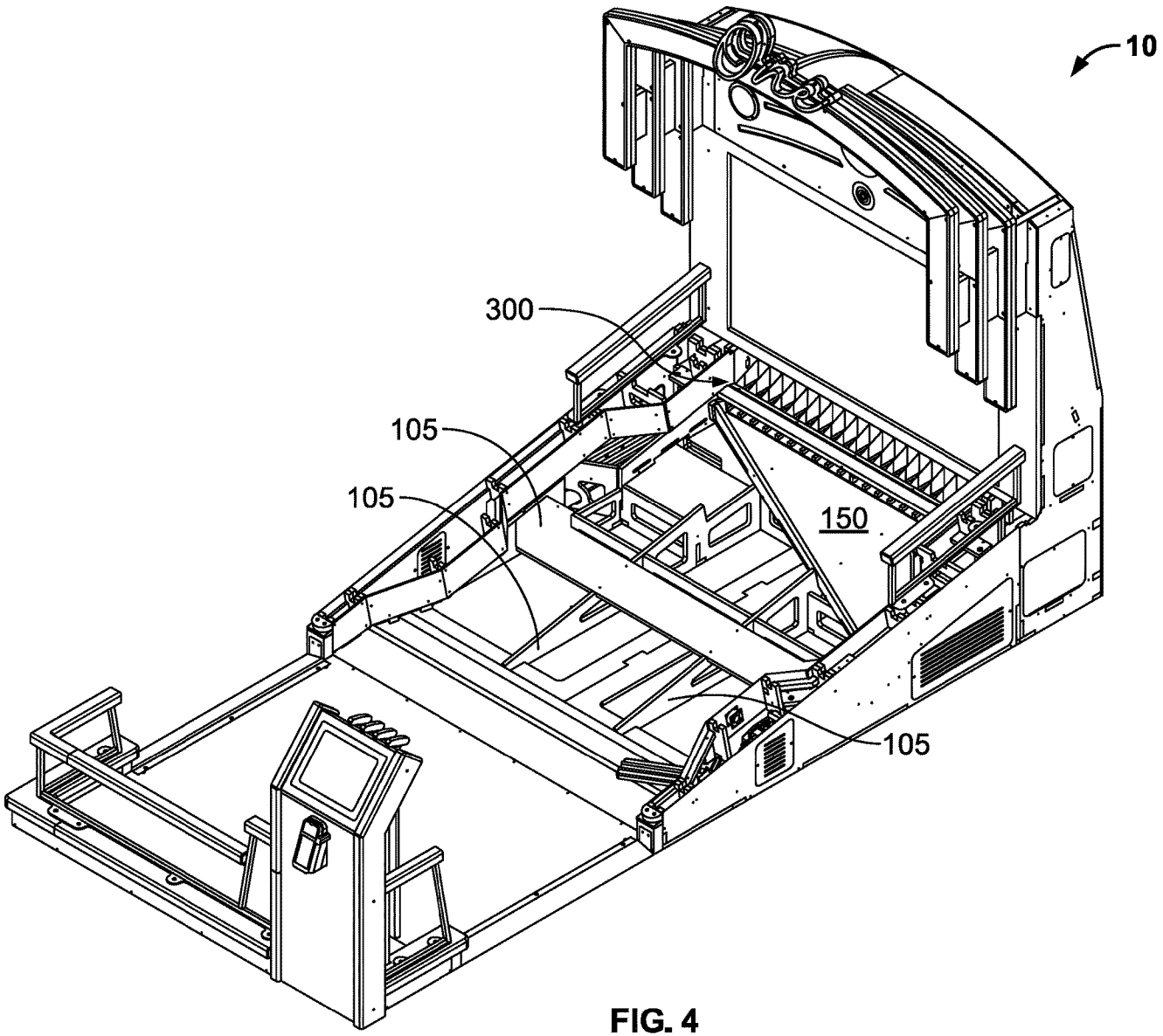
FIG. 4 depicts the standalone miniature-golf structure of FIG. 1 with the putting surface of FIG. 3 removed to depict example inner portions of the standalone miniature-golf structure.
Figure 7:
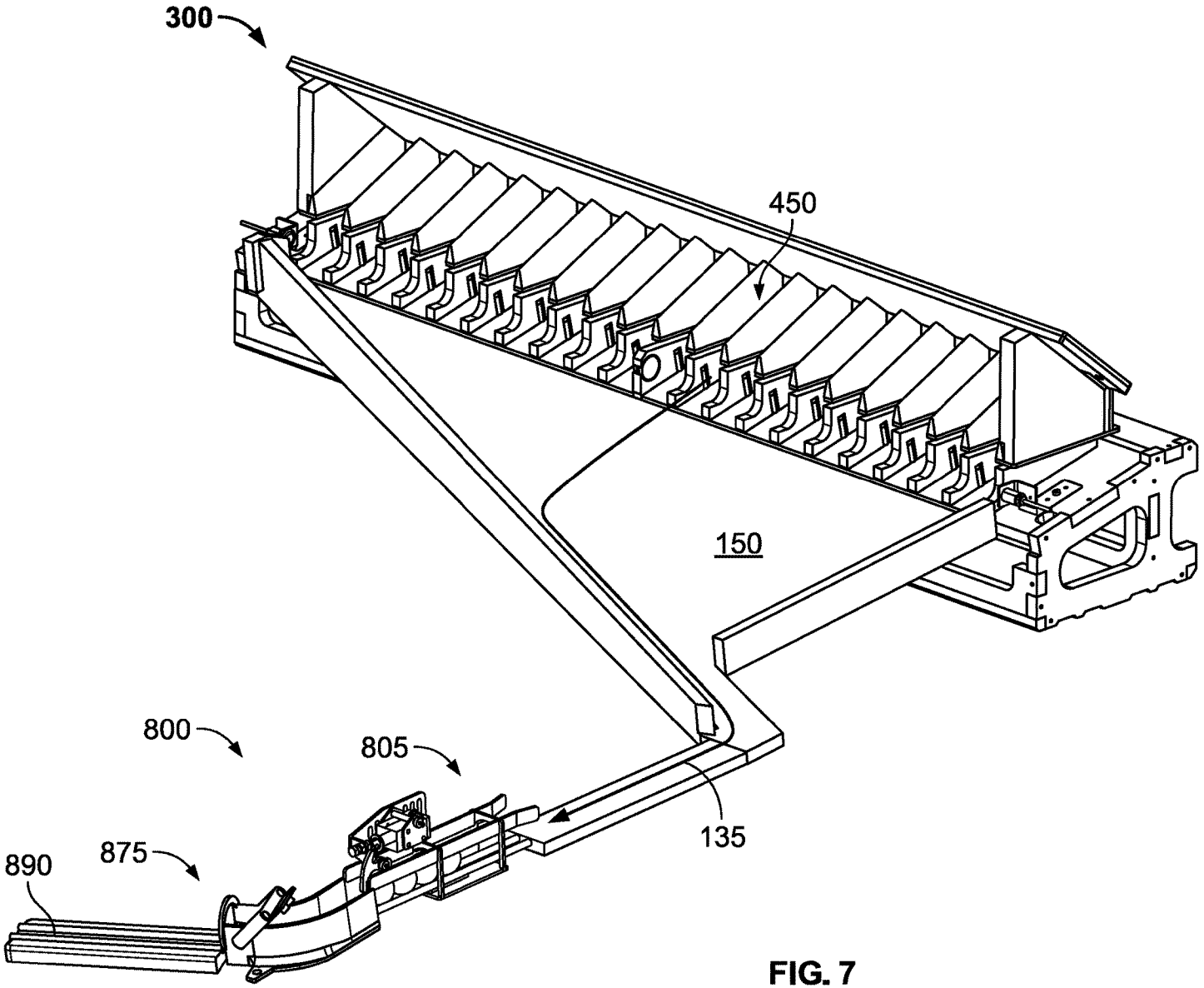
FIG. 7 depicts an example path of a golf ball exiting the sensor assembly of FIG. 5.
Figure 22:
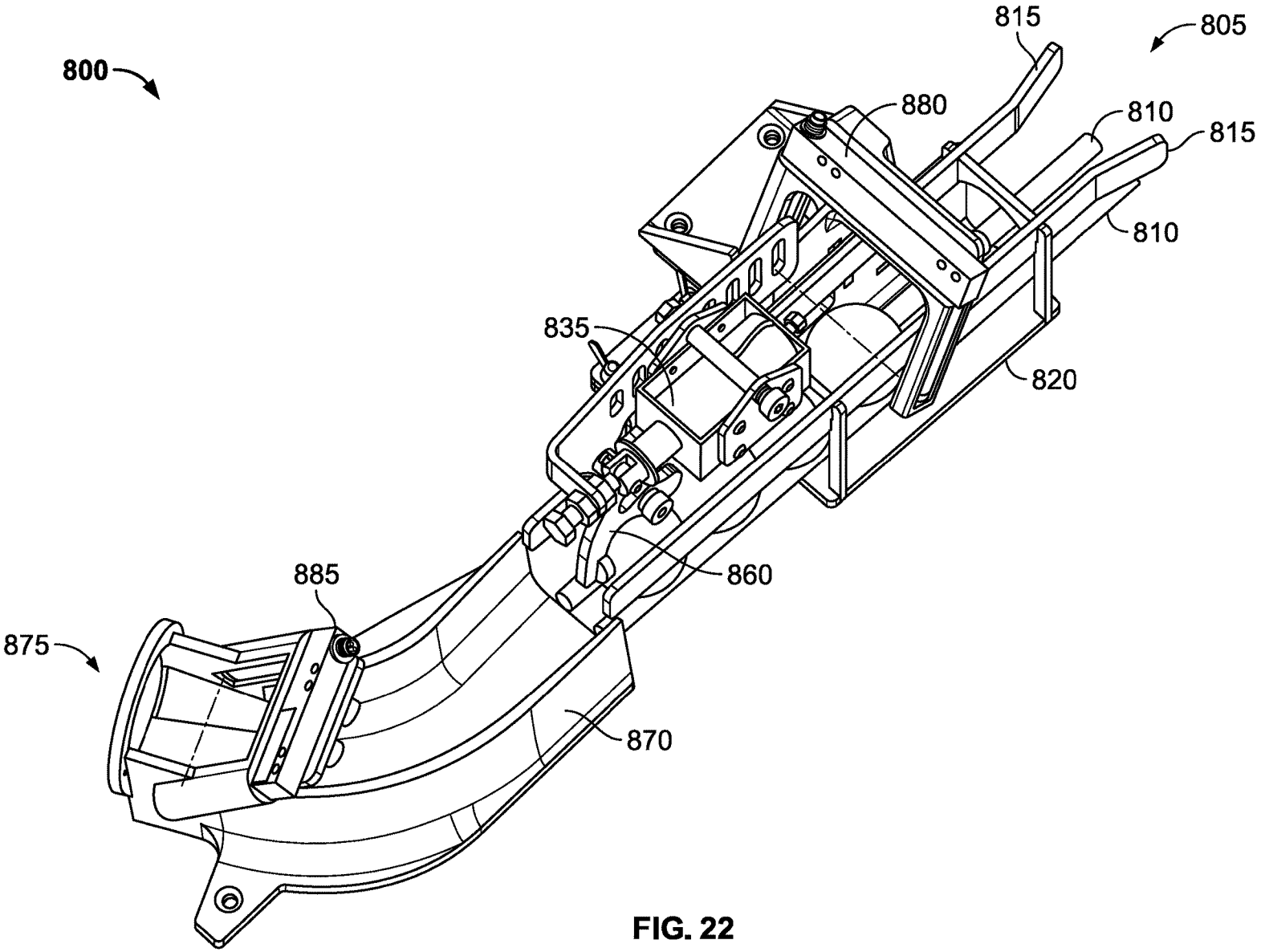
FIGS. 22-24 depict an example ball-dispensing assembly of the standalone miniature-golf structure of FIG. 1.

FIG. 4 illustrates the standalone miniature golf structure 10 with the putting surface 120 removed to depict components that are otherwise housed underneath the putting surface 120. In the illustrated example, the standalone miniature golf structure 10 includes one or more supports 105 one which the putting surface 120 is to rest. Additionally, the standalone miniature golf structure 10 includes a ball-return surface that is configured to transport a golf ball that has been putted into the sensor assembly 300 to the ball-dispensing assembly 800 (FIGS. 7 and 22).

FIG. 5 further depicts the putting surface 120, the ball-return surface 150, and the sensor assembly 300. The front end of the putting surface 120 is adjacent to the tee surface 110 (FIGS. 1-3) from which players are to putt golf balls. The rear end of the putting surface 120 is adjacent to the sensor assembly 300. The putting surface 120 also includes the rear end 125 at the rear end. The rear end 125 extends laterally between opposing sides of the putting surface 120. In the illustrated example, the rear end 125 extends perpendicularly to a longitudinal axis of the putting surface 120.

Turning to FIG. 6, the sensor assembly 300 is positioned adjacent to and extends along the rear end 125 of the putting surface 120. The sensor assembly 300 is positioned in such a manner relative to the putting surface 120 to detect a lateral position of the shot 130. That is, the sensor assembly 300 is positioned to detect the lateral position at which the golf ball crosses the rear end 125 of the putting surface 120 upon being putted by the player. In the illustrated example, the sensor assembly defines a plurality of ball-detection lanes 450 that are arranged in a side-by-side manner along the width of the sensor assembly 300. Each of the ball-detection lanes 450 aligns and corresponds with a respective lateral position along the rear end 125 of the putting surface 120 to facilitate the sensor assembly 300 in detecting the lateral position at which a golf ball crosses the rear end 125. In the illustrated example, each of the ball-detection lanes 450 is adjacent to and extends perpendicular to the rear end of the putting surface 120.

Returning to FIG. 5, the ball-return surface 150 is positioned underneath the putting surface 120 to facilitate the subsequent return of the golf ball to the tee surface 110 (FIGS. 1-3) for another shot. As shown in FIG. 7, the ball-return surface 150 extends between the sensor assembly 300 and the ball-dispensing assembly 800. In particular, the ball-return surface of the illustrated example extends from a front edge of a sensor cartridge (e.g., a front edge 436 of a sensor cartridge of FIG. 10, a front edge 636 of a sensor cartridge of FIG. 16, etc.) of the sensor assembly 300 to the ball-dispensing assembly 800. The putting surface 120, the sensor assembly 300, and the ball-return surface 150 are arranged with respect to each other such that after the golf ball enters one of the ball-detection lanes 450 (FIG. 6), the golf ball drops onto an upper surface of the sensor cartridge (e.g., an upper surface 435 of the sensor cartridge of FIG. 10, an upper surface 635 of the sensor cartridge of FIG. 16, etc.) and subsequently travels along the ball-return surface 150 toward the ball-dispensing assembly 800. FIG. 7 depicts an example of the return path 135 of the golf ball. That is, the sensor assembly 300 is configured to direct the golf ball from the rear end 125 of the putting surface 120 and to the ball-return surface 150 and the ball-dispensing assembly 800 to return the golf ball back to the tee surface 110 for a subsequent putt.

As shown in FIG. 5, the ball-return surface 150 is oriented at a decline from the sensor assembly 300 to the ball-dispensing assembly 800 to enable gravity to assist in the return of the golf ball toward the tee surface 110. Returning to FIG. 5, the putting surface 120 is angled at an incline from its front end to its rear end. The putting surface 120 is inclined to enable the ball-return surface 150 to be positioned below the putting surface 120 at a decline.

Figure 8:
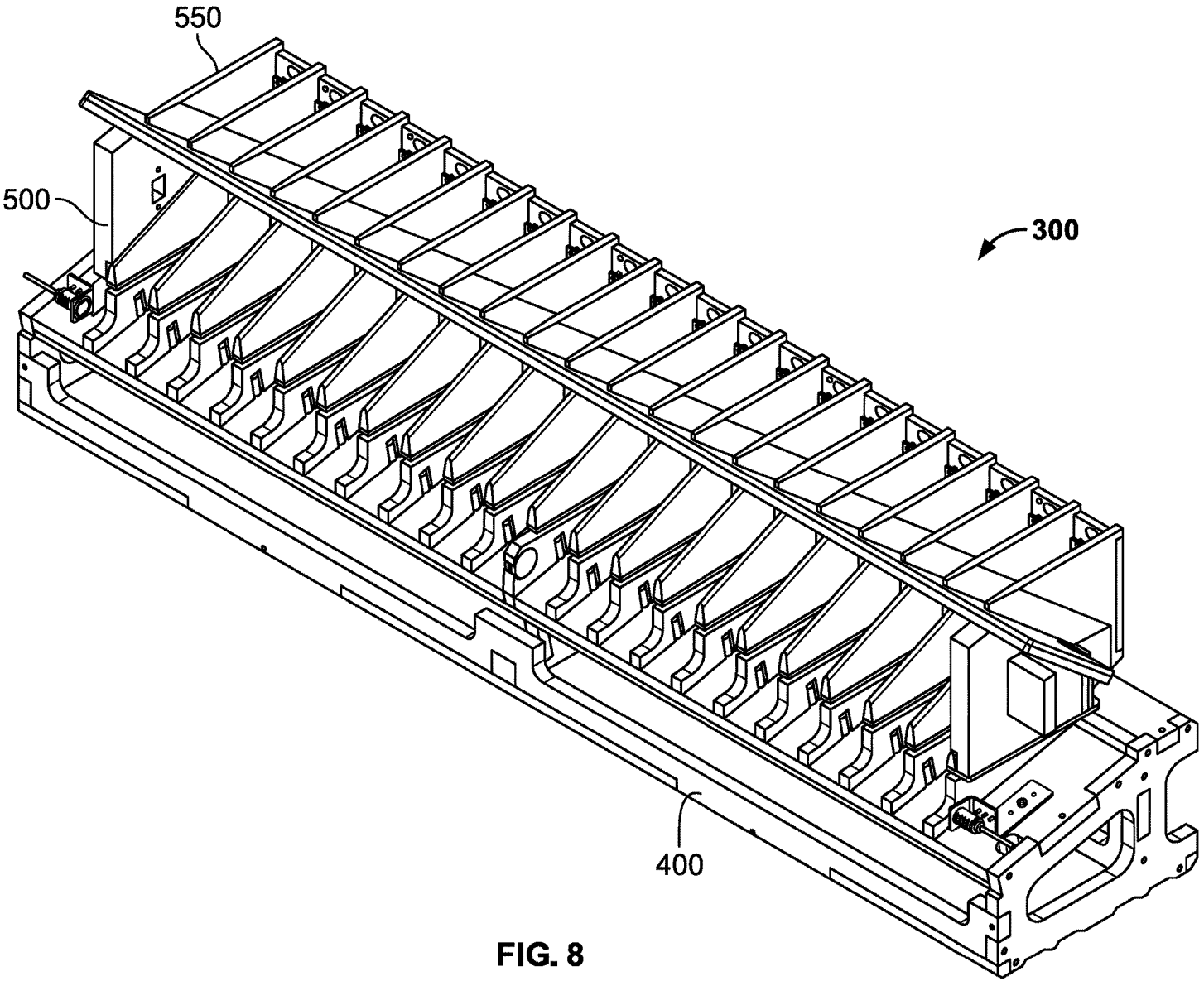
FIGS. 8-9 depict the sensor assembly of FIG. 5.
Figure 9:
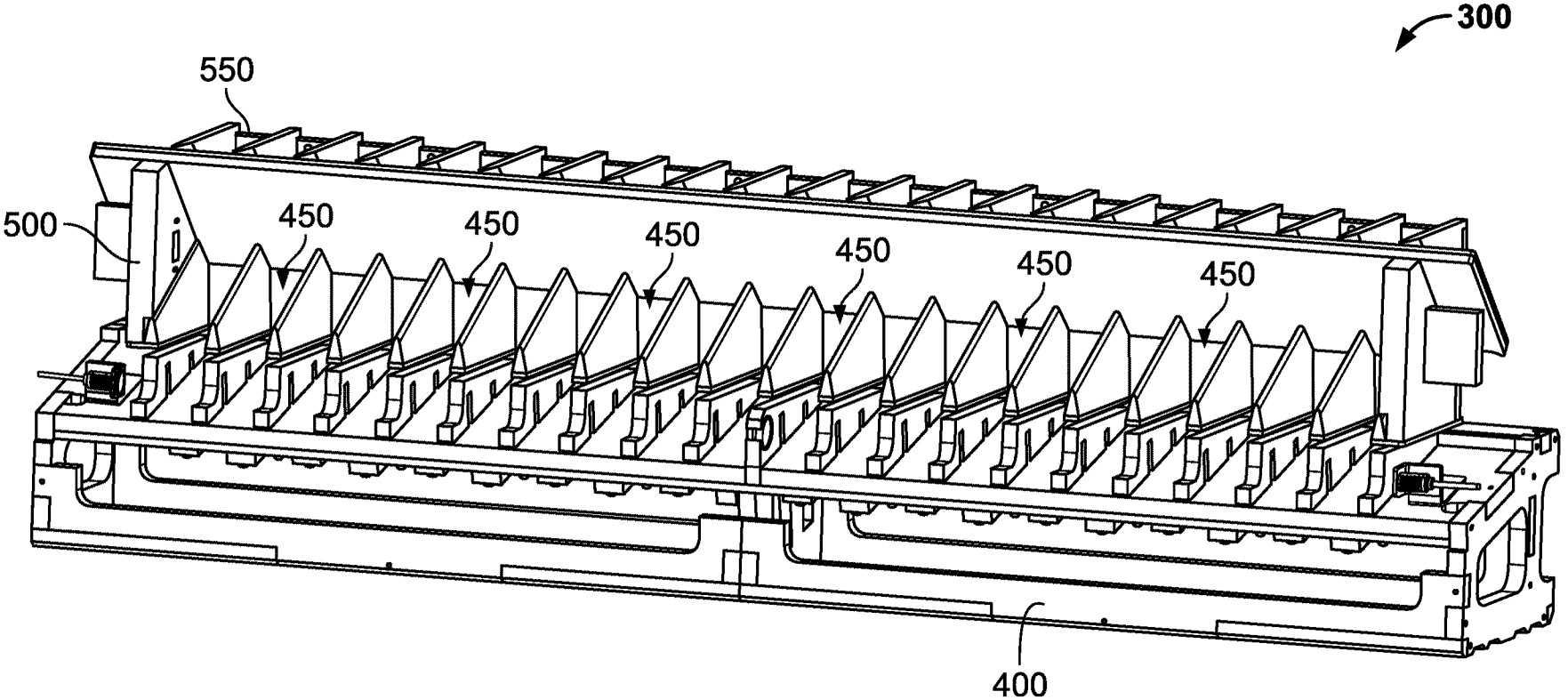

FIGS. 8-9 depict an example of the sensor assembly 300 that includes a sensor cartridge 400, a deflector tray 500, and a lighting housing 550. The deflector tray 500 is positioned above the sensor cartridge 400, and the lighting housing 550 is positioned behind the deflector tray 500. In the illustrated example, the sensor cartridge 400 and/or the deflector tray 500 define each of the ball-detection lanes 450. That is, in some examples, the sensor cartridge 400 defines the ball-detection lanes 450. In other examples, the deflector tray 500 define the ball-detection lanes 450. In other examples, a combination of the sensor cartridge 400 and the deflector tray 500 define the ball-detection lanes 450.

Figure 10:
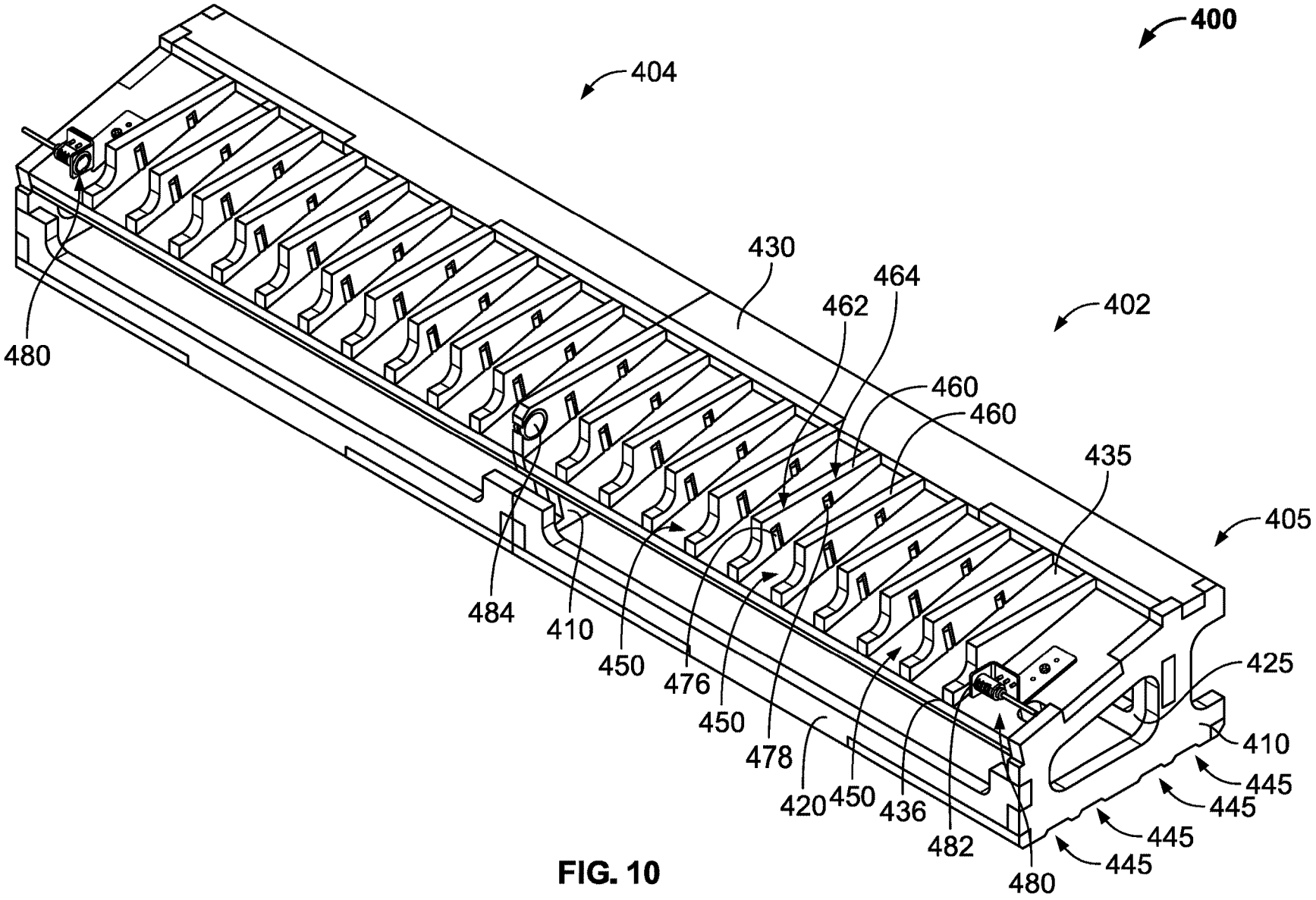
FIGS. 10-12 depict an example sensor cartridge of the sensor assembly of FIG. 5.
Figure 11:
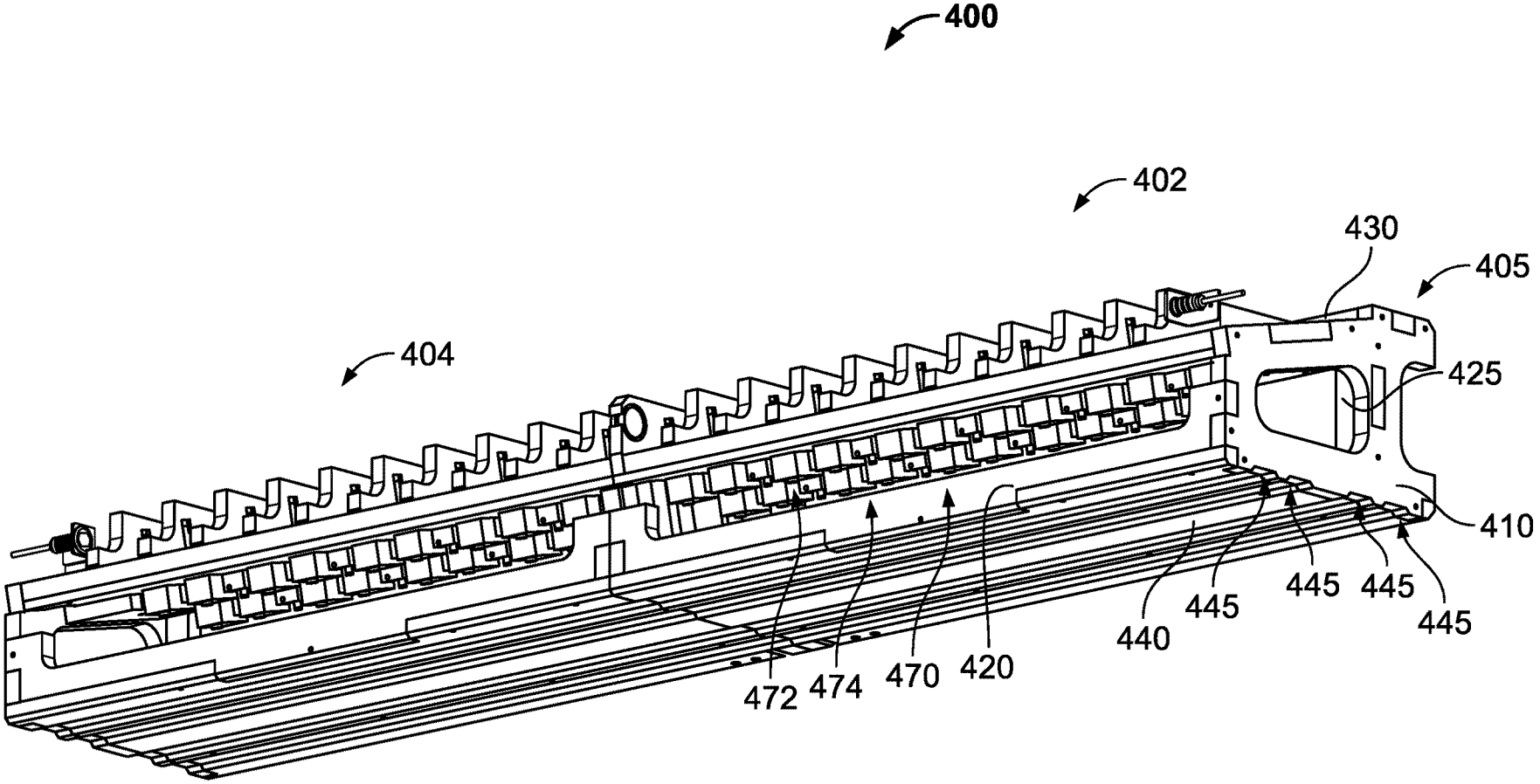
Figure 12:
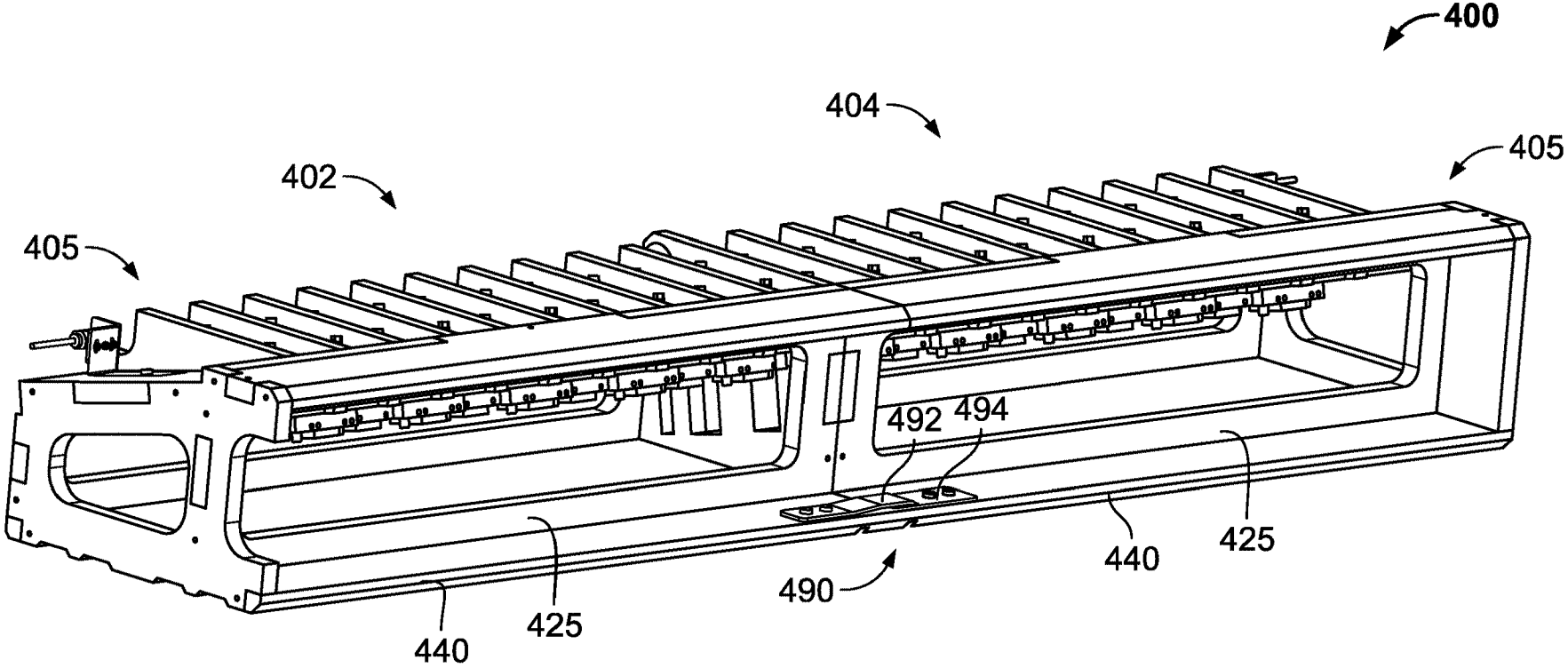

FIGS. 10-12 further depict the example sensor cartridge 400 of the sensor assembly 300. The sensor cartridge 400 a plurality of sensors 470 (also referred to as "first sensors" and "lane-detection sensors") configured to detect a lateral position at which a golf ball crosses the rear end 125 of the putting surface 120. For example, each of the sensors 470 is configured to monitor a predefined lateral position along the rear end 125 of the putting surface 120 to detect when a golf ball traverses the corresponding predefined lateral position. In the illustrated example, each of the sensors 470 corresponds with one of the ball-detection lanes 450 and is configured to detect when a golf ball travels through the corresponding ball-detection lane 450.

The sensor assembly 300 includes a body 405. The body 405 includes an upper panel 430 that defines an upper surface 435 along which golf balls are to travel (e.g., between the putting surface 120 and the ball-return surface 150). In the illustrated example, the body 405 also includes a plurality of side panels 410, a front panel 420, a rear panel 425, and a bottom panel 440. The front panel 420, the rear panel 425, and the bottom panel 440 extend laterally between two of the side panels 410. In the illustrated example, each of the side panels 410, the front panel 420, and the rear panel 425 defines openings to provide access to one or more components, such as the sensors 470, housed beneath the upper panel 430 of the sensor cartridge 400. Additionally or alternatively, each of the side panels 410, the front panel 420, the rear panel 425, the upper panel 430, and/or the bottom panel 440 may be decoupled from the other components of the body 405 to provide access to components housed beneath the upper panel 430.

The upper surface 435 includes a front edge 436 and a rear edge. The upper surface 435 is sloped downward from the rear edge and to the front edge 436 to guide the golf ball the front edge 436. For example, as disclosed below in greater detail, the front edge 436 of the sensor cartridge 400 is positioned adjacent to and flush with the ball-return surface 150. The upper surface 435 is sloped downward toward the front edge 436 to guide the golf ball from the upper surface 435 of the sensor cartridge 400 and onto the ball-return surface 150.

Additionally, the sensor cartridge 400 of the illustrated example include a plurality of walls 460 (also referred to as "lane walls") that protrude upwardly from the upper surface 435. Each wall 460 extends between the rear edge and the front edge 436 of the upper surface 435, The walls 460 are parallel to and spaced apart from each other to at least partially define the ball-detection lanes 450. In the illustrated example, the walls 460 are perpendicular to the front edge 436 of the upper surface 435 of the sensor cartridge 400 so that each of the ball-detection lanes 450 extends parallel to the putting surface 120 of the standalone miniature golf structure 10. Each of the ball-detection lanes 450 includes an outlet that is located adjacent to the front edge 436 of the upper surface 435. With the upper surface 435 being angled downward from the rear edge and to the front edge 436, any golf ball that lands onto the upper surface 435 is guided through the outlet of one of the ball-detection lanes 450.

In the illustrated example, each of the sensors 470 is a fork sensor, with each fork sensor including two opposing prongs. As shown in FIG. 11, each of the fork sensors includes a body (also referred to as a "sensor body") that is positioned below the upper panel 430. Each prong of a fork sensor extends upwardly from the respective sensor body and into an opening defined by a wall 460. Each prong of a fork sensor extends into a respective opening of adjacent walls 460 to enable the fork sensor to monitor a ball-detection lane 450 located between the adjacent walls 460.

Further, in the illustrated example, the sensors 470 are arranged such that each of the ball-detection lanes 450 is monitored by two of the sensors 470. As shown in FIG. 11, the sensors 470 include a plurality of front sensors 472 and a plurality of rear sensors 474. Each of the front sensors 472 and rear sensors 474 is a fork sensor in the illustrated example. Each ball-detection lane 450 is monitored by a respective front sensor 472 and a respective rear sensor 474 to ensure that a golf ball that enters the respective ball-detection lane 450 is detected. As shown in FIG. 10, each wall 460 defines a front opening 462 and a rear opening 464 that faces an adjacent ball-detection lane 450. The front opening 462 is configured to receive a prong 476 of a respective front sensor 472, and the rear opening 464 is configured to receive a prong 478 of a respective rear sensor 474. Further, in the illustrated example, each front sensor 472 is offset from adjacent front sensors 472, and each rear sensor 474 is offset from adjacent rear sensors 474. The two sensors 470 for each ball-detection lane 450 are staggered relative to the two sensors 470 of the adjacent ball-detection lanes 450 to enable each of the sensors 470 to fit in a relatively compact area along the sensor cartridge 400.

The sensor cartridge 400 of the illustrated example also includes one or more sensors 480 (also referred to as "second sensors" and "ball-detection sensors") that are configured to detect when a golf ball crosses the front edge 436 of the sensor cartridge 400. The sensors 480 are positioned near the front edge 436 to detect when a golf ball crosses the front edge 436. The sensors 480 may include proximity sensors, such as non-contact proximity sensors. The sensors 480 may include photoelectric sensors, such as photoelectric beam sensors. In the illustrated example, each sensor 480 include a transmitter 482 and a receiver 484 that are spaced apart and facing each other. The sensor 480 is configured to detect when a golf ball crosses any portion along the front edge 436 that is located between the transmitter 482 and the receiver 484. As disclosed below in greater detail, the time at which the golf ball crosses the front edge 436 is used to control when the ball-dispensing assembly 800 is to dispense another golf ball for a subsequent shot.

Figure 13:
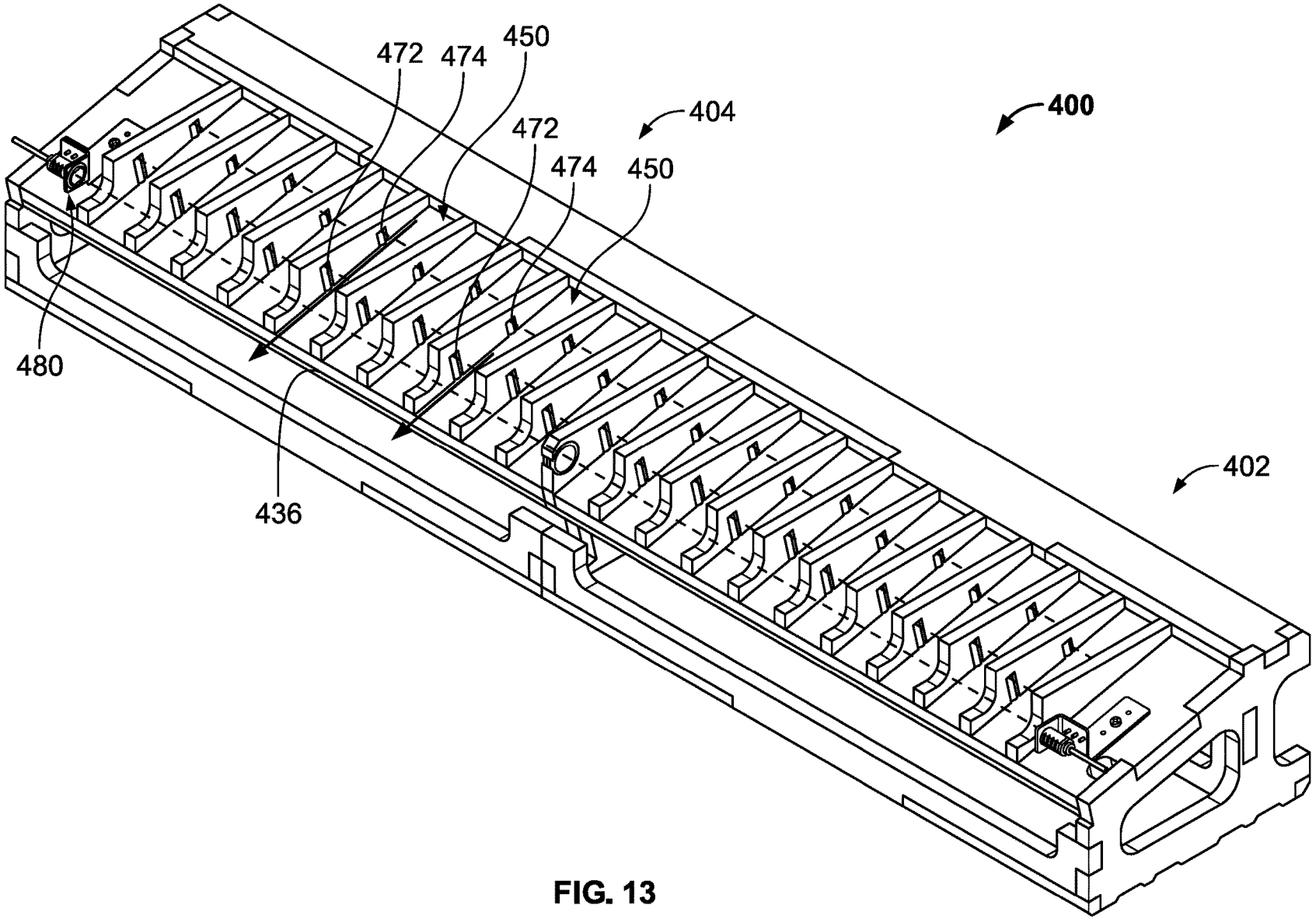
FIG. 13 depicts detection of various shots by the sensor cartridge of FIG. 10.

Turning to FIG. 13, depicts the sensor cartridge 400 detecting two shots that land at different locations on the upper surface 435. FIG. 13 includes two lines with arrows, with each of those arrows depicts the path of the golf ball for the respective shot. Horizontal lines depict detection beams of each of the front sensors 472 and the rear sensors 474 of the sensors 470. Other horizontal lines depict detection beams of the sensors 480.

In the illustrated example, the leftmost shot lands near the rear edge of the upper surface 435. Both the front sensor 472 and the rear sensor 474 of the corresponding ball-detection lane 450 are configured to detect that the golf ball has traveled through the ball-detection lane 450. Additionally, the sensor 480 is configured to detect when the golf ball crosses the front edge 436 and travels off the sensor cartridge 400. The right shot lands near the middle of one of the ball-detection lanes 450. As a result, the front sensor 472 of the ball-detection lane 450 is configured to detect that the golf ball has traveled through the ball-detection lane 450. The sensor 480 also is configured to detect when the golf ball crosses the front edge 436 and travels off the sensor cartridge 400.

Returning to FIGS. 10-11, the bottom panel 440 defines one or more grooves 415 that extend laterally along the bottom panel 440. As disclosed below in greater detail with respect to FIGS. 20-21, each of the grooves 415 is configured to receive a respective roller conveyor 720, 730 of a cartridge chamber 700 in which the sensor cartridge 400 is housed to facilitate insertion and removal of the sensor cartridge into and from the cartridge chamber 700, respectively.

In some examples, the sensor cartridge 400 is formed by a plurality of cartridge bodies that are coupled together. In the illustrated example, the sensor cartridge 400 is formed by a cartridge body 402 (also referred to as a "first body" and a "first cartridge body") and a cartridge body 404 (also referred to as a "second body" and a "second cartridge body"). The cartridge body 402 forms a first half of the sensor cartridge 400, and the cartridge body 404 forms a second half of the sensor cartridge 400.

Each cartridge body 402, 404 includes side panels 410, a front panel 420, a rear panel 425, an upper panel 430, and a bottom panel 440. The side panels 410 of the cartridge bodies 402, 404 combine to form the side panels 410 of the sensor cartridge 400. The front panels 420 of the cartridge bodies 402, 404 combine to form the front panel 420 of the sensor cartridge 400. The rear panels 425 of the cartridge bodies 402, 404 combine to form the rear panel 425 of the sensor cartridge 400. The upper panels 430 of the cartridge bodies 402, 404 combine to form the upper panel 430 of the sensor cartridge 400. The bottom panels 440 of the cartridge bodies 402, 404 combine to form the bottom panel 440 of the sensor cartridge 400. Additionally, the upper surfaces 435 and the front edges 436 of the cartridge bodies 402, 404 combine to form the upper surface 435 and the front edge 436, respectively, of the sensor cartridge 400. Each of the cartridge bodies 402, 404 includes a portion of the walls 460, the sensors 470, and the sensors 480. For example, each of the cartridge bodies 402, 404 include half of the walls 460, the sensors 470, and the sensors 480.

As shown in FIG. 12 the sensor cartridge 400 includes a latch assembly 490 that is configured to couple the cartridge bodies 402, 404 together to form the sensor cartridge 400. The latch assembly 490 includes a latch 492 and a slot body 494. The latch 492 is securely fastened to one of the cartridge bodies 402, 404. The slot body 494 is coupled to the other of the cartridge bodies 402, 404. To couple the cartridge bodies 402, 404 together, the latch 492 is inserted into a slot defined by the slot body 494. To decouple the cartridge bodies 402, 404 from each other, the latch 492 is removed from the slot of the slot body 494.

The sensor cartridge 400 is formed of the cartridge bodies 402, 404 to enable the standalone miniature golf structure 10 to be installed in tighter spaces. For example, when the sensor cartridge 400 is formed of a single body that cannot be separated, an operator would need a clearance of at least the length of the sensor cartridge 400 along the side of the body 15 of the standalone miniature golf structure 10 to remove the sensor cartridge 400 from the cartridge chamber 700, for example, for maintenance purposes. With the sensor cartridge 400 of the illustrated example being formed of the cartridge bodies 402, 404 that are detachable from each other, the requisite clearance can be reduced in half. For example, to remove the sensor cartridge 400 from the cartridge chamber 700, the operator can pull one of the cartridge bodies 402, 404 from the cartridge chamber 700; detach the cartridge bodies 402, 404 from each other; place the first of the cartridge bodies 402, 404 to the side; and then remove the other of the cartridge bodies 402, 404 from the cartridge chamber 700.

Figure 14:
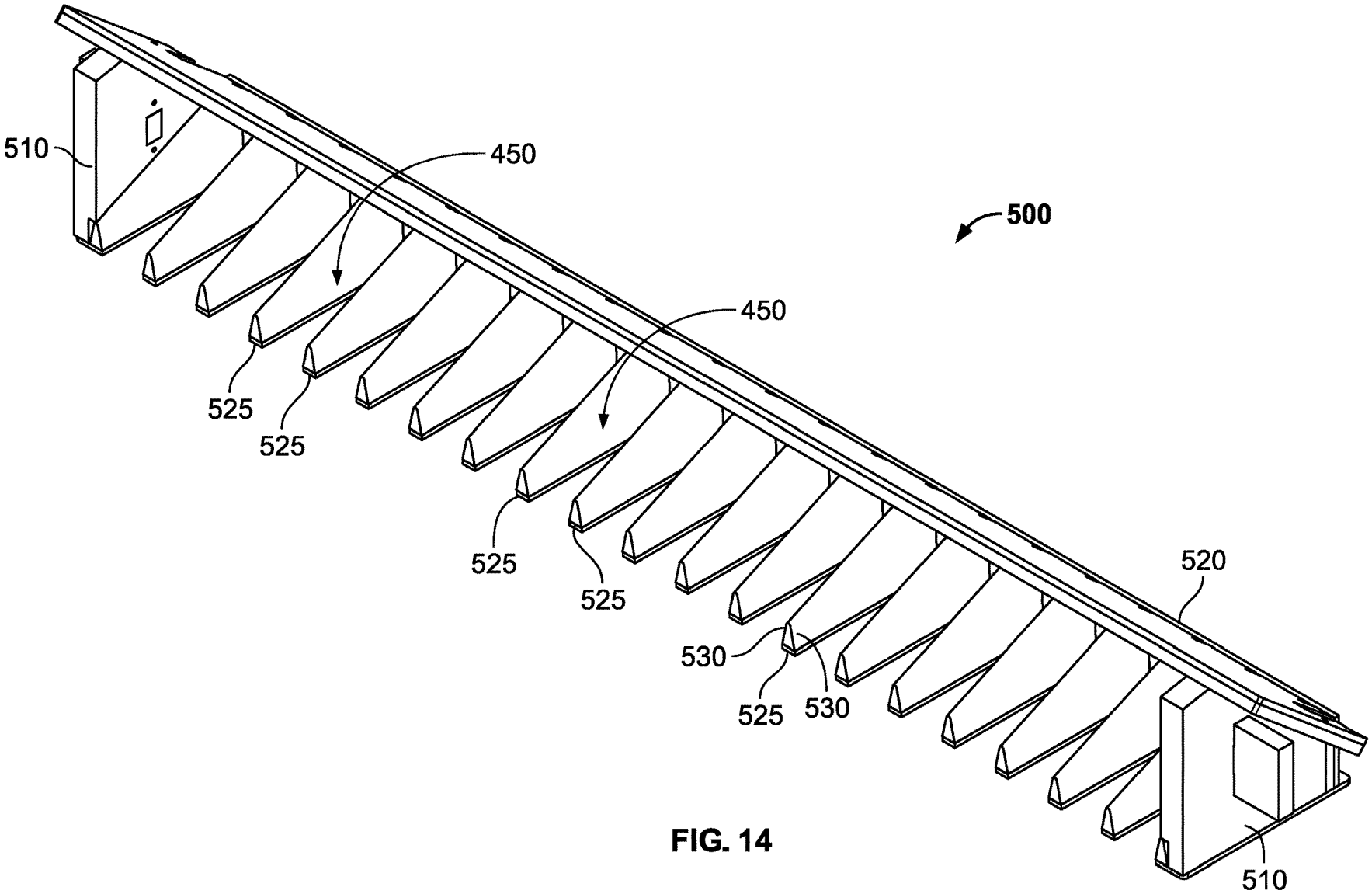
FIG. 14 is a perspective view of an example deflector tray of the sensor assembly of FIG. 5.

Turning to FIG. 14, the example deflector tray 500 of the sensor assembly 300 is further depicted. In the illustrated example, the deflector tray 500 includes opposing side walls 510 and a roof 520 that extends between and is connected to the side walls 510. The roof 520 is angled upward from a rear to a front of the deflector tray 500. The roof is angled upward to reflect light emitted by the lights 575 of the lighting housing 550 (FIG. 15) to illuminate one or more of the ball-detection lanes 450 associated with a target and/or an executed putt.

The deflector tray 500 of the illustrated example includes a plurality of deflectors 525. The deflectors 525 are spaced apart from each other and arranged in a side-by-side manner between the opposing side walls 510 to at least partially define the ball-detection lanes 450. The deflectors 525 from the rear and toward the front of the deflector tray 500 such that each of the ball-detection lanes 450 extend perpendicular to the rear end 125 of the putting surface 120. Additionally, each of the deflectors 525 include opposing deflecting surfaces 530. For example, each deflector 525 includes a left deflecting surface 530 and a right deflecting surface 530. The left deflecting surface 530 is configured to direct a golf ball into the ball-detection lane 450 to the left of the respective deflector 525, and the right deflecting surface 530 is configured to direct a golf ball into the ball-detection lane 450 to the right of the respective deflector 525.

Figure 15:
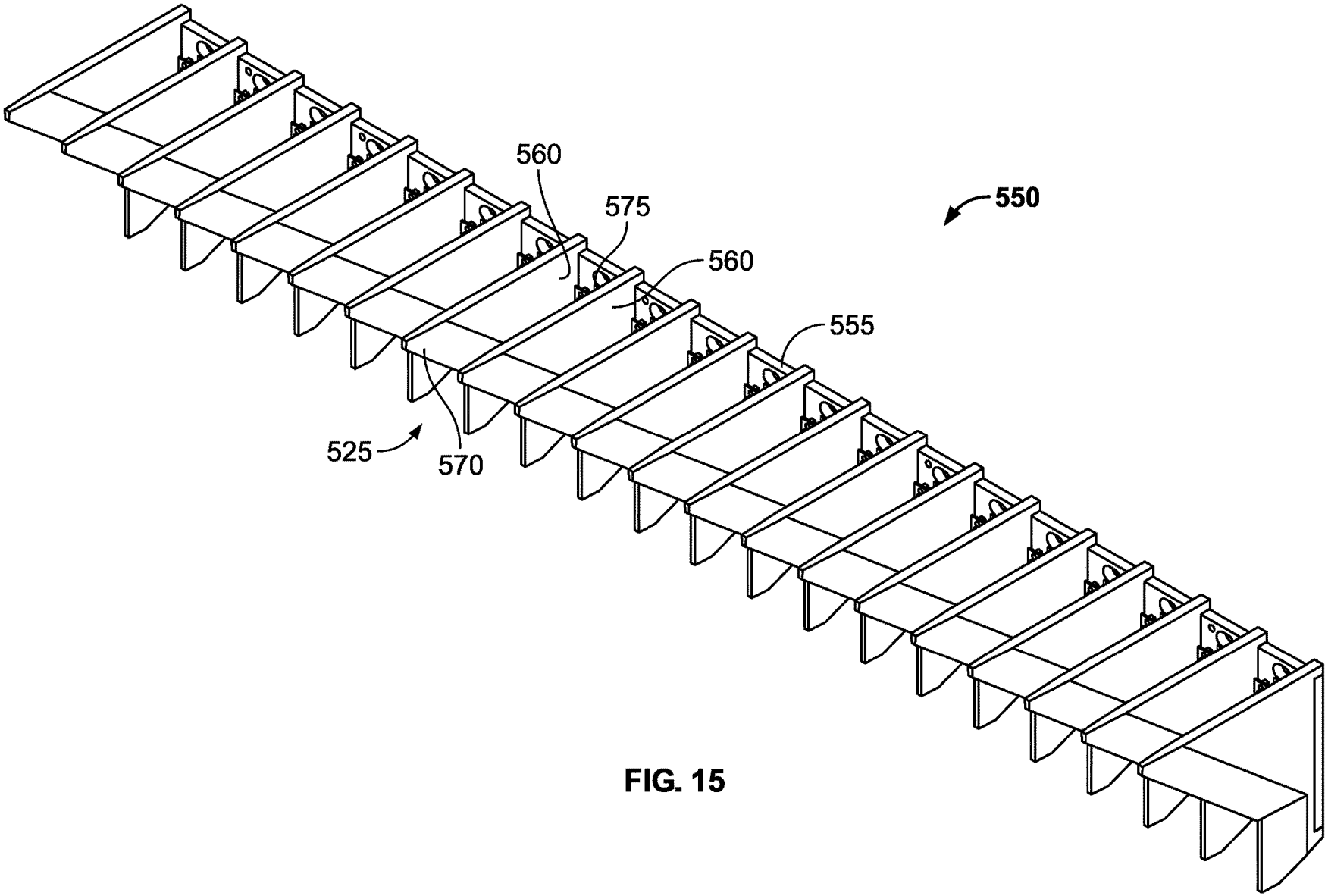
FIG. 15 is a perspective view of an example lighting housing of the sensor assembly of FIG. 5.

FIG. 15 further depicts the example lighting housing 550 of the sensor assembly 300. In the illustrated example, the lighting housing 550 includes a back panel 555 and a plurality of walls 560. The walls 560 extend forward from the back panel 555. In the illustrated example, each of the walls 560 is perpendicular to the back panel 555. The walls 560 are spaced apart from each other and arranged in a side-by-side manner to define lighting lanes 565 that extend forward from the back panel 555. The lighting housing 550 further includes a plurality of canopy panels 570, with each canopy panel 570 extending over a front end of a respective one of the lighting lanes 565.

The lighting housing 550 also includes a plurality of lights 575 (e.g., LEDs). Within each lighting lane 565, a respective light 575 is coupled to the back panel 555 and facing forward. Additionally, each lighting lane 565 is configured to align laterally with a respective one of the ball-detection lanes 450. The light 575 of each lighting lane 565 is configured to illuminate the corresponding ball-detection lane 450, for example, to indicate to a player that the ball-detection lane 450 corresponds with a target and/or to indicate to the player they just putted the golf ball into the ball-detection lane 450. Each light 575 is oriented and positioned relative to the canopy panel 570 of the respective lighting lane 565 and/or a back surface of the roof 520 of the deflector tray 500 to direct light emitted by the light 575 onto a surface that corresponds with the respective ball-detection lane 450.

Figure 16:
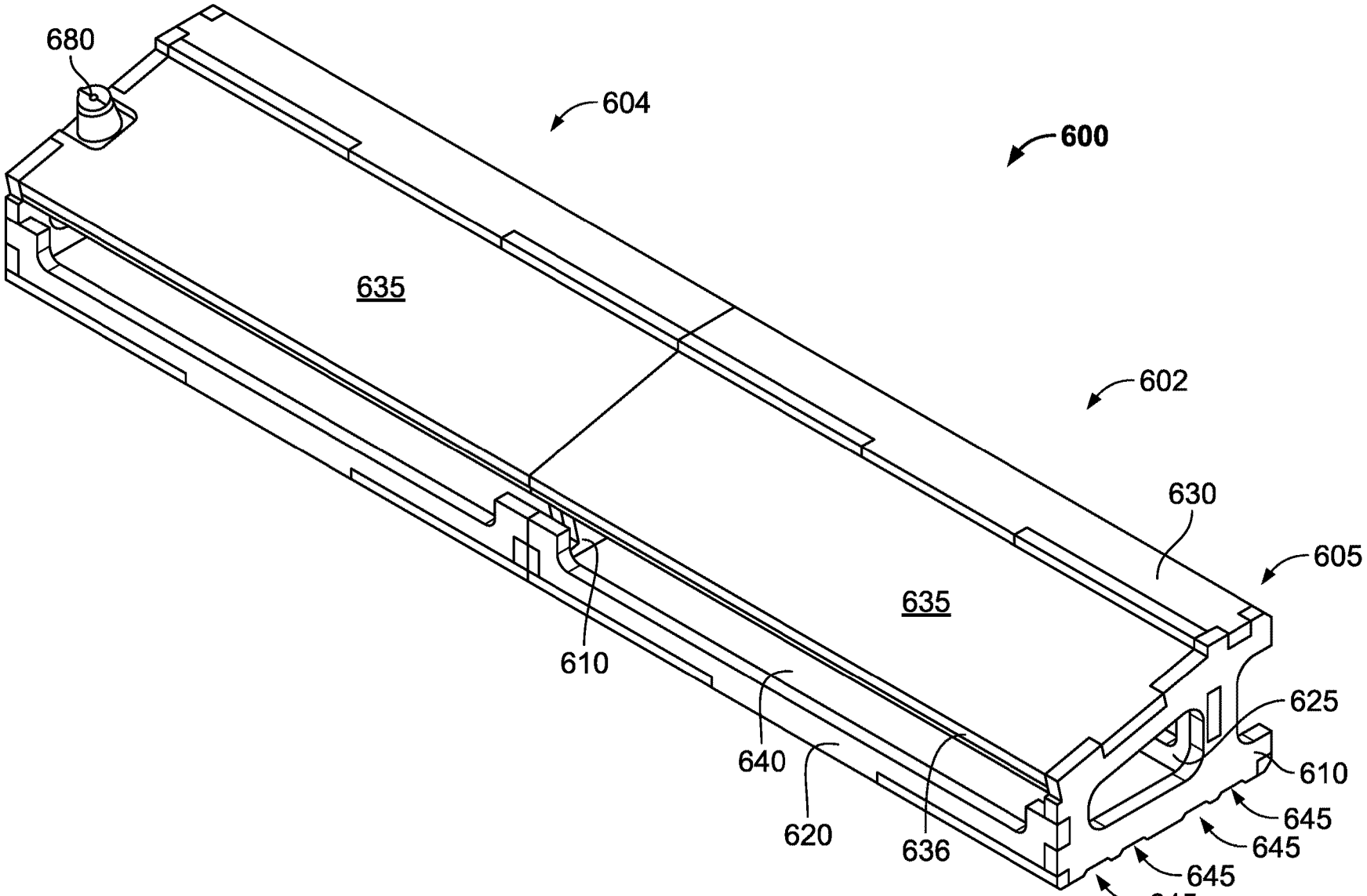
FIG. 16 is a perspective view of another example sensor cartridge of the sensor assembly of FIG. 5.

FIG. 16 depicts another example sensor cartridge 600 of the sensor assembly 300. For example, the sensor assembly 300 may include the sensor cartridge 600, the deflector tray 500, and the lighting housing 550, with the deflector tray 500 being positioned above the sensor cartridge 600 and the lighting housing 550 being positioned behind the deflector tray 500.

Figure 17:
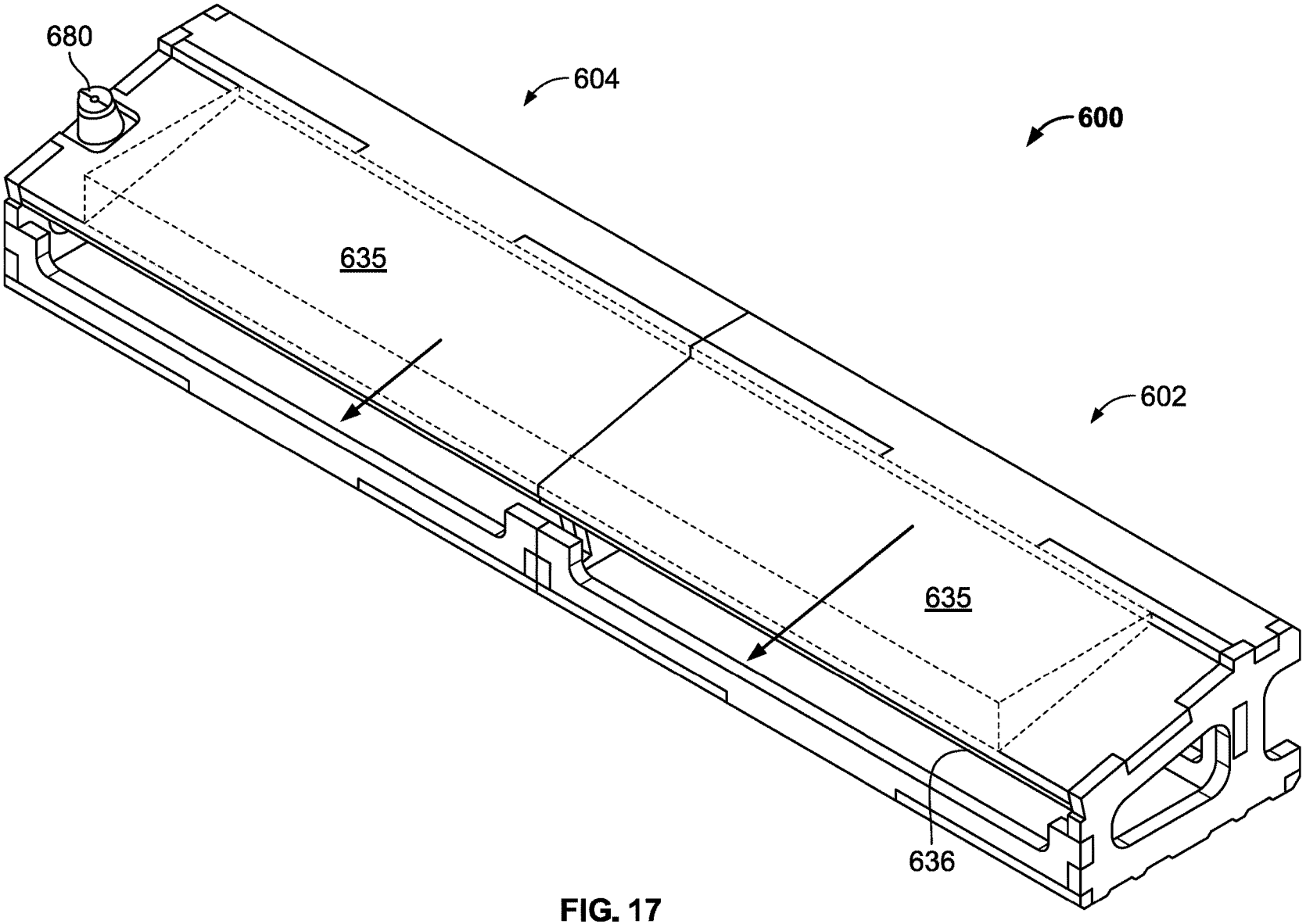
FIG. 17 depicts detection of various shots by the sensor cartridge of FIG. 16.

The sensor cartridge 600 includes a sensor 680 (also referred to as a "first sensor") configured to detect a lateral position at which a golf ball crosses the rear end 125 of the putting surface 120. FIG. 17 depicts the sensor 680 of the sensor cartridge 600 detecting two shots that land at different locations on the sensor cartridge 600. In the illustrated example, the sensor 680 is a lidar sensor and/or any other sensor that is capable of detecting the lateral position of a golf ball.

Returning to FIG. 17, the sensor cartridge 600 includes a body 605. The body 605 includes an upper panel 630 that defines an upper surface 635 along which golf balls are to travel (e.g., between the putting surface 120 and the ball-return surface 150). In the illustrated example, the body 605 also includes a plurality of side panels 610, a front panel 620, a rear panel 625, and a bottom panel 640. The front panel 620, the rear panel 625, and the bottom panel 640 extend laterally between two of the side panels 610. In the illustrated example, each of the side panels 610, the front panel 620, and the rear panel 625 defines openings to provide access to one or more components housed beneath the upper panel 630 of the sensor cartridge 600. Additionally or alternatively, each of the side panels 610, the front panel 620, the rear panel 625, the upper panel 630, and/or the bottom panel 640 may be decoupled from the other components of the body 605 to provide access to components housed beneath the upper panel 630.

The upper surface 635 includes a front edge 636 and a rear edge. The upper surface 635 is sloped downward from the rear edge and to the front edge 636 to guide the golf ball the front edge 636. For example, as disclosed below in greater detail, the front edge 636 of the sensor cartridge 600 is positioned adjacent to and flush with the ball-return surface 150. The upper surface 635 is sloped downward toward the front edge 636 to guide the golf ball from the upper surface 635 of the sensor cartridge 600 and onto the ball-return surface 150.

In some examples, the sensor cartridge 600 includes one or more second sensors that are configured to further detect when a golf ball crosses the front edge 636 of the sensor cartridge 600. The second sensors may be positioned near the front edge 636 to detect when a golf ball crosses the front edge 636. The second sensors may include proximity sensors, non-contact proximity sensors, photoelectric sensors, photoelectric beam sensors, etc. As disclosed below in greater detail, the time at which the golf ball crosses the front edge 636 is used to control when the ball-dispensing assembly 800 is to dispense another golf ball for a subsequent shot.

The bottom panel 640 defines one or more grooves 615 that extend laterally along the bottom panel 640. As disclosed below in greater detail with respect to FIGS. 20-21, each of the grooves 615 is configured to receive a respective roller conveyor 720, 730 of the cartridge chamber 700 in which the sensor cartridge 600 is housed to facilitate insertion and removal of the sensor cartridge into and from the cartridge chamber 700, respectively.

In some examples, the sensor cartridge 600 is formed by a plurality of cartridge bodies that are coupled together. In the illustrated example, the sensor cartridge 600 is formed by a cartridge body 602 (also referred to as a "first body" and a "first cartridge body") and a cartridge body 604 (also referred to as a "second body" and a "second cartridge body"). The cartridge body 602 forms a first half of the sensor cartridge 600, and the cartridge body 604 forms a second half of the sensor cartridge 600.

Each cartridge body 602, 604 includes side panels 610, a front panel 620, a rear panel 625, an upper panel 630, and a bottom panel 640. The side panels 610 of the cartridge bodies 602, 604 combine to form the side panels 610 of the sensor cartridge 600. The front panels 620 of the cartridge bodies 602, 604 combine to form the front panel 620 of the sensor cartridge 600. The rear panels 625 of the cartridge bodies 602, 604 combine to form the rear panel 625 of the sensor cartridge 600. The upper panels 630 of the cartridge bodies 602, 604 combine to form the upper panel 630 of the sensor cartridge 600. The bottom panels 640 of the cartridge bodies 602, 604 combine to form the bottom panel 640 of the sensor cartridge 600. Additionally, the upper surfaces 635 and the front edges 636 of the cartridge bodies 602, 604 combine to form the upper surface 635 and the front edge 636, respectively, of the sensor cartridge 600. In the illustrated example, the sensor 680 is coupled to the cartridge body 604. In other examples, the sensor 680 is coupled to the cartridge body 602. Further, in other examples, each cartridge body 602, 604 may includes a respective sensor 680 is configured to monitor the upper surface 635 of the corresponding cartridge body 602, 604.

Additionally, the sensor cartridge 400 may include a latch assembly that is configured to couple the cartridge bodies 602, 604 together to form the sensor cartridge 600. In such examples, the latch assembly includes a latch and a slot body. The latch is securely fastened to one of the cartridge bodies 602, 604. The slot body is coupled to the other of the cartridge bodies 602, 604. To couple the cartridge bodies 602, 604 together, the latch is inserted into a slot defined by the slot body. To decouple the cartridge bodies 602, 604 from each other, the latch is removed from the slot of the slot body.

The sensor cartridge 600 is formed of the cartridge bodies 602, 604 to enable the standalone miniature golf structure 10 to be installed in tighter spaces. For example, when the sensor cartridge 600 is formed of a single body that cannot be separated, an operator would need a clearance of at least the length of the sensor cartridge 600 along the side of the body 15 of the standalone miniature golf structure 10 to remove the sensor cartridge 600 from the cartridge chamber 700, for example, for maintenance purposes. With the sensor cartridge 600 of the illustrated example being formed of the cartridge bodies 602, 604 that are detachable from each other, the requisite clearance can be reduced in half. For example, to remove the sensor cartridge 600 from the cartridge chamber 700, the operator can pull one of the cartridge bodies 602, 604 from the cartridge chamber 700; detach the cartridge bodies 602, 604 from each other; place the first of the cartridge bodies 602, 604 to the side; and then remove the other of the cartridge bodies 602, 604 from the cartridge chamber 700.

Figure 18:
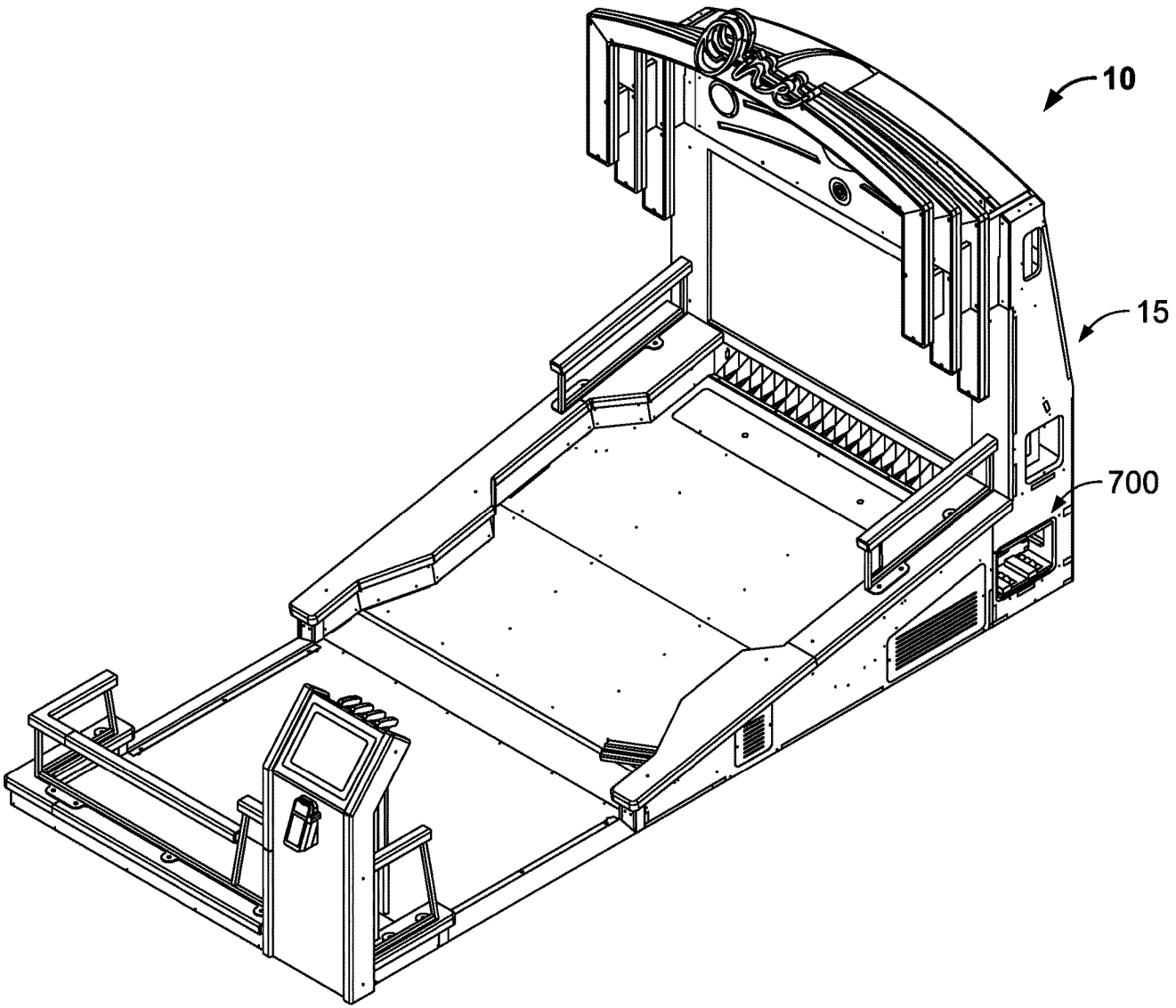
FIG. 18 depicts the standalone miniature-golf structure of FIG. 1 with various access panels removed.
Figure 19:
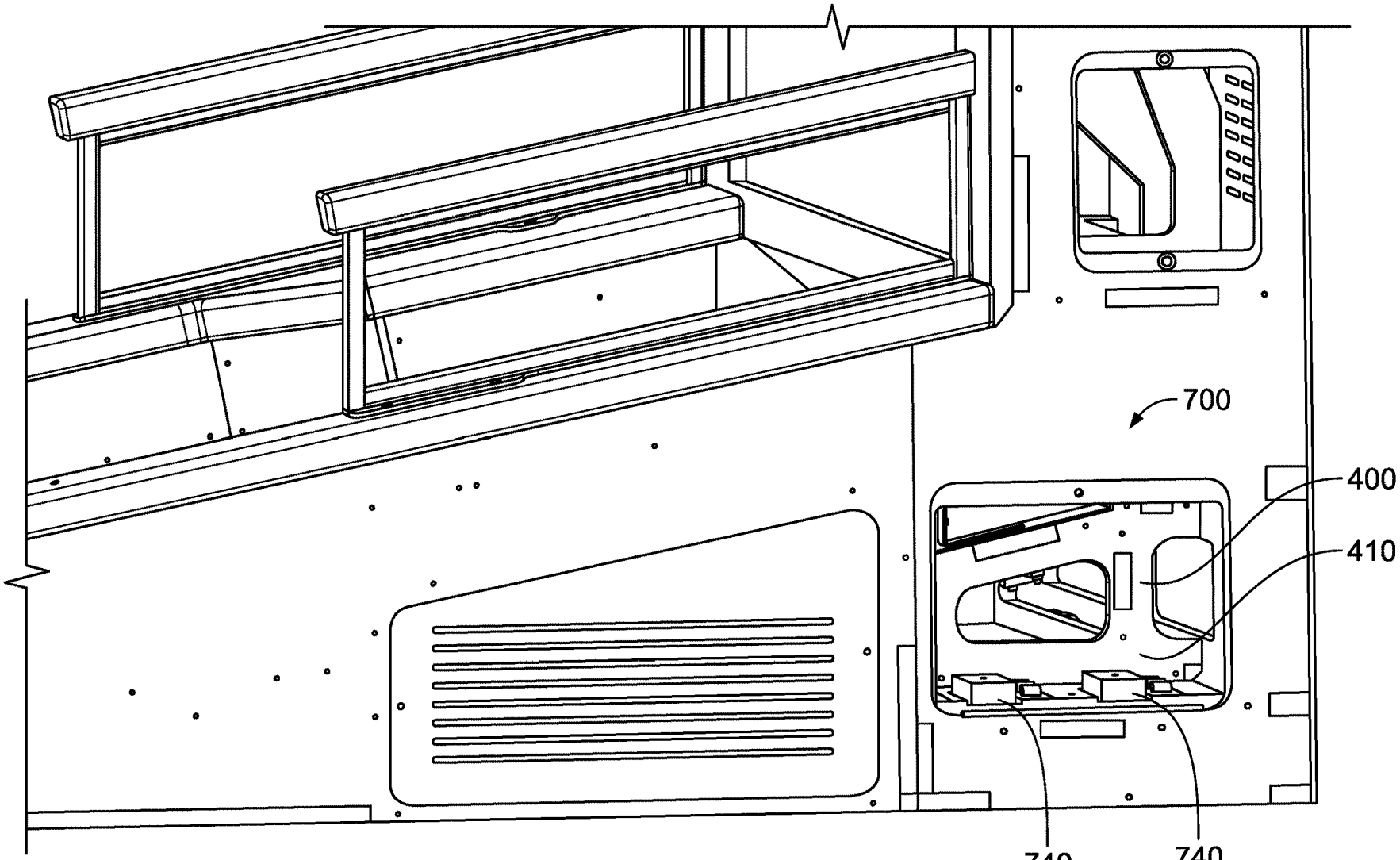
FIG. 19 depicts the sensor assembly of FIG. 5 housed in an example sensor chamber of the standalone miniature-golf structure of FIG. 1 that is accessed by removing an access panel.

FIG. 18 depicts the standalone miniature golf structure 10 with the access panels 23, 24, 25 removed from the body 15. The access panel 25 is detached from the body 15 to provide access to the cartridge chamber 700. The body 15 of the standalone miniature golf structure 10 defines the cartridge chamber 700. As shown in FIG. 19, the sensor cartridge 400, 600 of the sensor assembly 300 is housed in the cartridge chamber 700. The cartridge chamber 700 is located adjacent to the rear end 125 of the putting surface 120 and the ball-return surface 150 so that the sensor cartridge 400, 600 may be securely housed in place next to the rear end 125 of the putting surface 120 and the ball-return surface 150.

Figure 21:
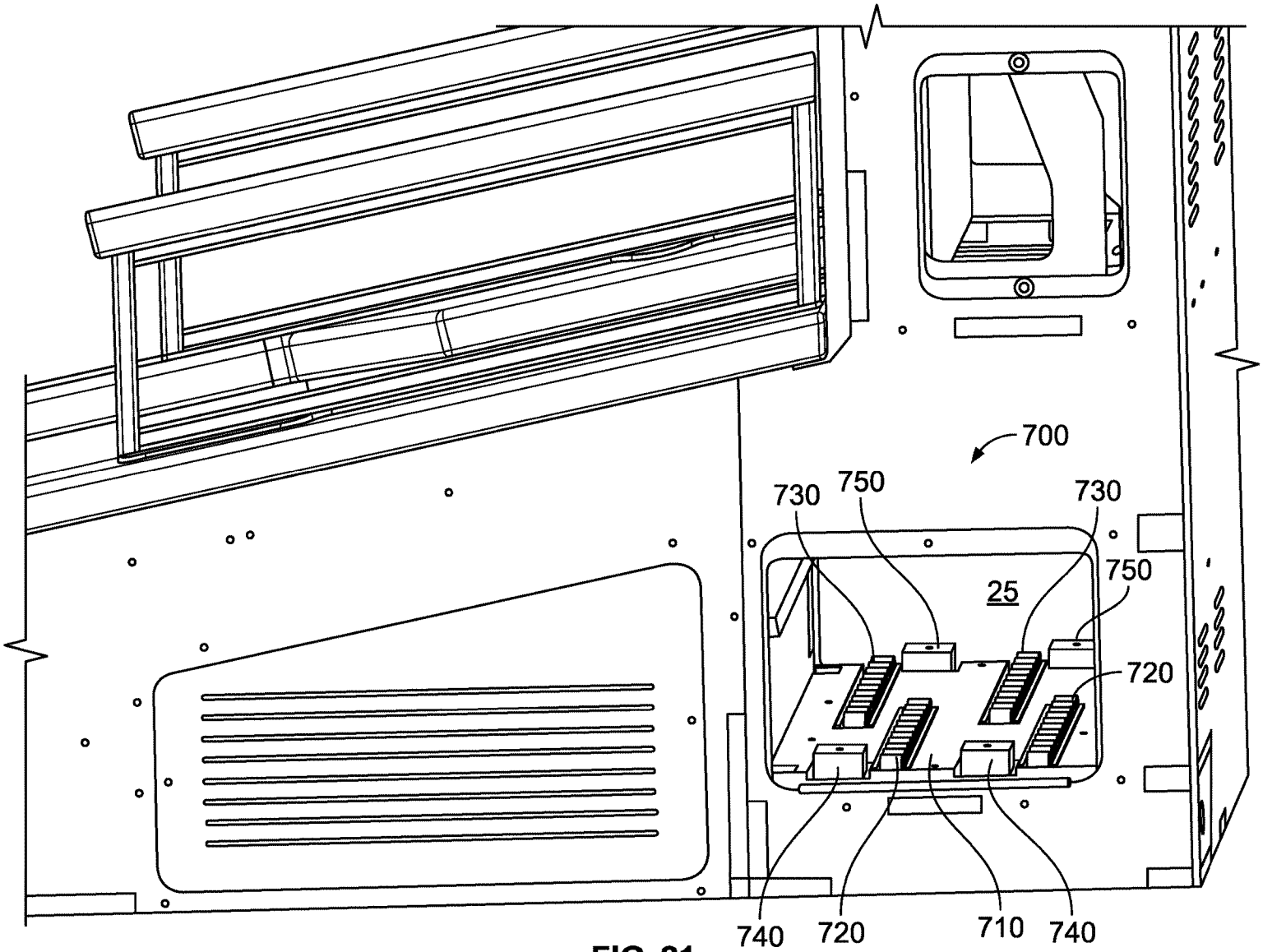

Turning to FIG. 21, the standalone miniature golf structure 10 includes two access panels 25 that are configured to be removed from the body 15 to access the cartridge chamber 700. For example, the two access panels 25 are configured to be located on opposite ends of the cartridge chamber 700. One access panel 25 is configured to be located on a left side of the body 15, and the other access panel 25 is configured to be located on a right side of the body 15. In the illustrated example, the access panel 25 on the left side remains coupled to the body 15, and the access panel 25 on the right side has been removed to provide access to the cartridge chamber 700.

Figure 20:
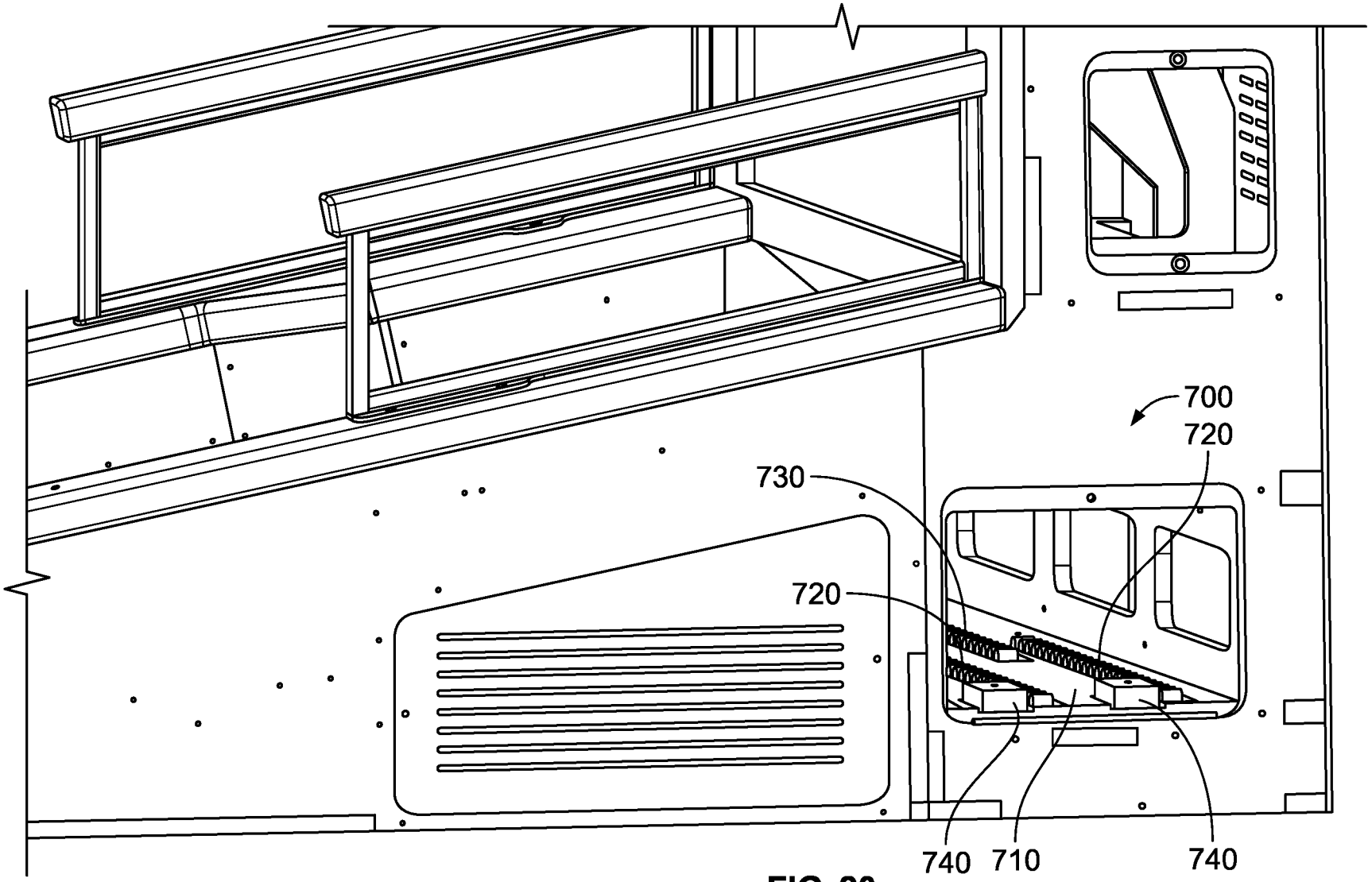
FIGS. 20-21 further depict the sensor chamber of FIG. 19.

The sensor cartridge 400, 600 is configured to be securely housed in the cartridge chamber 700 during operation of the standalone miniature golf structure 10 and is removable from the cartridge chamber 700 for maintenance purposes. FIG. 19 depicts the cartridge chamber 700 with the sensor cartridge 400, 600 housed in the cartridge chamber 700. FIGS. 20-21 depict the cartridge chamber 700 with the sensor cartridge 400, 600 removed from the cartridge chamber 700.

As shown in FIGS. 20-21, the standalone miniature golf structure 10 includes a floor 710 of the cartridge chamber 700.

The standalone miniature golf structure 10 includes one or more roller conveyors 720, 730 that extends along the floor 710 of the cartridge chamber 700. The roller conveyors 720, 730 extend along the length of the cartridge chamber 700. In the illustrated example, the roller conveyors 720, 730 between both access points of the cartridge chamber 700. The roller conveyors 720 are configured to facilitate the sensor cartridge 400, 600 in sliding in and out of the cartridge chamber 700. The roller conveyors 720 are located adjacent to the right-side access point to facilitate the sensor cartridge 400, 600 in being inserted into and removed from the cartridge chamber 700 via the right-side access point. The roller conveyors 730 are located adjacent to the left-side access point to facilitate the sensor cartridge 400, 600 in being inserted into and removed from the cartridge chamber 700 via the left-side access point.

The standalone miniature golf structure 10 includes one or more stopper blocks 740, 750 for the cartridge chamber 700. When the sensor cartridge 400, 600 is placed in the cartridge chamber 700, as shown in FIG. 19, the stopper blocks 740, 750 are configured to engage the sensor cartridge 400, 600 to secure the sensor cartridge 400, 600 in place. In the illustrated example, the stopper blocks 740 are configured to engage the side panel 410, 610 of the sensor cartridge 400, 600 that is positioned adjacent to the right-side access point. The stopper blocks 760 are configured to engage the side panel 410, 610 of the sensor cartridge 400, 600 that is positioned adjacent to the left-side access point. In some examples, the stopper blocks 740, 750 are positioned in respective cutouts along the floor 710 to retain the stopper blocks 740, 750 in place when the sensor cartridge 400, 600 is in the cartridge chamber 700. Additionally or alternatively, the stopper blocks 740, 750 may be secured in place to the floor 710 via fasteners.

Turning to FIG. 22, an example of the ball-dispensing assembly 800 is depicted. The ball-dispensing assembly 800 includes a track 810 along which golf balls are configured to roll. In the illustrated example, the track 810 includes and is at least partially formed by two rails that extend parallel to each other. Further, the track includes a curved portion 870. The two rails are adjacent the inlet 805, and the curved portion 870 is adjacent to the outlet 875.

The track 810 extends between an inlet 805 and an outlet 875 of the ball-dispensing assembly 800. Returning briefly to FIG. 7, the inlet 805 is positioned downstream of the ball-return surface 150, the sensor assembly 300, and the putting surface 120. The outlet 875 is positioned to dispense golf balls onto the tee surface 110. In the illustrated example, the ball-dispensing assembly 800 includes the ramp 890 that extends from the outlet 875 and onto the tee surface 110 to deliver golf balls onto the tee surface 110 in a controlled manner.

Figure 23:
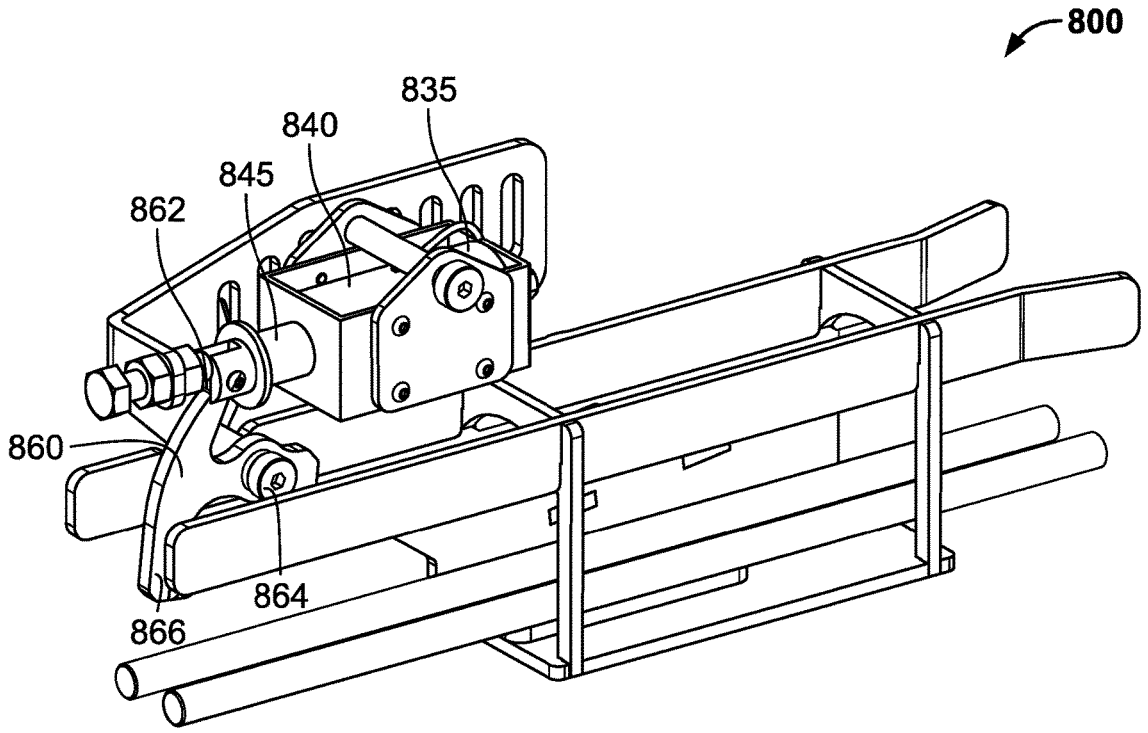
Figure 24:
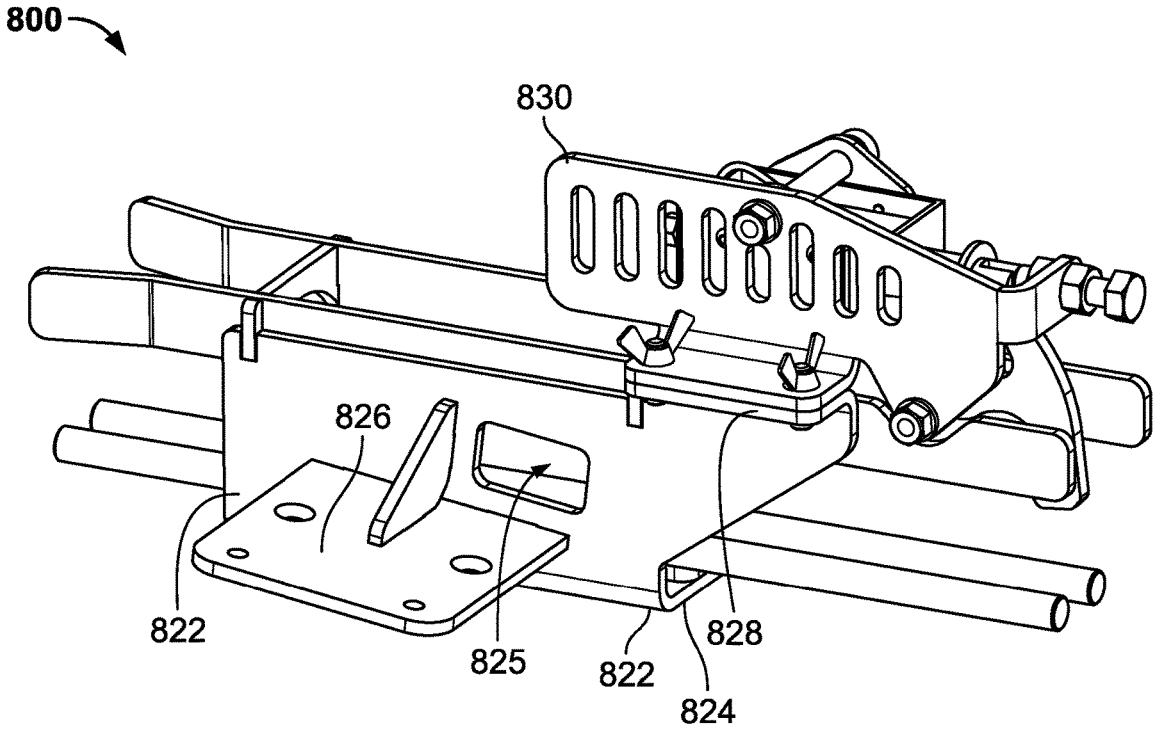

Returning to FIG. 22, the ball-dispensing assembly 800 includes a frame 820 that is adjacent to at least a portion of the track 810. The ball-dispensing assembly 800 also includes an actuator 835 and a pivot arm 860. FIGS. 23-24 further illustrate portions of the frame 820, the actuator 835, and the pivot arm 860. Other portions of the ball-dispensing assembly 800 are not shown in FIGS. 23-24 to more clearly depict features of the frame 820, the actuator 835, and the pivot arm 860.

As shown in FIG. 24, the frame 820 includes a side portion 822 and a lower portion 824 that extends transversely from the side portion 822 and below the rails of the track 810. The frame 820 also includes support flanges 826, 828. A sensor 880 (FIG. 22) is configured to mount to the support flange 826. The side portion 822 also defines an opening 825 that enable the sensor 880 to detect when the ball-dispensing assembly 800 has received one of the golf balls. A bracket 830 is configured to mount to the support flange 828. The actuator body 840 is coupled to the bracket 830 and the bracket 830 is coupled to the support flange 828 to mount the actuator 835 to the frame 820.

Turning to FIG. 23, the actuator 835 includes an actuator body 840 and an actuator arm 845 that extends from the actuator body 840. The actuator body 840 is mounted to the frame 820. The actuator arm 845 is configured to actuate between an extended position and a retracted position. In the illustrated example, the actuator 835 is a solenoid. In other examples, the actuator may be any other type of actuating device capable of controlling operation of the ball-dispensing assembly 800.

The pivot arm 860 is operatively connected to the actuator arm 845. The pivot arm 860 is configured to transition between a closed position and an open position. The pivot arm 860 is configured to be in its closed position when the actuator arm 845 is in its extended position, and the pivot arm 860 is configured to be in its open position when the actuator arm is in its retracted position. As disclosed below in greater detail with respect to FIGS. 25-28, the pivot arm 860 is configured to block golf balls from being dispensed by the ball-dispensing assembly 800 when the pivot arm 860 is in its closed position. The pivot arm 860 is configured to permit golf balls in dispensed by the ball-dispensing assembly 800 when the pivot arm 860 is in its open position.

The pivot arm 860 is pivotably mounted to the frame 820 to rotate between its open position and its closed position. In the illustrated example, the pivot arm 860 is pivotably mounted to the frame 820 via a pin 864 and the bracket 830. The pivot arm 860 also includes a proximal end 862 and a distal end 866. The proximal end 862 is hingedly coupled to the actuator arm 845 such that the pivot arm 860 is to pivot about the pin 864 as the actuator arm 845 transitions between its extended and retracted positions. The distal end 866 is configured to engage one of the golf balls when the pivot arm 860 is in its closed position and is configured to be disengaged from the golf balls when the pivot arm 860 is in its the open position.

Figure 26:
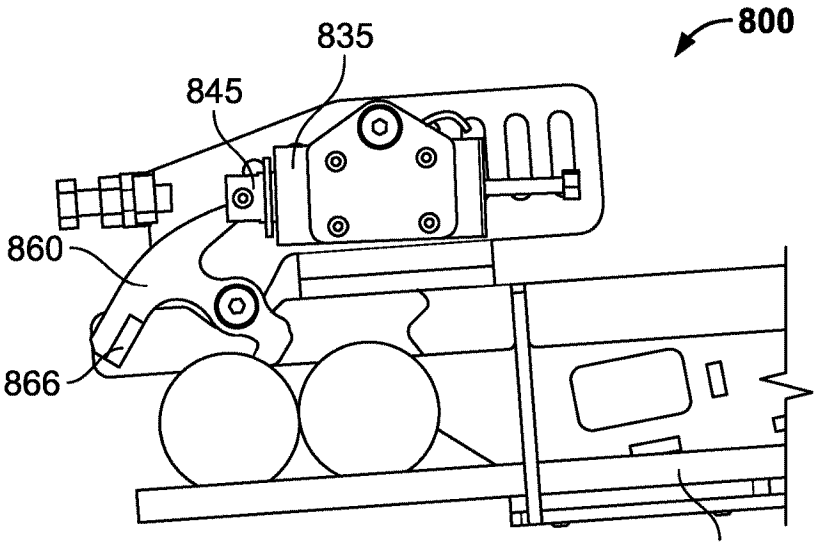
FIGS. 25-28 depict a sequence of the ball-dispensing assembly of FIGS. 22-24 dispensing a golf ball to a player of the standalone miniature-golf structure of FIG. 1.
Figure 25:
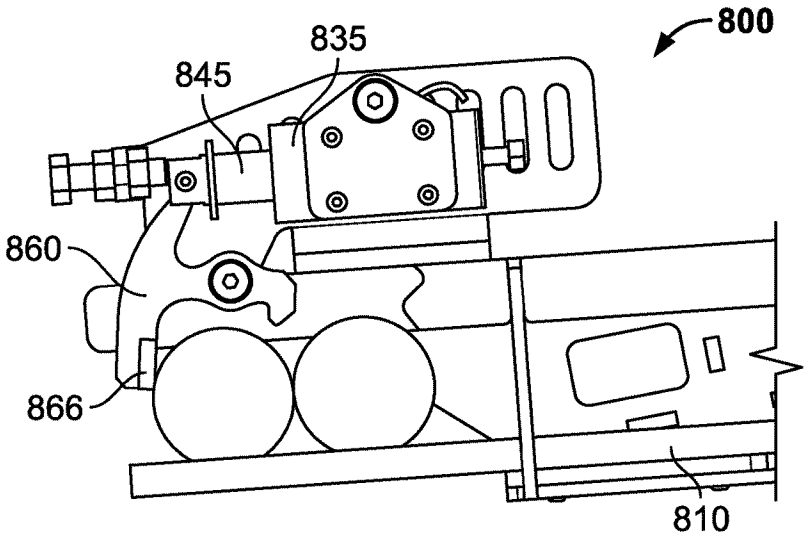
Figure 28:
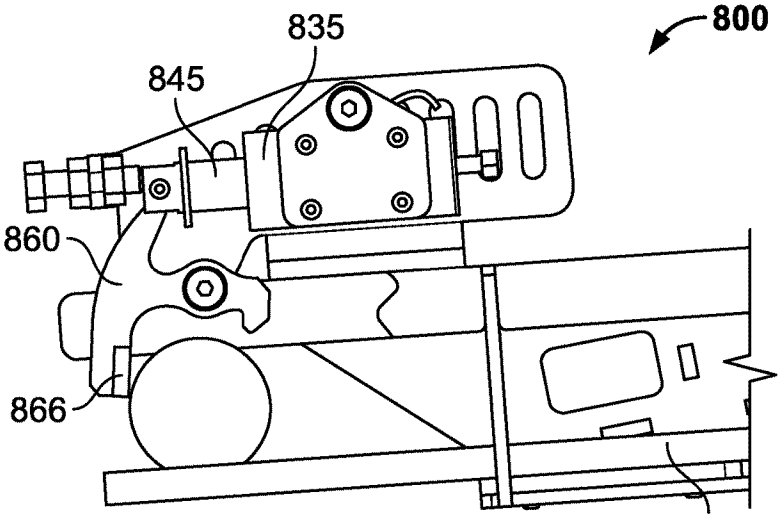
Figure 27:
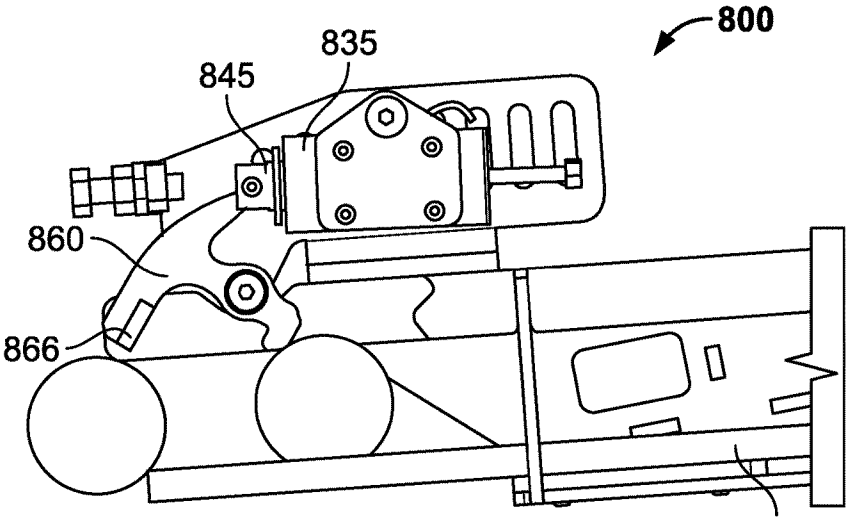

FIGS. 25-28 depict a sequence of the ball-dispensing assembly 800 dispensing a golf ball onto the tee surface 110 (FIGS. 1-3). Initially, as shown in FIG. 25, the actuator arm 845 of the actuator 835 is in its extended position to position the pivot arm 860 in its closed position. The distal end 866 of the pivot arm 860 engages a lead golf ball to retain two golf balls along the track 810. In FIG. 26, the actuator arm 845 has actuated to its retracted position to cause the pivot arm 860 to its open position. The distal end 866 of the pivot arm 860 is released from the lead golf ball to permit the golf ball to roll further down the track 810 toward the outlet 875. In FIG. 27, the actuator arm 845 remains in its retracted position to cause the pivot arm 860 to remain in its open position. The lead golf ball is permitted to roll down the track and 810 and subsequently be dispensed onto the tee surface 110. In FIG. 28, the actuator arm 845 has actuated back to its extended position to return the pivot arm 860 to its closed position. The distal end 866 of the pivot arm 860 engages the remaining golf ball to temporarily prevent it from being dispensed onto the tee surface 110.

Returning briefly to FIG. 22, the ball-dispensing one or more sensors 880, 885. The sensor 880 (also referred to as a "first sensor" and a "ball-receiving sensor") is positioned toward the inlet 805 and is configured to detect when the ball-dispensing assembly 800 has received a golf ball from the ball-return surface 150. The sensor 885 (also referred to as a "second sensor" and a "ball-release sensor") is positioned toward the outlet 875 and is configured to detect when the ball-dispensing assembly 800 has dispensed a golf ball onto the tee surface 110. In the illustrated example, each of the sensors 880, 885 is a fork sensor. In other examples, the sensor 880 and/or the sensor 885 may be any other sensor that is capable of detecting the respective receipt and dispensing of a golf ball.

Figure 29:
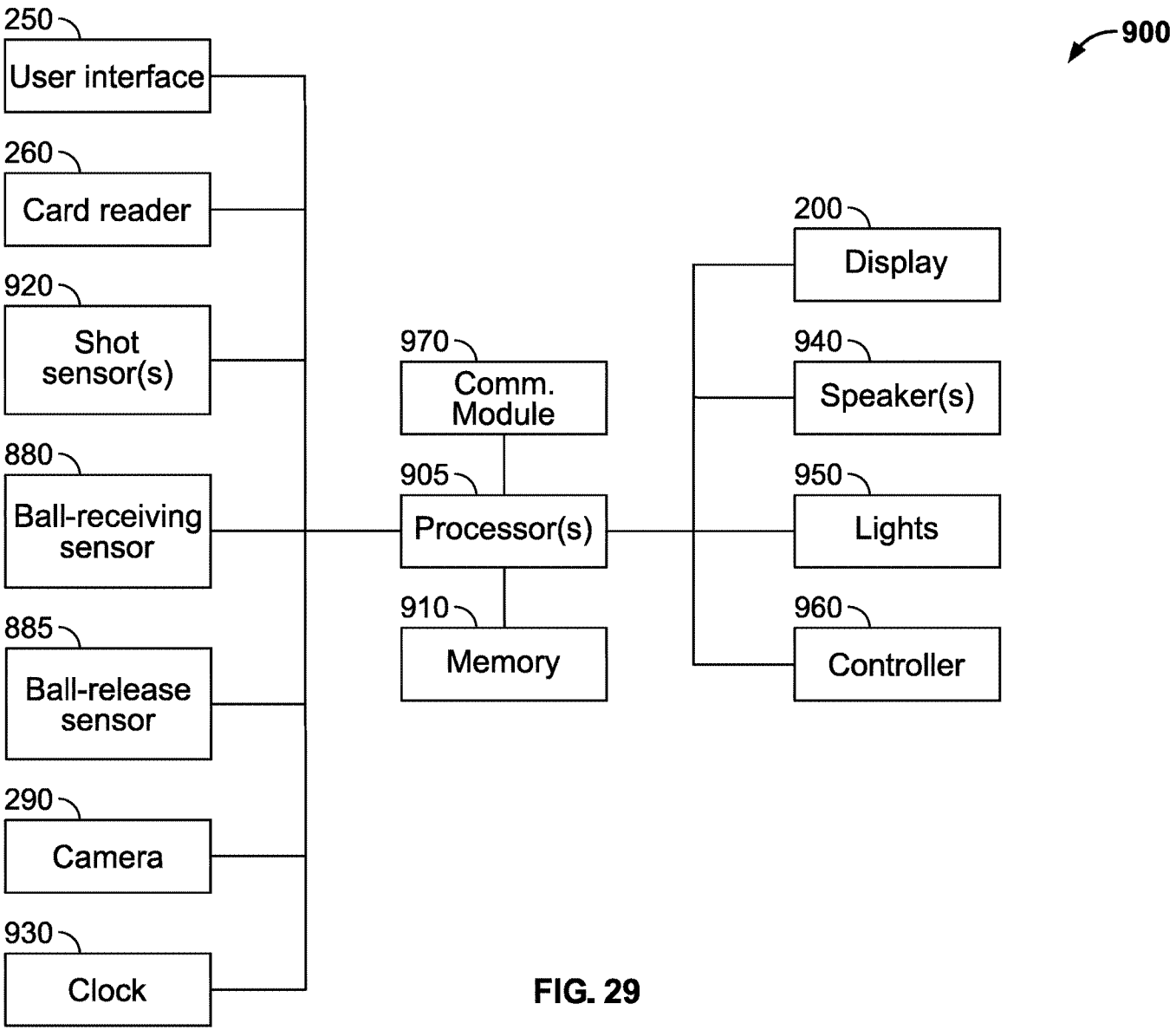
FIG. 29 is a block diagram of example electronic components of the standalone miniature-golf structure of FIG. 1.

Turning to FIG. 29, a block diagram of electronic components 900 of the standalone miniature golf structure 10 is depicted. In the illustrated example, the electronic components 900 include one or more processors 905, memory 910, input devices, output devices, and a communication module 970.

The processor(s) 905 may be any suitable processing device or set of processing devices such as, but not limited to, a microprocessor, a microcontroller-based platform, an integrated circuit, etc. The memory 910 may include one or more of volatile memory, non-volatile memory, read-only memory, etc. In some examples, the memory 910 may include a combination of multiple kinds of memory, such as volatile memory and non-volatile memory. The memory 910 is computer readable media on which one or more sets of instructions, such as the software for operating the methods of the instant disclosure, can be embedded. The instructions may embody one or more of the methods or logic as described herein. For example, the instructions reside completely, or at least partially, within any one or more of the memory 910, the computer readable medium, and/or within the processor(s) 905 during execution of the instructions.

The terms "non-transitory computer-readable medium" and "computer-readable medium" include a single medium or multiple media, such as a centralized or distributed database, and/or associated caches and servers that store one or more sets of instructions. Further, the terms "non-transitory computer-readable medium" and "computer-readable medium" include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The communication module 970 is configured to enable wired or wireless communication with other electronic devices. As used herein, the term "module" refers to hardware with circuitry configured to perform one or more functions. A "module" may also include firmware that executes on the circuitry to enable the one or more functions to be performed.

The communication module 970 includes wired or wireless network interfaces to enable communication with the network(s) and/or computing device(s). The communication module 970 also includes hardware (e.g., processors, memory, storage, antenna, etc.) and software to control the wired or wireless network interfaces. For example, the communication module 970 includes hardware, software, and network interfaces for communication via a wireless personal area network (WPANs), such as Bluetooth®; etc. In such examples, the communication module 970 is capable of pairing with another nearby computing device. Additionally or alternatively, the communication module 970 includes hardware, software, and network interfaces to wirelessly communicate via cellular network(s), such as Long-Term Evolution (LTE); wireless local area networks (WLANs), such as Wi-Fi®; etc.

For example, the communication module 970 may be configured to communicate with a mobile device (e.g., a smartphone, a smartwatch, a tablet, etc.) of a player, via a WPAN or a WLAN, to receive user selections from the player. The communication module 970 may be configured to communicate with a mobile device an operator and/or a remote server to receive updates for one or more games.

The input devices of the standalone miniature golf structure 10 include the user interface 250 and the card reader 260 of the check-in station 70. In some examples, the user interface 250 of the check-in station 70 is a touchscreen and/or other device that operates both as an input device and an output device. Additionally or alternatively, other input device(s) of the electronic components 900 may also operate output device(s).

The input devices of the electronic components 900 also include one or more shot sensors 920. The shot sensors 920 are configured to detect a lateral position at which a golf ball has been putt by a player. Example shot sensors 920 include the sensors 470 of the sensor cartridge 400 and the sensor 680 of the sensor cartridge 600. The shot sensors 920 may also include sensors, such as the sensors 480, that are configured to detect when a golf ball has rolled off the sensor cartridge 400, 600.

Other example input devices of the electronic components 900 include the sensor 880 configured to detect when the ball-dispensing assembly 800 has received a golf ball, the sensor 885 configured to detect when the ball-dispensing assembly 800 has release a golf ball for dispensing, the camera 290 mounted to the rear portion of the body 15, and/or a clock 930. The clock 930 may be used to monitor how long a party has been occupying the standalone miniature golf structure 10. Additionally or alternatively, the clock 930 may be used to time when to release a golf ball from the ball-dispensing assembly 800 after the golf ball has rolled off the sensor cartridge 400, 600.

The electronic components 900 of the standalone miniature golf structure 10 also includes a plurality of output devices. The output devices include the digital display screen 200 that is configured to present a plurality of interfaces for the available games of the standalone miniature golf structure 10. As discussed below in further detail, the digital display screen 200 is configured to present game interfaces that include targets, hazards, digital lanes (e.g., digital lanes 2010 of FIGS. 30-31) that align with the ball-detection, a status bar (e.g., a status bar 2050 of FIGS. 30 and 32), animations, and/or other information associated with the game being played.

In the illustrated example, the output devices also include one or more speakers 940 configured to provide audible signals to the player(s), lights 950, and a controller 960. The lights 950 includes the lighting mounted to the rear portion of the body 15, the lights 575 of the sensor assembly 300, and/or other light sources. The controller 960 is configured to control actuation of the actuator arm 245 of the actuator 235. The controller 960 may include a processor and/or memory and be configured to control actuation of the actuator arm 245 based on control signal(s) received by the processor(s) 905.

The processor(s) 905 are configured to control operation of the standalone miniature golf structure 10, for example, based on instructions stored in the memory 910. For example, the memory 910 is configured to store instructions for each of the games that are playable on the standalone miniature golf structure 10. In some examples, the instructions stored in the memory 910 enable one or more of the games to be played by a range of a number of players and/or a plurality of different gameplays. For example, the instructions enable a game, based on a user selection, to be played by between 2 and 6 players. The instructions enable a game, based on a user selection, to be played in an individual gameplay or a team gameplay. For the individual gameplay each player is competing against the other player(s) in the party. In a team gameplay, two or more players are grouped together in teams to compete against other team(s) in the party.

The processor(s) 905, based on instructions stored in the memory 910, are configured to send command signals to the digital display screen 200 to display interfaces of a game. For example, the digital display screen 200 is configured to present one or more putting targets and/or one or more hazards based on instructions sent by the processor(s) 905. The processor(s) 905, based on instructions stored in the memory 910, are configured to select a lateral position, a width, and a point value for each of the putting target(s) and/or hazard(s) presented by the digital display screen 200. In some examples, the processor(s) 905 are configured to randomly select the lateral position, the width, and the point value for each putting target and/or hazard. As disclosed below in greater detail, the processor(s) 905 may be configured to change the putting target(s) and/or hazard(s) presented by the digital display screen 200 for each shot in a game, for example, to keep repeat players entertained overtime.

Figure 30:
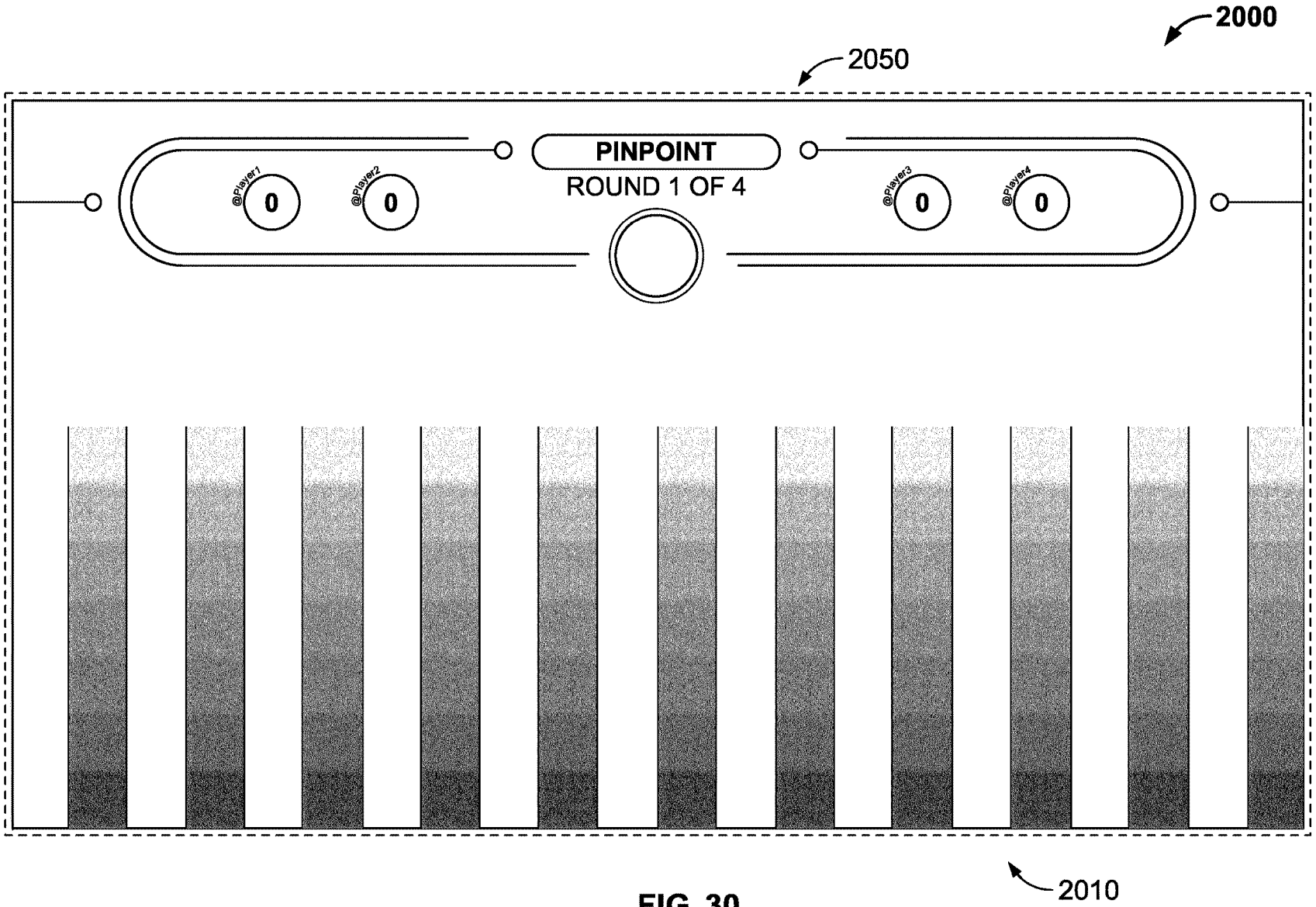
FIG. 30 depicts an example background and an example status bar of interfaces presented via a display for games of the standalone miniature-golf structure of FIG. 1.
Figure 31:
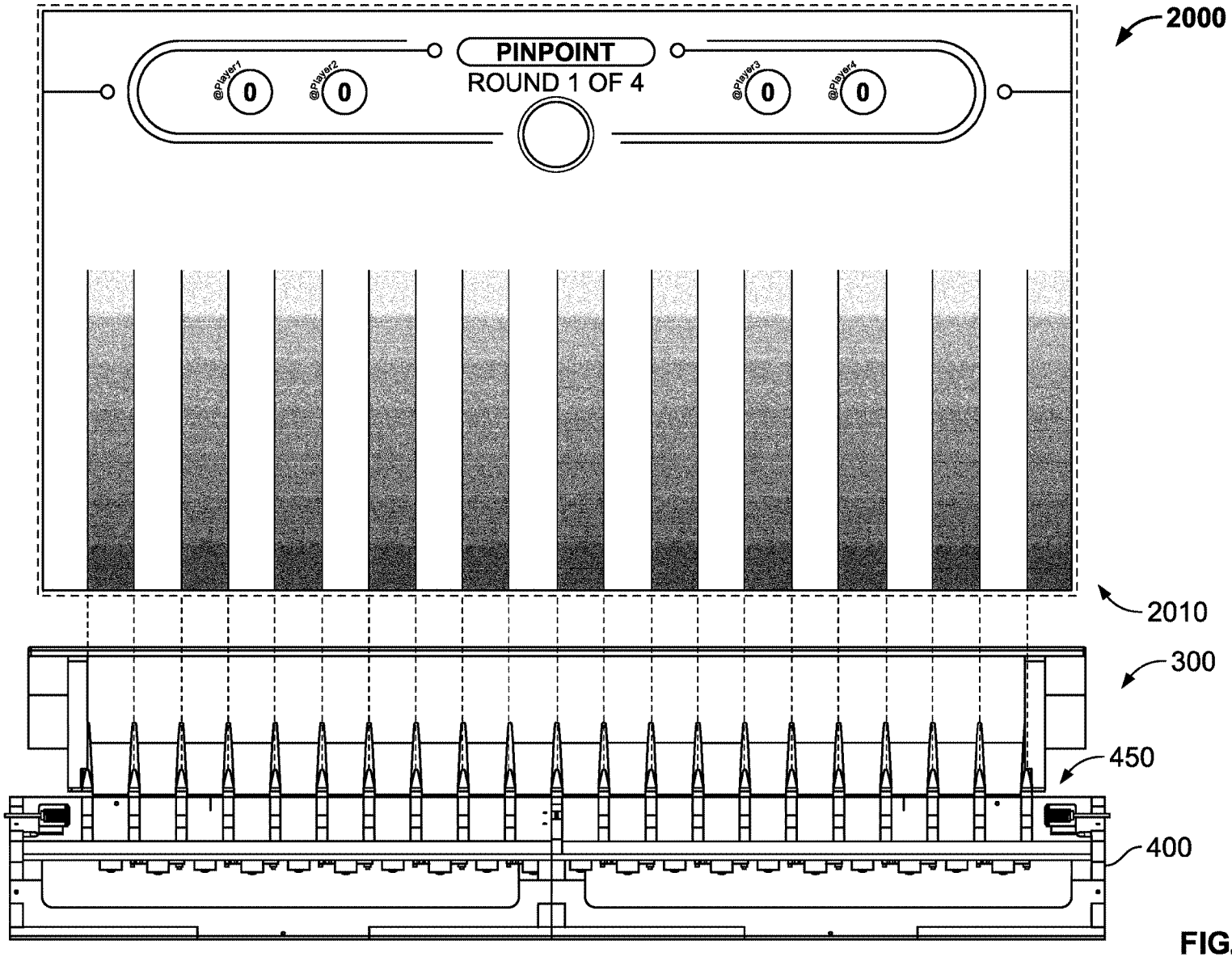
FIG. 31 depicts vertical alignment between digital lanes of the background of FIG. 30 and ball-detection lanes of the sensor assembly of FIG. 5.

In some examples, the digital display screen 200 is configured to present, based on instructions received by the processor(s) 905, digital lanes in the background of each interface for a game. FIG. 30 depicts an example interface 2000 with such a background. In FIG. 30, the background includes a plurality of digital lanes 2010 that align vertically with predefined lateral positions along the rear end 125 of the putting surface 120. The digital lanes 2010 are configured to facilitate a player in putting a golf ball in a direction toward a putting target presented over a portion of one or more of the digital lanes 2010 of the background. In some examples, as shown in FIG. 31, the each of the digital lanes 2010 aligns vertically with a respective ball-detection lane 450 of the sensor cartridge 400 of the sensor assembly 300 to further facilitate a player in putting a golf ball in a direction toward a putting target. For example, if a putting target is positioned laterally in the third digital lane 2010 from the left edge, the player will be able to easily identify that they should putt the golf ball in the third ball-detection lane 450 from the left.

Figure 32:
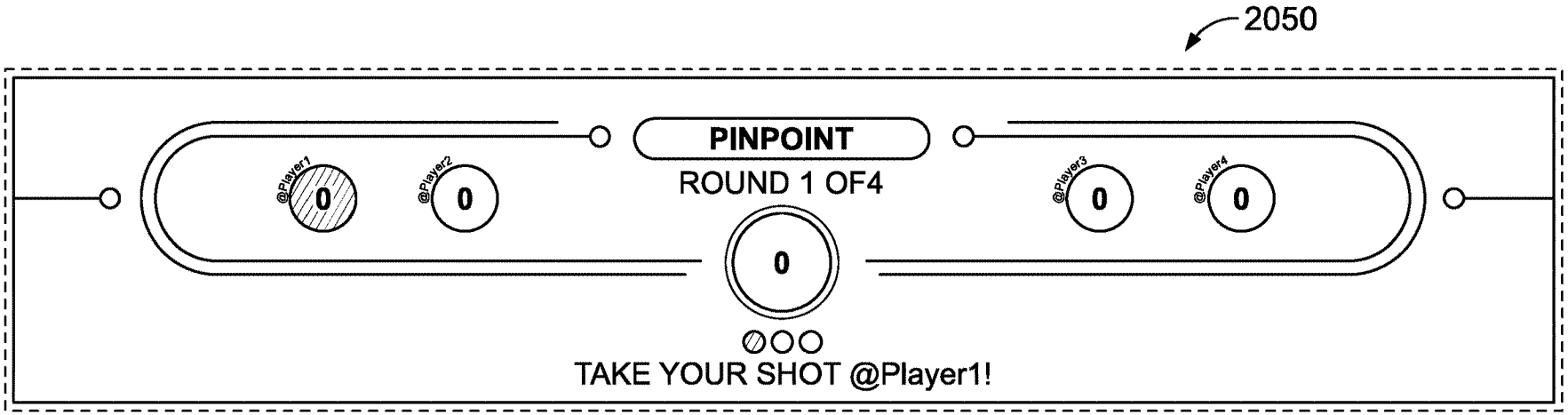
FIG. 32 further depicts the status bar of FIG. 30.

Returning briefly to FIG. 30, the digital display screen 200 is configured to present, based on instructions received by the processor(s) 905, a status bar toward the top of each interface for a game. As shown in FIG. 32, the status bar 2050 is configured to identify the name of the game being player, the current round of the game being played, the current shot within the current round, the number of players, the names of each player, the current score of each player, which player is currently putting, and the gameplay of the game (e.g., individual mode or team mode). The processor(s) 905 are configured to send instructions that cause the digital display screen 200 to updated the status bar 2050 in real-time as the game is being played.

Additionally, the processor(s) 905 are configured to detect when a player has completed a putt based on data collected by one or more of the sensors 470, 480, 680 of the sensor assembly 300. For each putt, the processor(s) 905 are configured to detect, via the sensors 470, 680, a lateral position at which the golf ball crosses the rear end 125 of the putting surface 120. For example, the processor(s) 905 are configured to identify, via the sensors 470, into which of the ball-detection lanes 450 the golf ball has been shot.

The processor(s) 905 are then configured to determine whether the lateral position of the putt of the golf ball aligns vertically with any of the putting target(s) and/or hazard(s) that was presented to the player via the digital display screen 200. The processor(s) 905 are configured to generate a score for the shot based on the lateral position of the putt relative to the lateral position(s) of each of the putting target(s) and/or hazard(s). For example, if the lateral position of the putt aligns with the lateral position(s) of a putting target, the processor(s) 905 assign a predefined point value to the corresponding player. If the lateral position of the putt aligns with the lateral position(s) of a hazard, the processor(s) 905 deduct a predefined point value from the corresponding player.

After a shot has been detected, the processor(s) 905 are configured to control operation of the ball-dispensing assembly 800. For example, the processor(s) 905 are configured to instruct the ball-dispensing assembly 800 to release another golf ball onto the tee surface 110 at a predetermined time after a sensor 480, 680 has detected that the putted golf ball has crossed the front edge 436, 636 of the sensor cartridge 400, 600 and rolled onto the ball-return surface 150. The memory 910 is configured to store a respective predetermined time for each game playable on the standalone miniature golf structure 10. In some examples, the predetermined time is relatively short for games that are intended to be quickly. In other examples, the predetermined time is relatively long for games that can be played at a slower pace.

Figure 33:
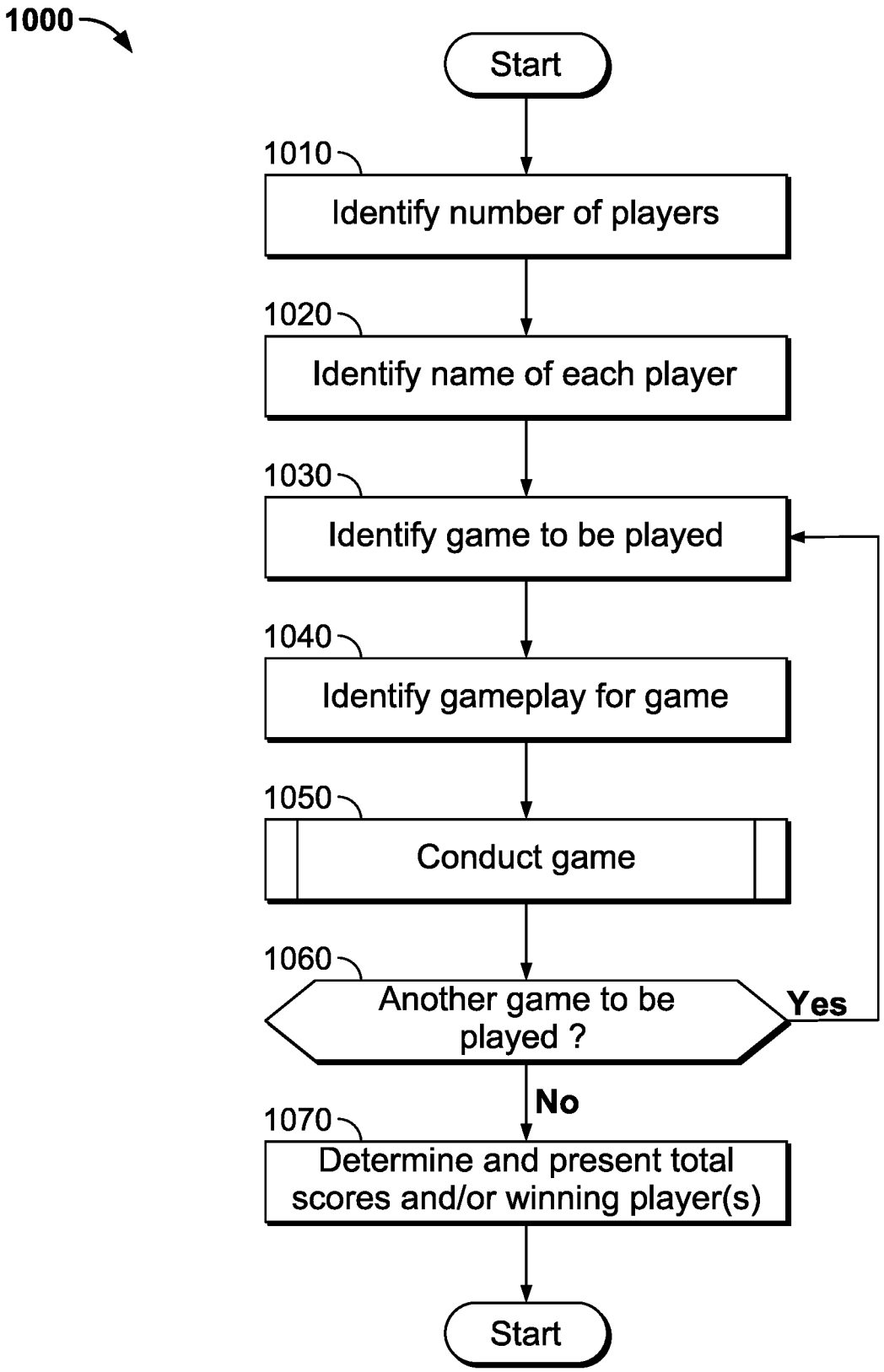
FIG. 33 is a flowchart of an example method of operation of the standalone miniature-golf structure of FIG. 1 in accordance with the teachings herein.

FIG. 33 is a flowchart of an example method 1000 for the standalone miniature golf structure 10 to conduct a session for a party of players. The flowchart of FIG. 33 is representative of machine readable instructions that are stored in memory (such as the memory 910 of FIG. 29) and include one or more programs which, when executed by one or more processors (such as the processor(s) 905 of FIG. 29), cause the standalone miniature golf structure 10 to conduct one or more games for a group of players. While the example program is described with reference to the flowchart illustrated in FIG. 33, many other methods may alternatively be used. For example, the order of execution of the blocks may be rearranged, changed, eliminated, and/or combined to perform the method 1000. Further, because the method 1000 is disclosed in connection with the components of FIGS. 1-32, some functions of those components will not be described in detail below.

Initially, at block 1010, the processor(s) 905 identify the number of players in a party. For example, the user interface 250 of the check-in station 70 receives a user selection of the number of players from one of the players, and the processor(s) 905 collect the user-selected number of players from the user interface 250. At block 1020, the processor(s) 905 identify the name of each party. For example, the user interface 250 receives user selections of the names of the players, and the processor(s) 905 collect the user-selected names from the user interface 250. Additionally, or alternatively, the processor(s) 905 identify, via a user selection collected by the user interface 250, whether any of the players have health conditions or impairments to enter another mode of game play (e.g., an "ADA mode") in which the sequence that one or more games may be played is altered to facilitate participation by those players.

At block 1030, the processor(s) 905 identify a game to be played by the players of the party. In some examples, the processor(s) 905 randomly select the game to be played from a plurality of games that are uploaded onto the standalone miniature golf structure 10 (e.g., with executing instructions stored in the memory 910). In other examples, the user interface 250 receives a user selection of the game from one of the players, and the processor(s) 905 collect the user-selected game from the user interface 250. At block 1040, the processor(s) 905 identify a gameplay for the selected game. For example, the selected game may be played in an individual mode or a team mode. In some examples, the processor(s) 905 automatically select the gameplay for the selected game based on the user-selected number of players. For example, if the there are two players in the party, the processor(s) 905 automatically select the individual mode for the selected game. In other examples, the gameplay is user-selected. For example, the user interface 250 receives the user selection from one of the players, and the processor(s) 905 collect the user selection from the user interface 250.

Figure 35:
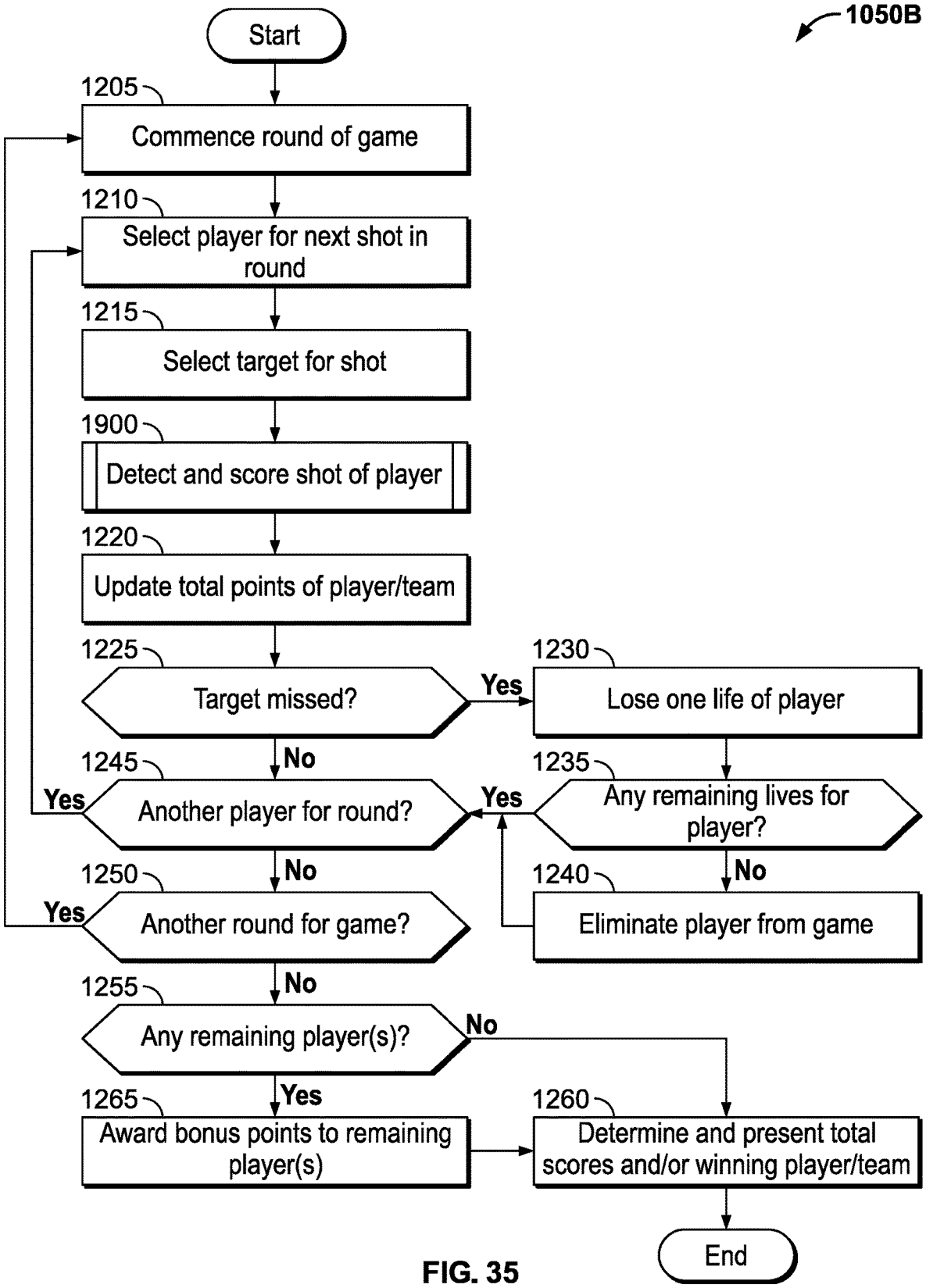
FIG. 35 is a flowchart of an example method of the standalone miniature-golf structure of FIG. 1 executing a second game.
Figure 36:
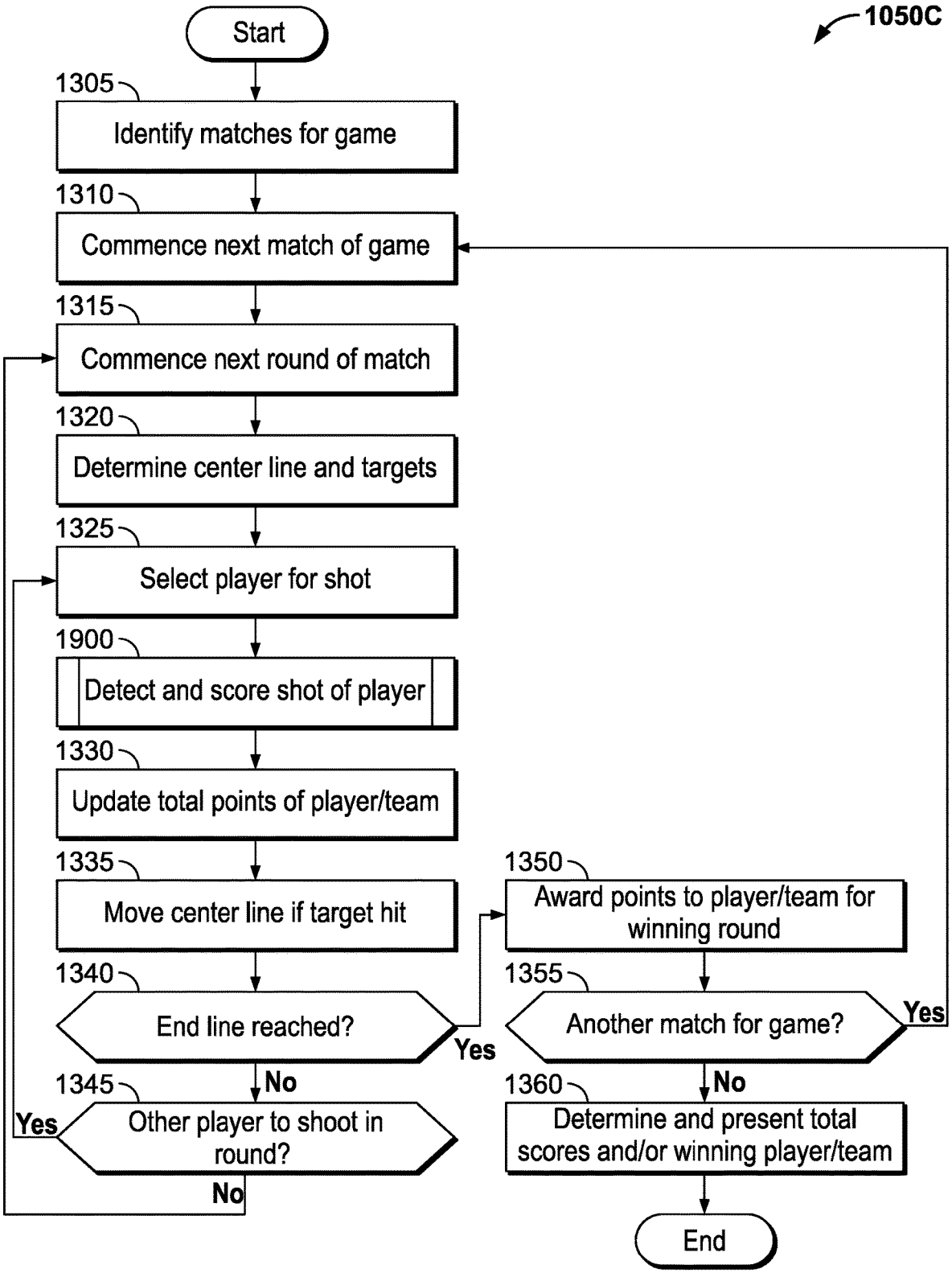
FIG. 36 is a flowchart of an example method of the standalone miniature-golf structure of FIG. 1 executing a third game.
Figure 37A:
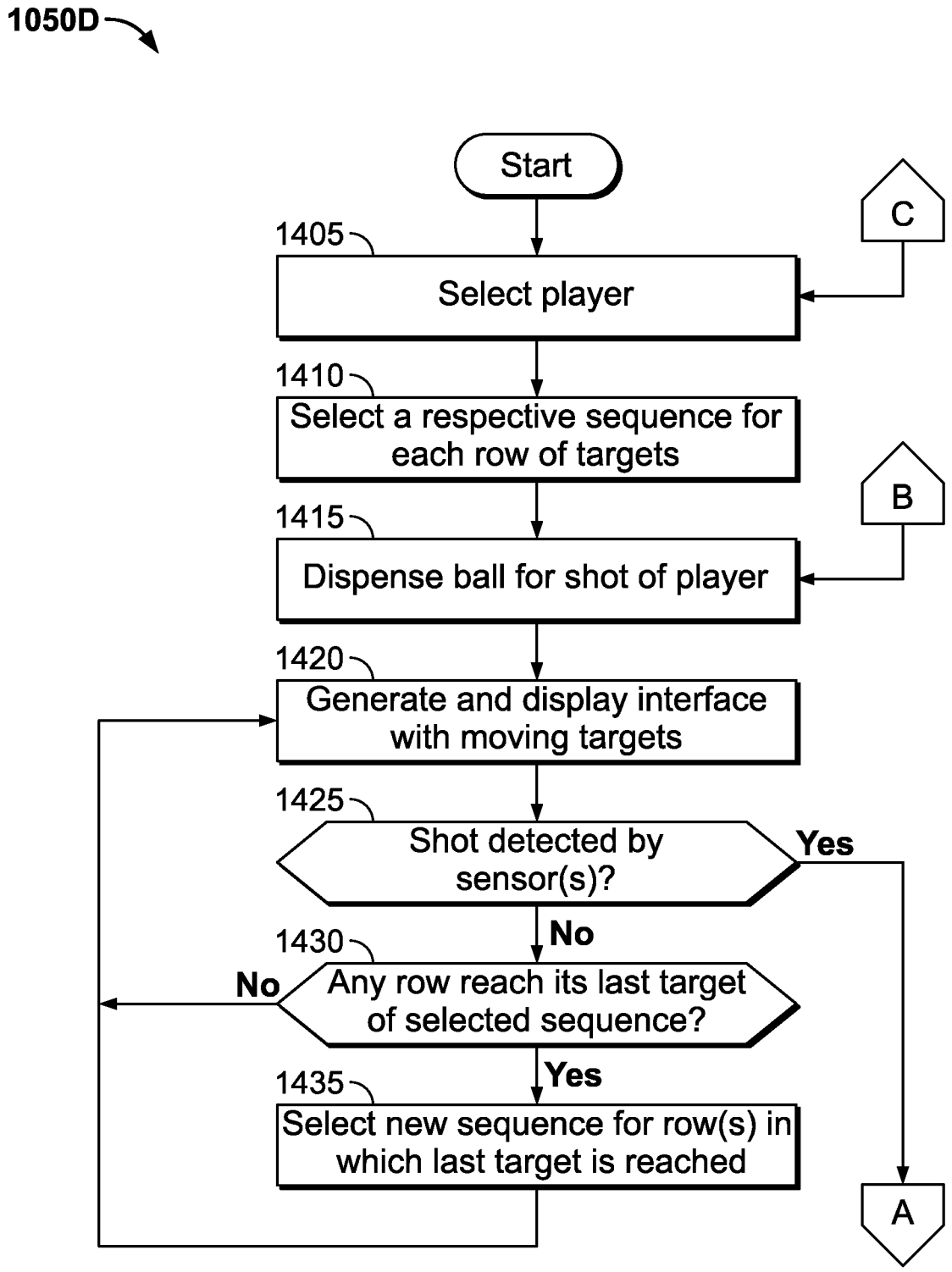
FIGS. 37A-37B is a flowchart of an example method of the standalone miniature-golf structure of FIG. 1 executing a fourth game.
Figure 37B:
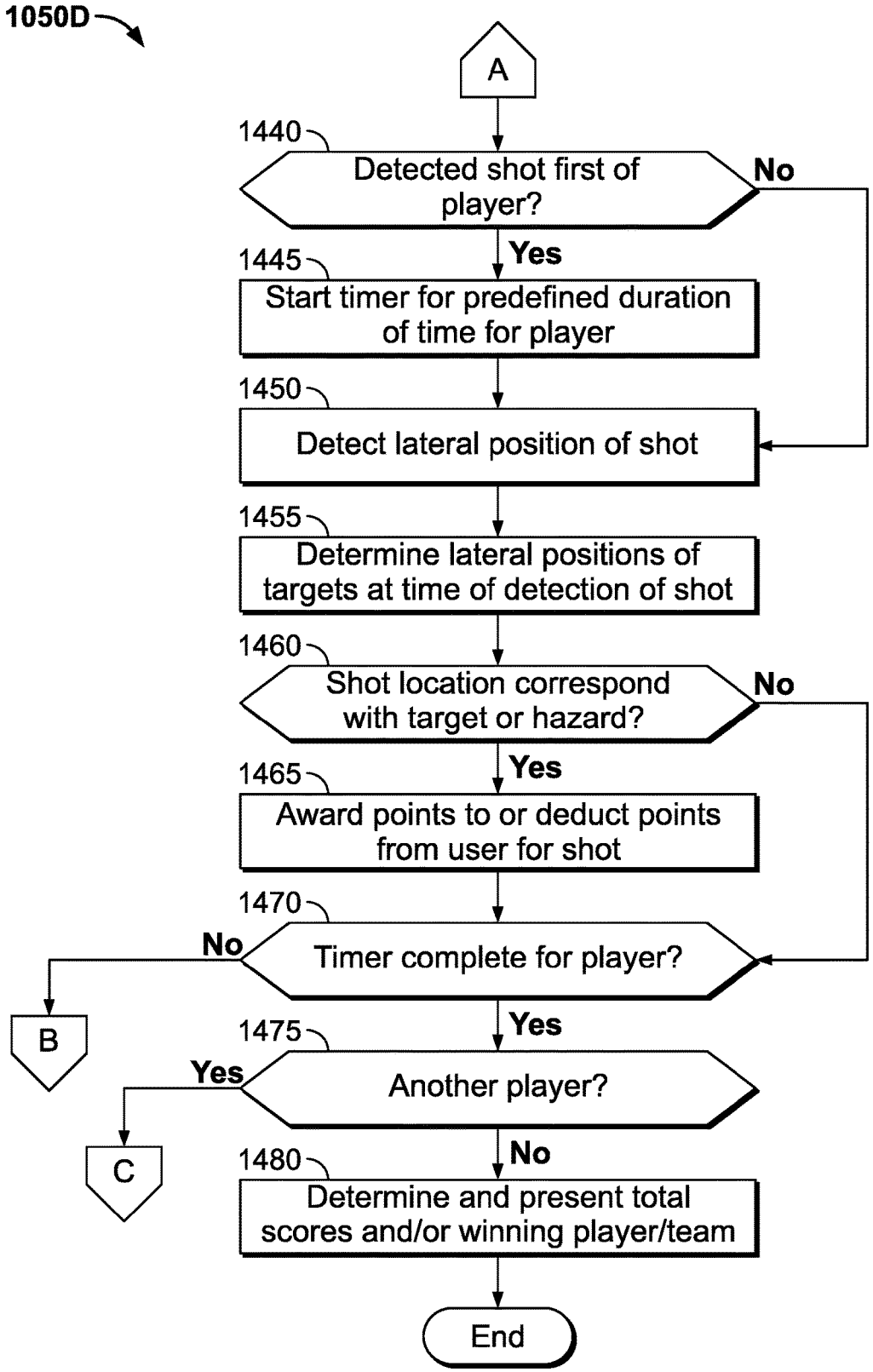
Figure 38:
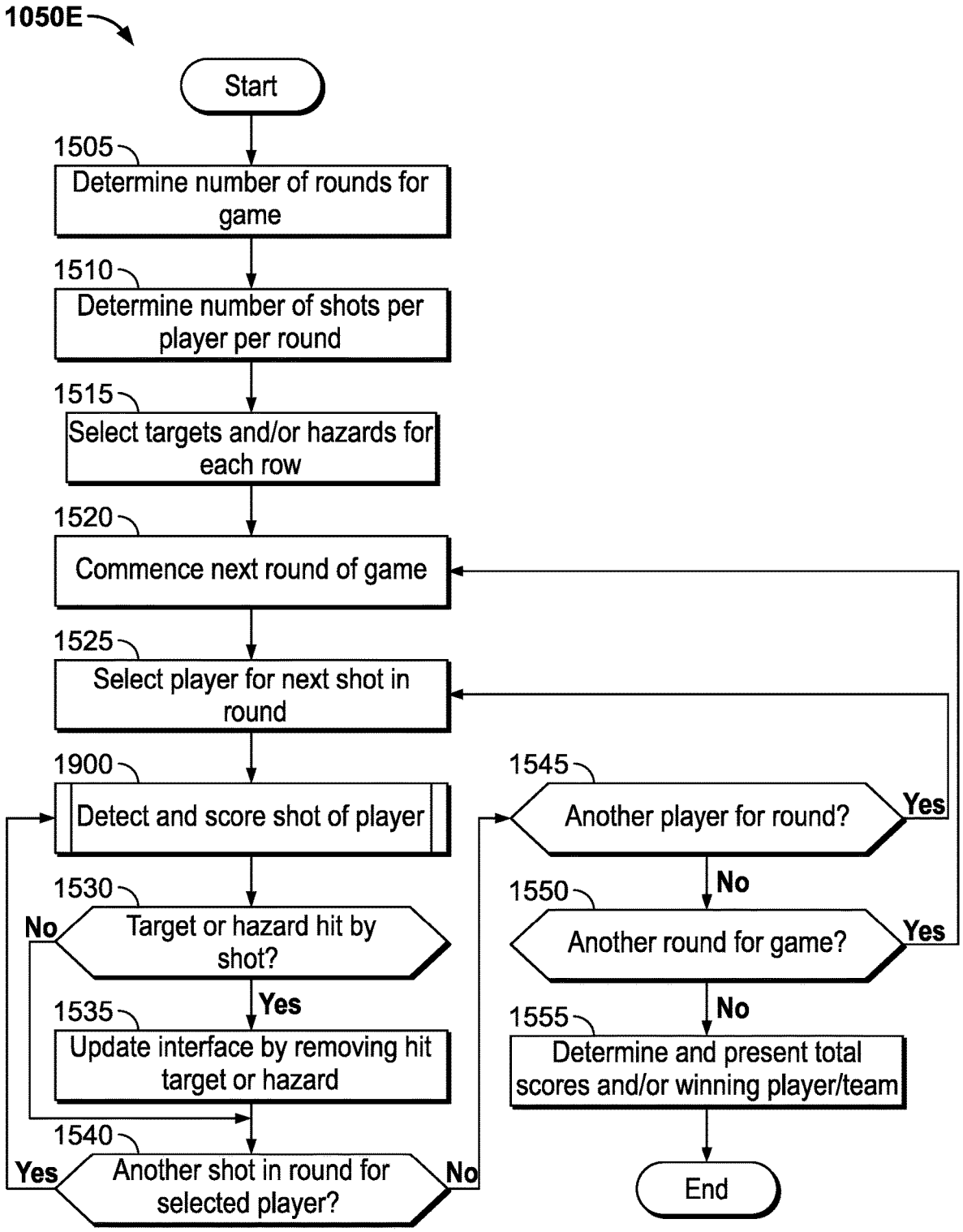
FIG. 38 is a flowchart of an example method of the standalone miniature-golf structure of FIG. 1 executing a fifth game.
Figure 39:
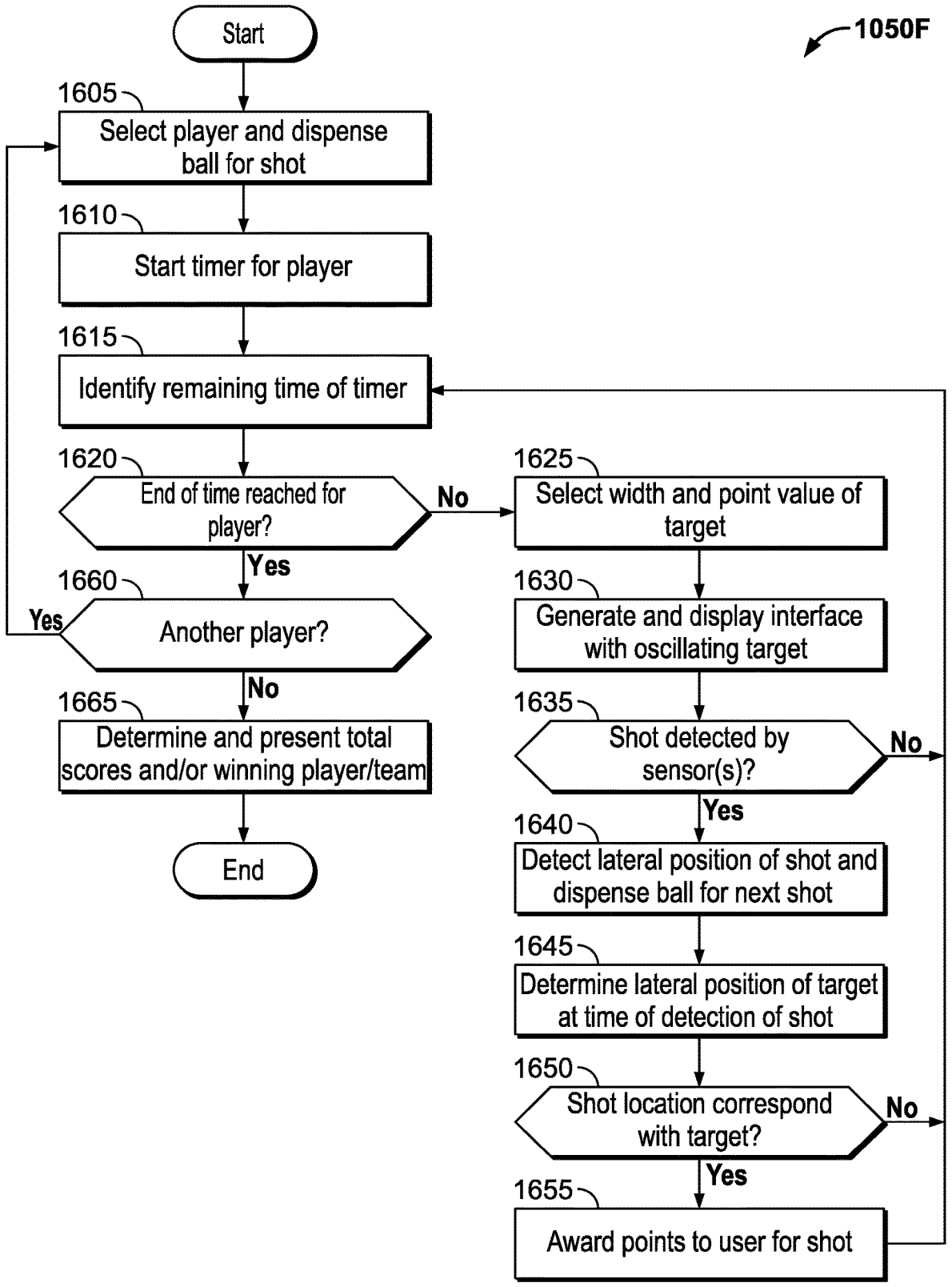
FIG. 39 is a flowchart of an example method of the standalone miniature-golf structure of FIG. 1 executing a sixth game.

At block 1050, the processor(s) 905 conduct the selected game based on instructions stored in the memory 910. Methods to conduct example games are disclosed below in greater detail. For example, FIG. 34 depicts an example method 1050A to conduct a first game, FIG. 35 depicts an example method 1050B to conduct a second game, FIG. 36 depicts an example method 1050C to conduct a third game, FIGS. 37A-37B depicts an example method 1050D to conduct a fourth game, FIG. 38 depicts an example method 1050E to conduct a fifth game, and FIG. 39 depicts an example method 1050F to conduct a sixth game.

At block 1060, the processor(s) 905 determine whether another game in the session is to be played by the party. In some examples, the session is time-based such that the processor(s) 905 determine to conduct another game if there is at least a predefine amount of time remaining for the session. In some examples, the processor(s) 905 determine whether another game is to be played based on a user selection received by the user interface 250. In response to the processor(s) 905 determining that another game is to be played, the method 1000 returns to block 1030 to conduct the game. Otherwise, in response to the processor(s) 905 determining that another game is not to be played, the method 1000 proceeds to block 1060.

At block 1070, the processor(s) 905 determine a total score for each player and/or team in the party. A display, such as the digital display screen 200, presents the total scores to the party. Additionally or alternatively, the processor(s) determine and the display presents a winning player and/or team for the session.

Figure 34:
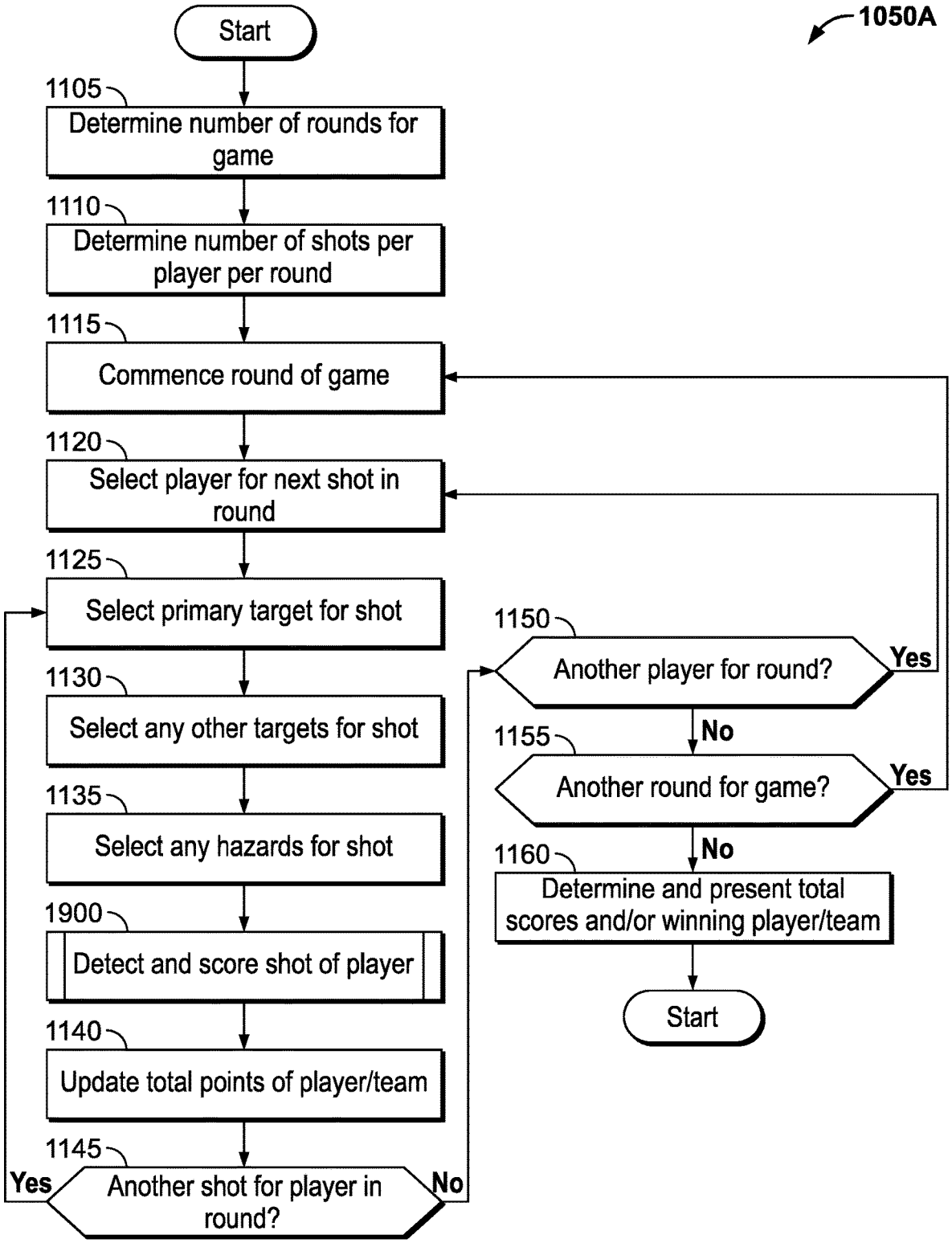
FIG. 34 is a flowchart of an example method of the standalone miniature-golf structure of FIG. 1 executing a first game.

FIG. 34 is a flowchart of an example method 1050A for conducting a first game (also referred to as "Pinpoint" and the "Pinpoint game") to perform block 1050 of FIG. 33. The flowchart of FIG. 34 is representative of machine readable instructions that are stored in memory (such as the memory 910 of FIG. 29) and include one or more programs which, when executed by one or more processors (such as the processor(s) 905 of FIG. 29), cause the standalone miniature golf structure 10 to conduct the first game for a group of players. While the example program is described with reference to the flowchart illustrated in FIG. 34, many other methods may alternatively be used. For example, the order of execution of the blocks may be rearranged, changed, eliminated, and/or combined to perform the method 1050A. Further, because the method 1050A is disclosed in connection with the components of FIGS. 1-32, some functions of those components will not be described in detail below.

For the first game, the goal is to score as many points as possible by hitting putting targets and avoiding hazards. The game is divided into a number of rounds (e.g., 3 rounds, 4 rounds, etc.). Within each round players in the party take turns taking a predetermined number of shots (e.g., 3 shots). In some examples, when a party has identified that it includes a player with health condition(s) or impairment(s), each player will putt their shots sequentially (e.g., in an "ADA mode") to reduce the number of times each player is required to enter and exit from the tee surface 110.

For each shot, different target(s) and/or hazard(s) are presented via the digital display screen 200. For example, the processor(s) 905 may generate an interface for the game to include a primary target, secondary targets, tertiary targets, hazards, etc. If the lateral position at which the golf is putted aligns vertically with a primary putting target, a first point value associated with the primary putting target is awarded to the player. Similarly, if the lateral position at which the golf is putted aligns vertically with a secondary putting target or tertiary putting target, a second point value associated with the secondary putting target or a third point value associated with the tertiary putting target, respectively, is awarded to the player. In contrast, if the lateral position at which the golf is putted aligns vertically with a hazard, a hazard point value associated with the hazard is deducted from the total point value of the player.

The location, width, and/or point value of the target(s) and/or hazard(s) may change for each shot. For example, the processor(s) 905, based on instructions stored in the memory 910, change the location, width, and/or point value of the target(s) and/or hazard(s). In some examples, the location, width, and/or point value for each target and/or hazard is selected randomly. In some examples, each shot for a player becomes progressively more difficult, for example, by introducing hazard(s), decreasing the width of target(s), and/or increasing the width of hazard(s). In some examples, no lateral position may be repeatedly selected as the center point of a primary putting target for each player. Additionally or alternatively, the center point for one shot may be no closer than a predetermined distance away (e.g., two ball-detection lanes 450) from the preceding shot.

Figure 41:
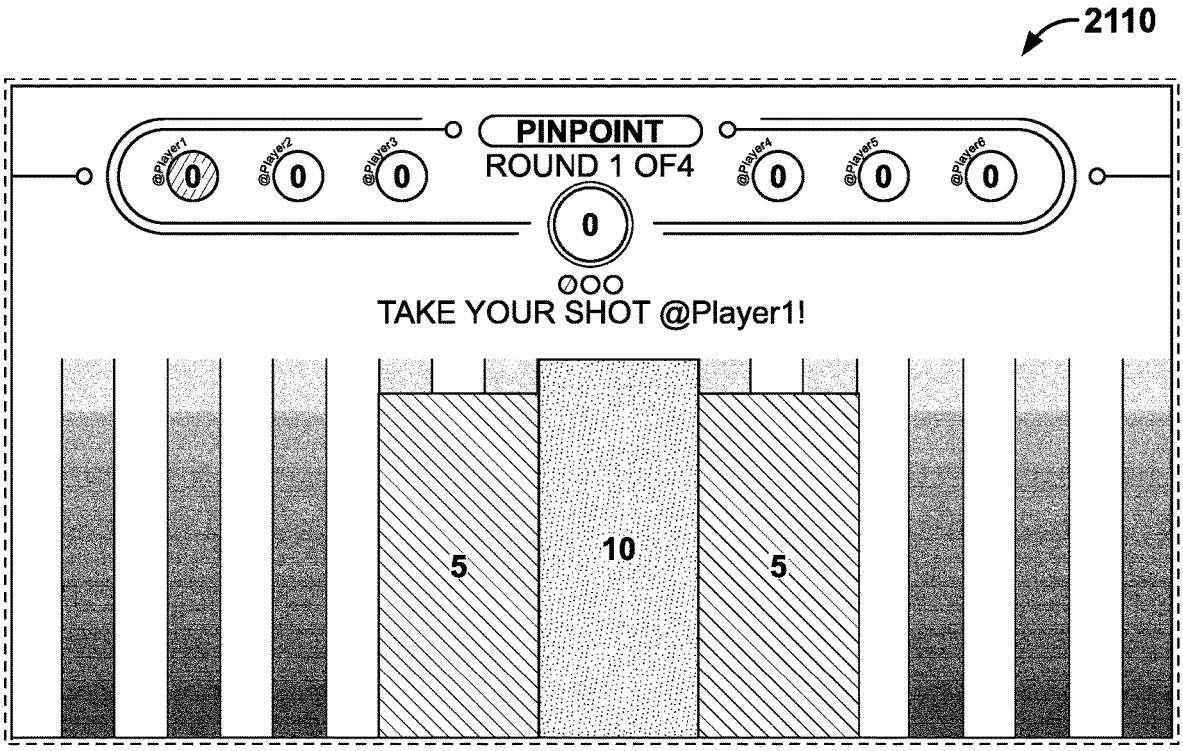
FIG. 41 depicts an example first interface presented via a display of the standalone miniature-golf structure of FIG. 1 for the first game of FIG. 34.
Figure 42:
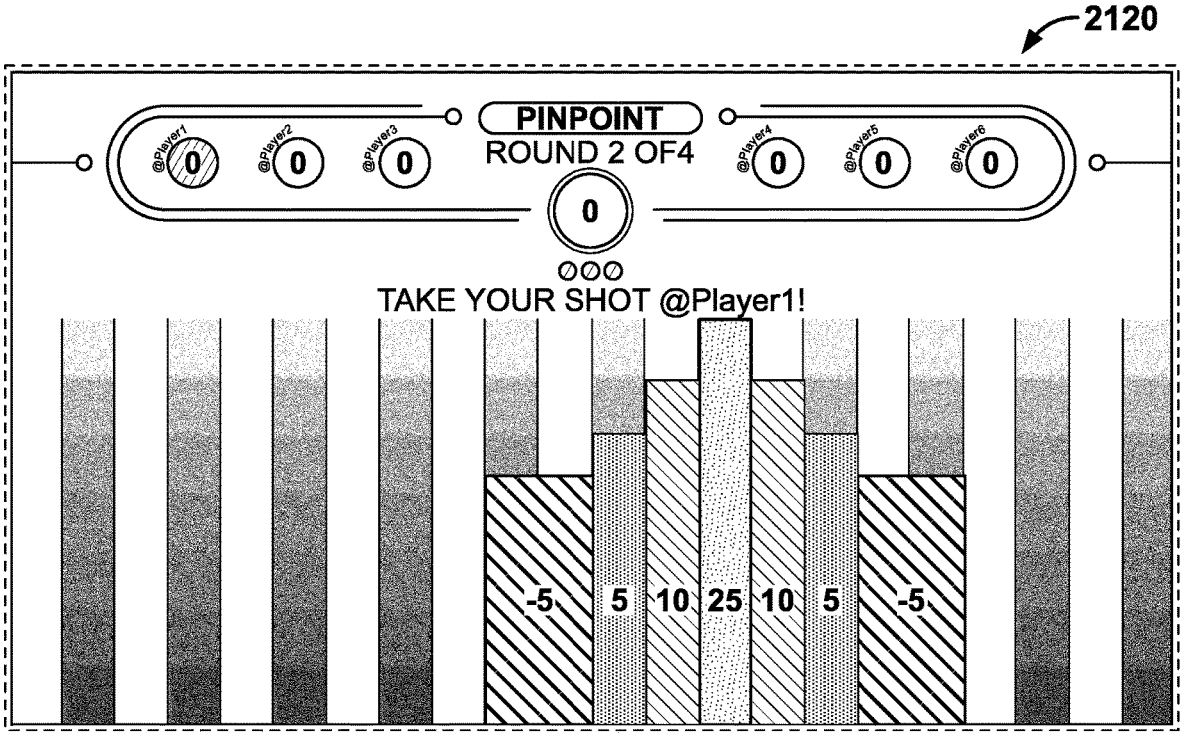
FIG. 42 depicts an example second interface presented via a display of the standalone miniature-golf structure of FIG. 1 for the first game of FIG. 34.
Figure 43:
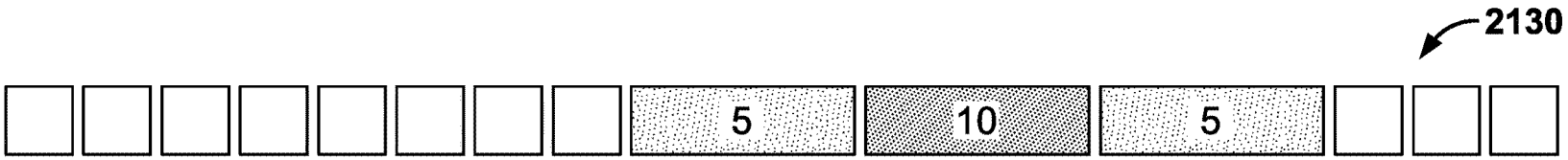
FIG. 43 is a schematic of the first interface of FIG. 41.
Figure 44:
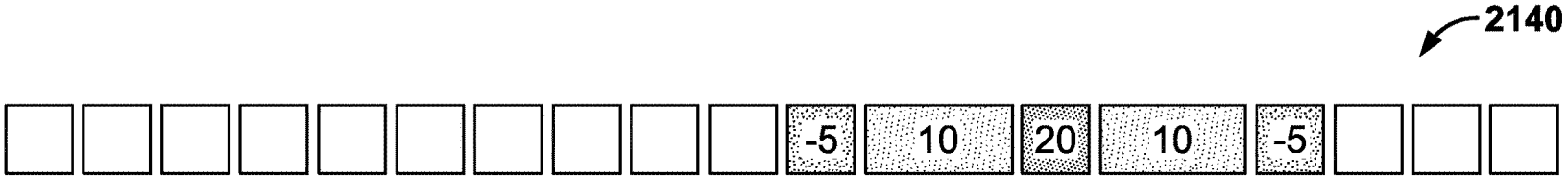
FIG. 44 is a schematic of a third interface of the first game of FIG. 34.

FIGS. 41-42 depict example interfaces 2110, 2120 for shots, and FIGS. 43-46 depict example schematics 2130, 2140, 2150, 2160 for respective interfaces.

Returning to FIG. 34, the method 1050A commences at block 1105 at which the processor(s) 905 determine the number of rounds for the game. For example, the processor (s) 905 determine the number of rounds based on the user-selected number of players. The processor(s) 905 may select fewer rounds for parties with more players and/or select more rounds for parties with fewer players. At block 1110, the processor(s) 905 determine the number of shots for each round in the game. For example, the processor(s) 905 determine the number of shots per round based on the user-selected number of players and/or the number of rounds selected for the game. The processor(s) 905 may select fewer shots per round for games with more rounds and/or parties with more players. The processor(s) 905 may select more shots per round for games with fewer rounds and/or parties with fewer players.

At block 1115, the processor(s) 905 commence a round of the game. At block 1120, the processor(s) 905 select one of the players for the next shot in the round.

At block 1125, the processor(s) 905 selects a primary putting target for the shot. The primary putting target corresponds with the greatest point value available to the player for the shot. In selecting the primary putting target, the processor(s) 905 select a lateral location, a width, and/or a point value for the primary putting target. Each of FIGS. 41-46 depict a primary putting target. In some examples, the processor(s) 905 randomly select the lateral location, the width, and/or the point value associated with the primary putting target. In each of the interfaces 2110, 2120 and the schematics 2130, 2140, 2150, 2160, the primary putting target corresponds with the highest valued target.

Figure 45:
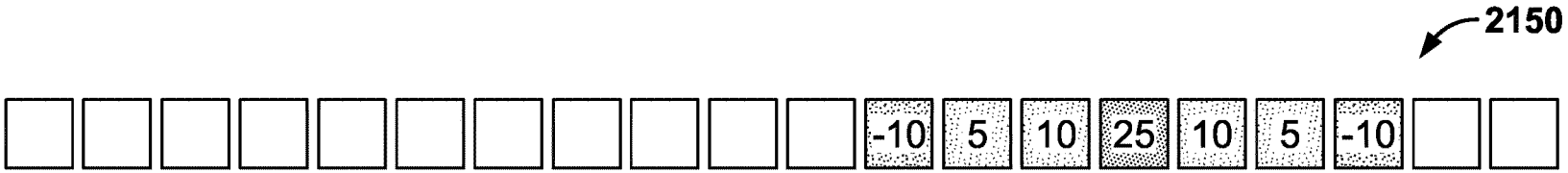
FIG. 45 is a schematic of the second interface of FIG. 42.
Figure 46:
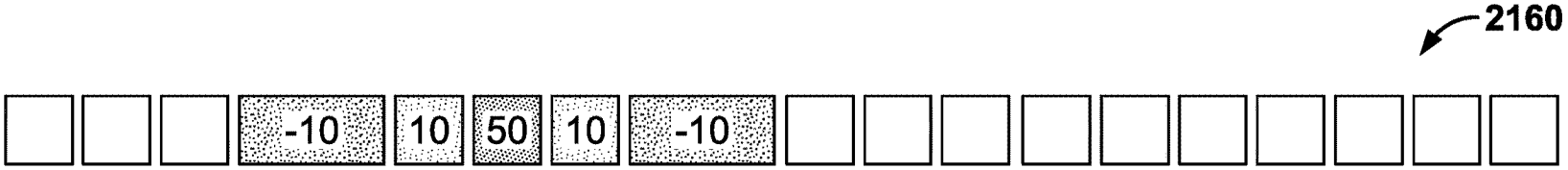
FIG. 46 is a schematic of a fourth interface of the first game of FIG. 34.

At block 1130, the processor(s) 905 selects any other putting targets (e.g., secondary targets, tertiary targets, etc.) for the shot. Each of the other putting targets corresponds with a respective point value that is less than that of the primary putting target. In selecting the other putting targets, the processor(s) 905 select a lateral location, a width, and/or a point value for each of those putting targets. Each of FIGS. 41-46 depict secondary putting targets, and each of FIGS. 42 and 45 depict a tertiary putting targets. In some examples, the other putting targets are selected by the processor(s) 905 to be contiguous with the primary putting target. For example, each secondary putting target is located next to the primary putting target, and each tertiary putting target is located next to a respective tertiary putting target. In some examples the processor(s) 905 randomly select the lateral location, the width, and/or the point value associated with the other putting targets.

At block 1135, the processor(s) 905 selects any hazards for the shot. Each of the hazards corresponds with a respective negative point value. In selecting the hazards, the processor(s) 905 select a lateral location, a width, and/or a point value for each of the hazards. Each of FIGS. 42 and 44-46 depict hazards. In some examples, the hazards are selected by the processor(s) 905 to be contiguous with the putting targets. For example, each hazard is located next a primary putting target, a respective secondary putting target (FIGS. 44 and 46), or a tertiary putting target (FIGS. 42 and 45). In some examples the processor(s) 905 randomly select the lateral location, the width, and/or the point value associated with the hazards.

At block 1900, the processor(s) 905 detect and score the shot of the player. An example method 1900 to detect and score the shot of the player is disclosed below in greater detail with respect to FIG. 40. At block 1140, the processor(s) 905 update the total points of the player and/or a team of the player based on the recently completed shot. For example, the processor(s) 905 add to the total points if the shot corresponded with a putting target or deduct from the total points if the shot corresponded with a hazard.

At block 1145, the processor(s) 905 determine whether there is another shot for the current player in the current round. In response to the processor(s) 905 determining that there is another shot, the method 1050A returns to block 1125 to conduct another shot for the current player. Otherwise, in response to the processor(s) 905 determining that there is not another shot, the method 1050A proceeds to block 1150.

At block 1150, the processor(s) 905 determine whether there is another player to putt in the current round. In response to the processor(s) 905 determining that there is another player for the current round, the method 1050A returns to block 1120 to conduct one or more shots for the other player. Otherwise, in response to the processor(s) 905 determining that there is not another player for the current round, the method 1050A proceeds to block 1155.

At block 1155, the processor(s) 905 determine whether there is another round to conduct for the game. In response to the processor(s) 905 determining that there is another round, the method 1050A returns to block 1115 to conduct the other round. Otherwise, in response to the processor(s) 905 determining that there is not another round, the method 1050A proceeds to block 1160 at which the processor(s) 905 determine the total scores and/or the winning player(s) and/or team for the game. Additionally, the digital display screen 200 presents the total scores and/or the winning player(s) and/or team. Upon completing block 1160, the method 1050A ends.

FIG. 35 is a flowchart of an example method 1050B for conducting a second game (also referred to as "Survival" and the "Survival game") to perform block 1050 of FIG. 33. The flowchart of FIG. 35 is representative of machine readable instructions that are stored in memory (such as the memory 910 of FIG. 29) and include one or more programs which, when executed by one or more processors (such as the processor(s) 905 of FIG. 29), cause the standalone miniature golf structure 10 to conduct the second game for a group of players. While the example program is described with reference to the flowchart illustrated in FIG. 35, many other methods may alternatively be used. For example, the order of execution of the blocks may be rearranged, changed, eliminated, and/or combined to perform the method 1050B. Further, because the method 1050B is disclosed in connection with the components of FIGS. 1-32, some functions of those components will not be described in detail below.

For the second game, the goal is to survive each round. The game is divided into a number of rounds (e.g., 6 rounds, 8 rounds, etc.). Each player is to putt one shot for each round. Each player is to begin with a predetermined number (e.g., 2, 3, 4, etc.) of lives (also referred to as "chances") at the beginning of the game. That is, the processor(s) 905, based on instructions stored in the memory 910, are configured to assign a predetermined number of lives to each player at the start of the game. Each player is to perform one shot for each round. In some examples, when a party has identified that it includes a player with health condition(s) or impairment(s), each player will putt all their shots consecutively (e.g., in an "ADA mode") to reduce the number of times each player is required to enter and exit from the tee surface 110.

For each shot, a target is presented via the digital display screen 200. If the lateral position of the shot matches the lateral position of the target, a predetermined point value is assigned to the player. If the player misses the target (e.g., the lateral position of the shot does not match that of the target), no point value is assigned to the player and one life is eliminated from the player. If the player has no remaining lives, the player is eliminated from the game. If the player survives all rounds of the game, bonus points are awarded to the player.

The location and/or width changes for each round and/or shot. In some examples, the location and/or width of the target is selected randomly. In some examples, each subsequent round becomes progressively more difficult, for example, by decreasing the width of the target for each subsequent shot. In some examples, no lateral position may be repeatedly selected as the center point of a target for each player. Additionally or alternatively, the center point for one shot may be no closer than a predetermined distance away (e.g., two ball-detection lanes 450) from the preceding shot.

Figure 47:
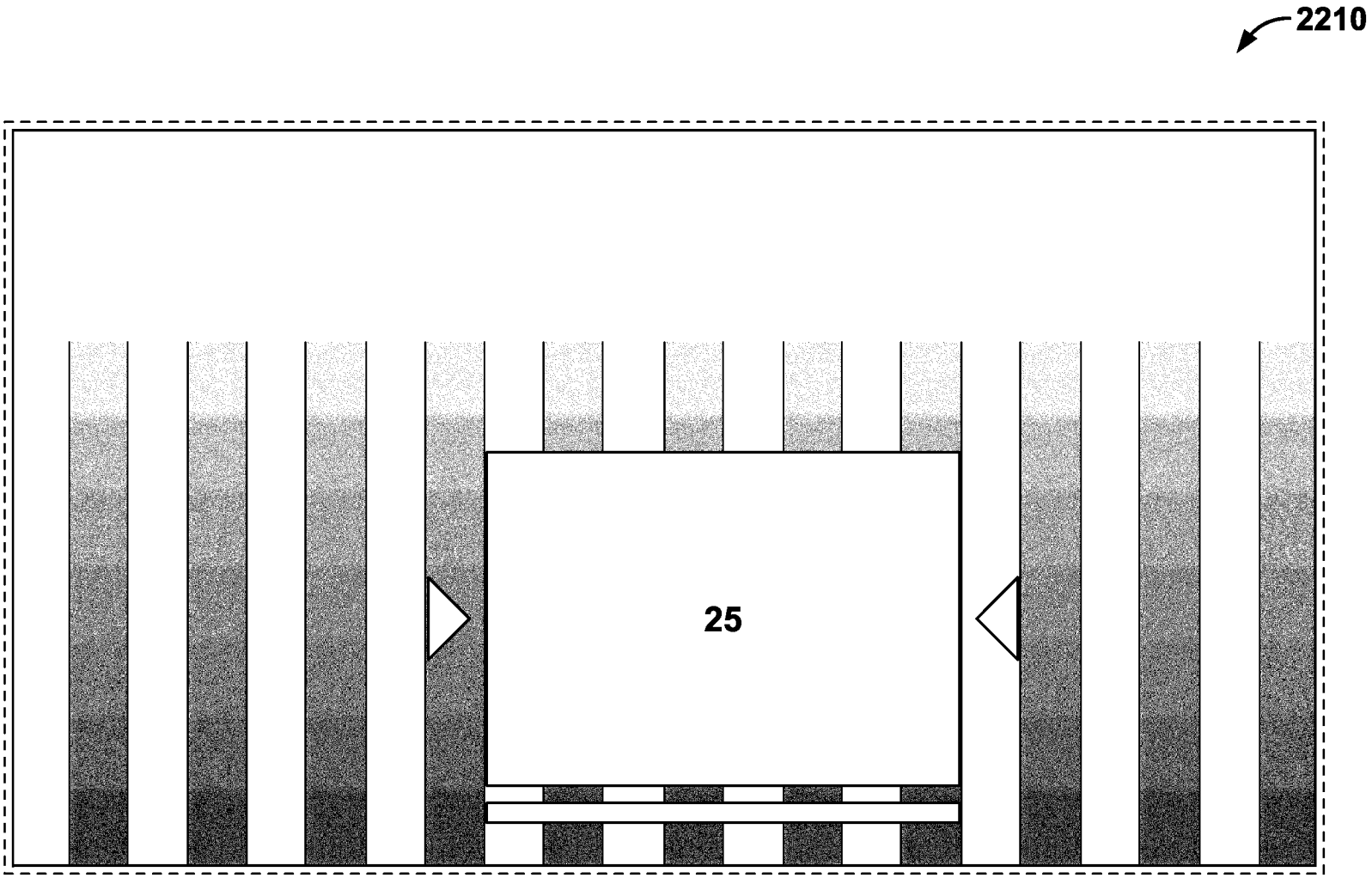
FIG. 47 depicts an example interface presented via a display of the standalone miniature-golf structure of FIG. 1 for the second game of FIG. 35.
Figure 48:
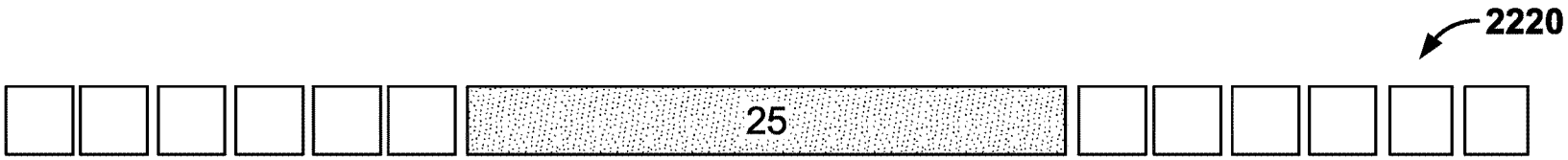
FIG. 48 is a schematic of the interface of FIG. 47.
Figure 49:
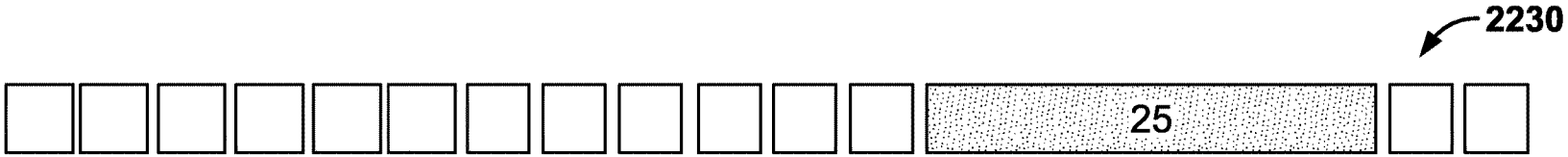
FIGS. 49-51 depict schematics of other example interfaces of the second game of FIG. 35.
Figure 50:
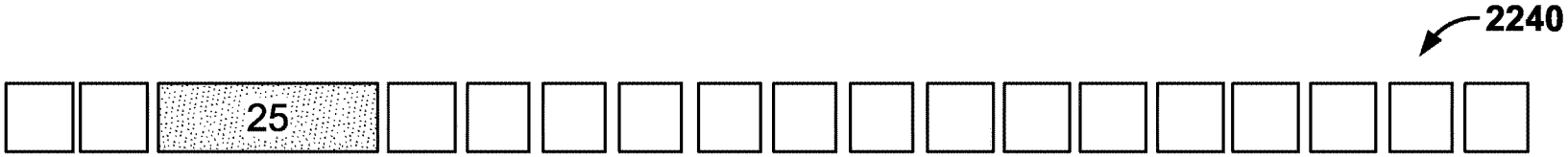
Figure 51:
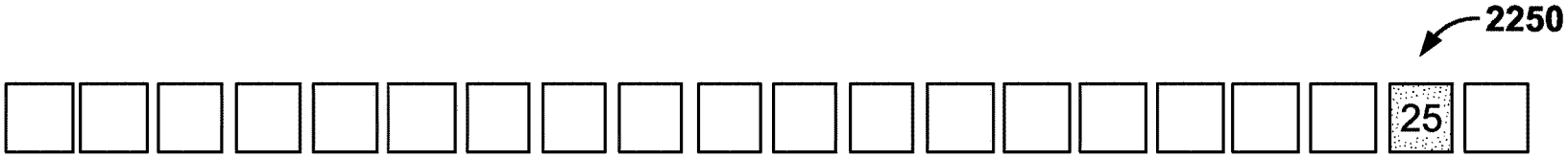

FIG. 47 depicts an example interface 2210 for a shot of the game, and FIGS. 48-51 depict example schematics 2220, 2230, 2240, 2250 for respective interfaces of the game.

Returning to FIG. 35, the method 1050B commences by the processor(s) 905 identifying the maximum number of rounds to be conducted for the game. At block 1205, the processor(s) 905 commence a round of the game. At block 1210, the processor(s) 905 select one of the players for the next shot in the round.

At block 1215, the processor(s) 905 select a putting target for the shot. In selecting the putting target, the processor(s) 905 select a lateral location, a width, and/or a point value for the primary putting target. Each of FIGS. 47-51 depict example putting targets. In some examples, the processor(s) 905 randomly select the lateral location, the width, and/or the point value associated with the primary putting target. Further, in some examples, the processor(s) 905 reduce the width of each subsequent shot to increase the difficulty for the player over time.

At block 1900, the processor(s) 905 detect and score the shot of the player. An example method 1900 to detect and score the shot of the player is disclosed below in greater detail with respect to FIG. 40. At block 1220, the processor(s) 905 update the total points of the player and/or a team of the player based on the recently completed shot. For example, the processor(s) 905 add to the total points if the shot corresponded with a putting target or deduct from the total points if the shot corresponded with a hazard. At block 1225, the processor(s) 905 determine whether the putting target was missed by the putt of the player.

In response to the processor(s) 905 determining that the putting target was missed, the method 1050B proceeds to block 1230 at which the processor(s) 905 deduct one life from the remaining lives of the player. At block 1235, the processor(s) 905 determine whether the current player has any lives remaining. In response to the processor(s) 905 determining that the current player does not have any lives remaining, the method 1050B proceeds to block 1240 at which the processor(s) 905 eliminate the player from the game. Upon completing block 1240, the method 1050B proceeds to block 1245. Returning to block 1235, in response to the processor(s) 905 determining that the current player has at least one life remaining, the method 1050B proceeds to block 1245.

At block 1245, the processor(s) 905 determine whether there is another player for the current round of the game. In response to the processor(s) 905 determining that there is another player for the current round, the method 1050B returns to block 1210 to conduct the shot for the other player. Otherwise, in response to the processor(s) 905 determining that there is not another player for the current round, the method 1050B proceeds to block 1250.

At block 1250, the processor(s) 905 determine whether there is another round to conduct for the game. For example, the processor(s) 905 identify that there is no other round to conduct if the preselected maximum number of rounds have been completed. In response to the processor(s) 905 determining that there is round to conduct, the method 1050B returns to block 1205 to commence the other round. Otherwise, in response to the processor(s) 905 determining that there is not another round to conduct, the method 1050B proceeds to block 1255.

At block 1255, the processor(s) 905 determine whether there are any players that have at least one life remaining after the last round has been completed. In response to the processor(s) determining that there are no remaining players, the method 1050B proceeds to block 1260 at which the processor(s) 905 determine the total scores and/or the winning player(s) and/or team for the game. Additionally, the digital display screen 200 presents the total scores and/or the winning player(s) and/or team. Returning to block 1255, in response to the processor(s) determining that there are remaining player(s), the method 1050B proceeds to block 1265 at which the processor(s) 905 award a predetermined bonus point value to each remaining player. Upon completing block 1265, the method 1050B proceeds to block 1260. Upon completing block 1260, the method 1050B ends.

FIG. 36 is a flowchart of an example method 1050C for conducting a third game (also referred to as "Tug-of-War" and the "Tug-of-War game") to perform block 1050 of FIG. 33. The flowchart of FIG. 36 is representative of machine readable instructions that are stored in memory (such as the memory 910 of FIG. 29) and include one or more programs which, when executed by one or more processors (such as the processor(s) 905 of FIG. 29), cause the standalone miniature golf structure 10 to conduct the third game for a group of players. While the example program is described with reference to the flowchart illustrated in FIG. 36, many other methods may alternatively be used. For example, the order of execution of the blocks may be rearranged, changed, eliminated, and/or combined to perform the method 1050C. Further, because the method 1050C is disclosed in connection with the components of FIGS. 1-32, some functions of those components will not be described in detail below.

For the third game, the goal is to cause a center line of a set of putting targets to cross an end line. The game is played by two or more players/teams. Each player/team includes one player or a team of a players for an individual mode or a team mode, respectively. The game is played as a series of matches. If there are two participating players/teams, the two players/teams play each other for each match. If there are more than two participating players/teams, the players/teams participating in each match is rotated, for example, in a round-robin manner.

For each match, rounds of shots are completed until one of the players/teams reaches a respective end line to finish the match. For each round, one player from each player/team conducts a shot. For each shot, a center line and a set of putting targets are presented via the digital display screen 200. Each player/team has a set of putting targets dedicated to it. The putting targets for one player/team, is on one side of the center line, and the putting targets for the other player/team, is on the other side of the center line.

Figure 52:
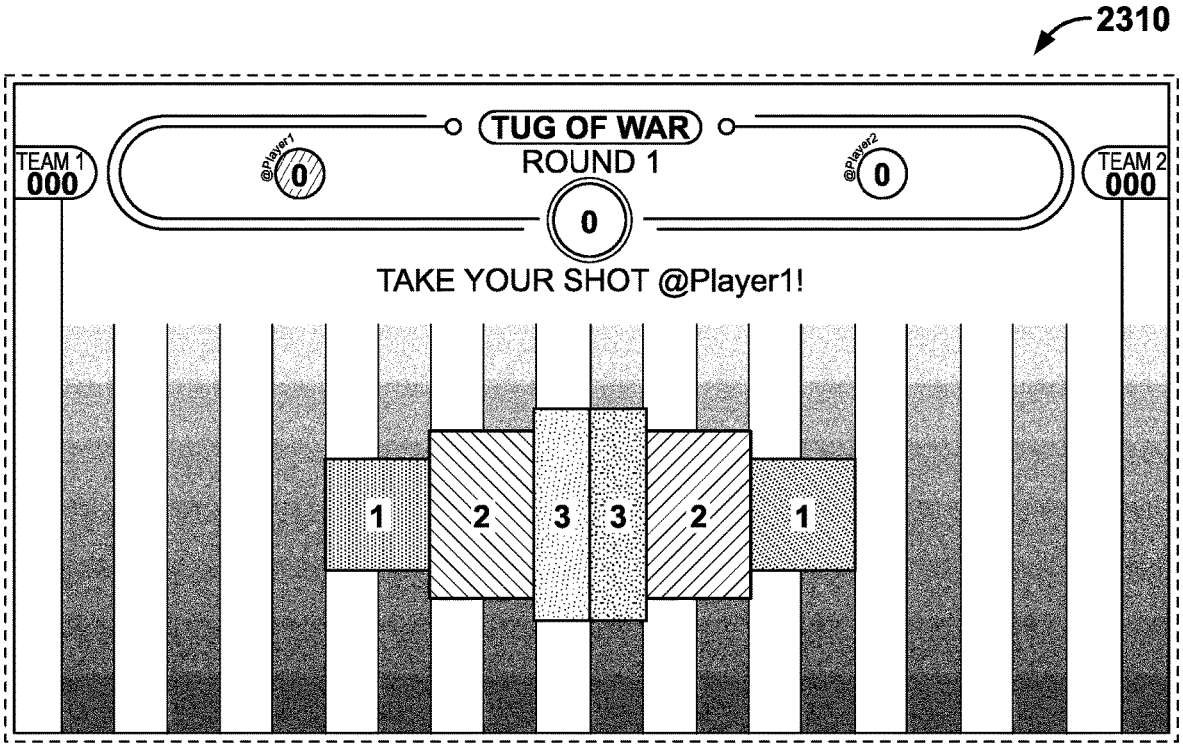
FIGS. 52-57 depict example interfaces presented via a display of the standalone miniature-golf structure of FIG. 1 for the third game of FIG. 36.
Figure 53:
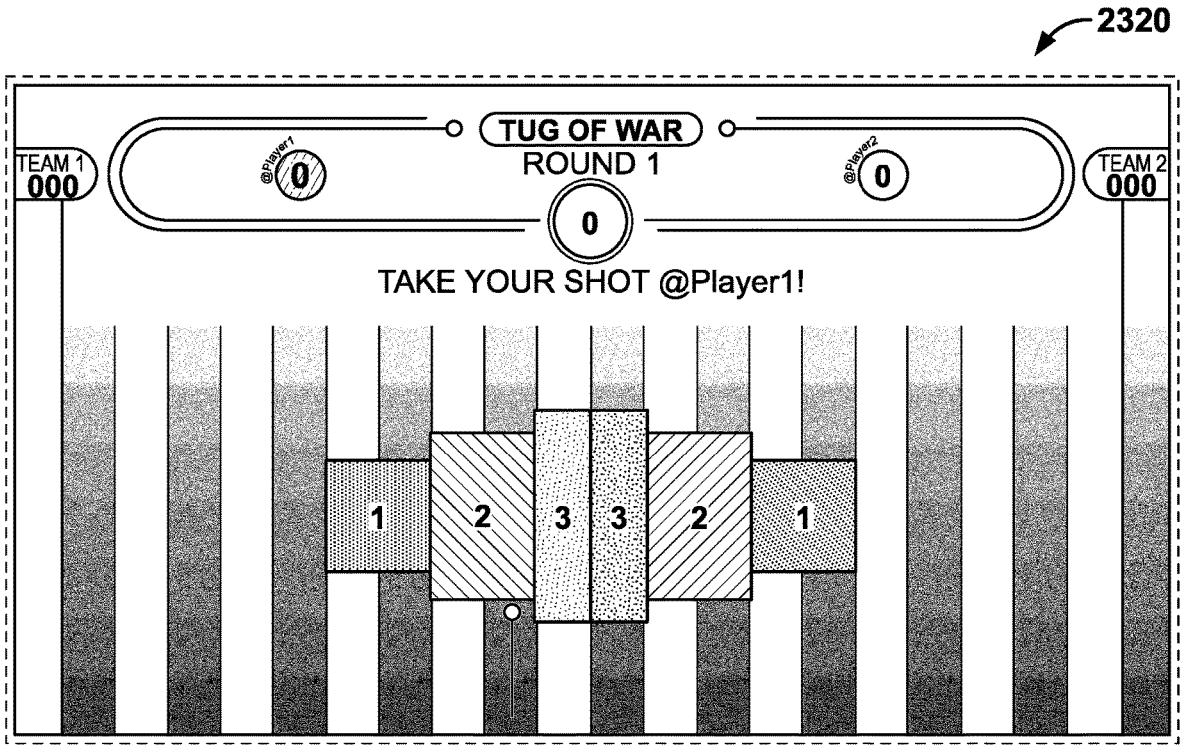
Figure 54:
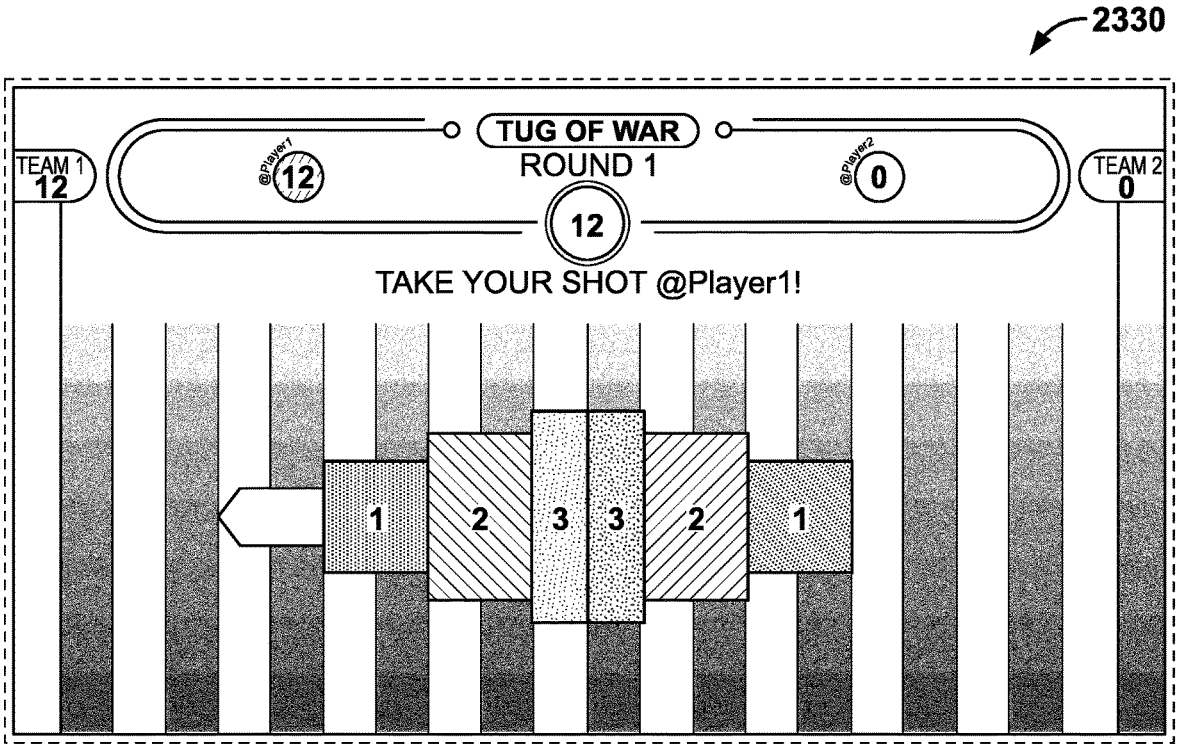
Figure 55:
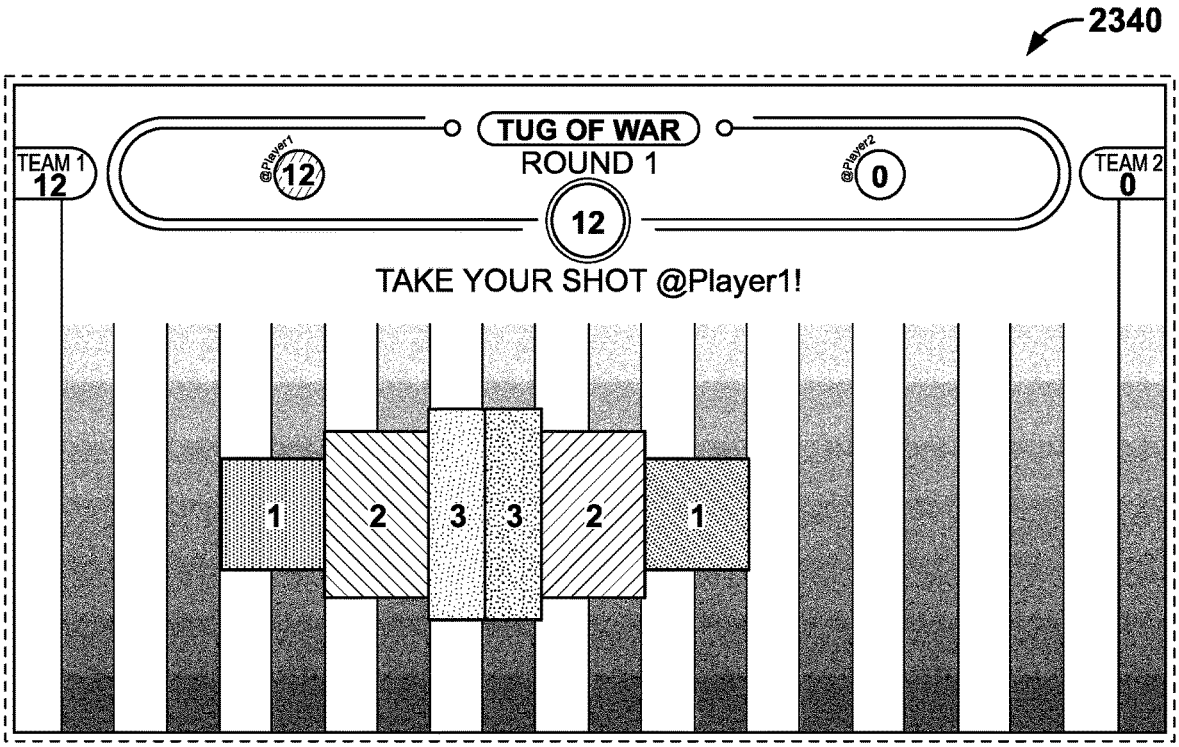
Figure 56:
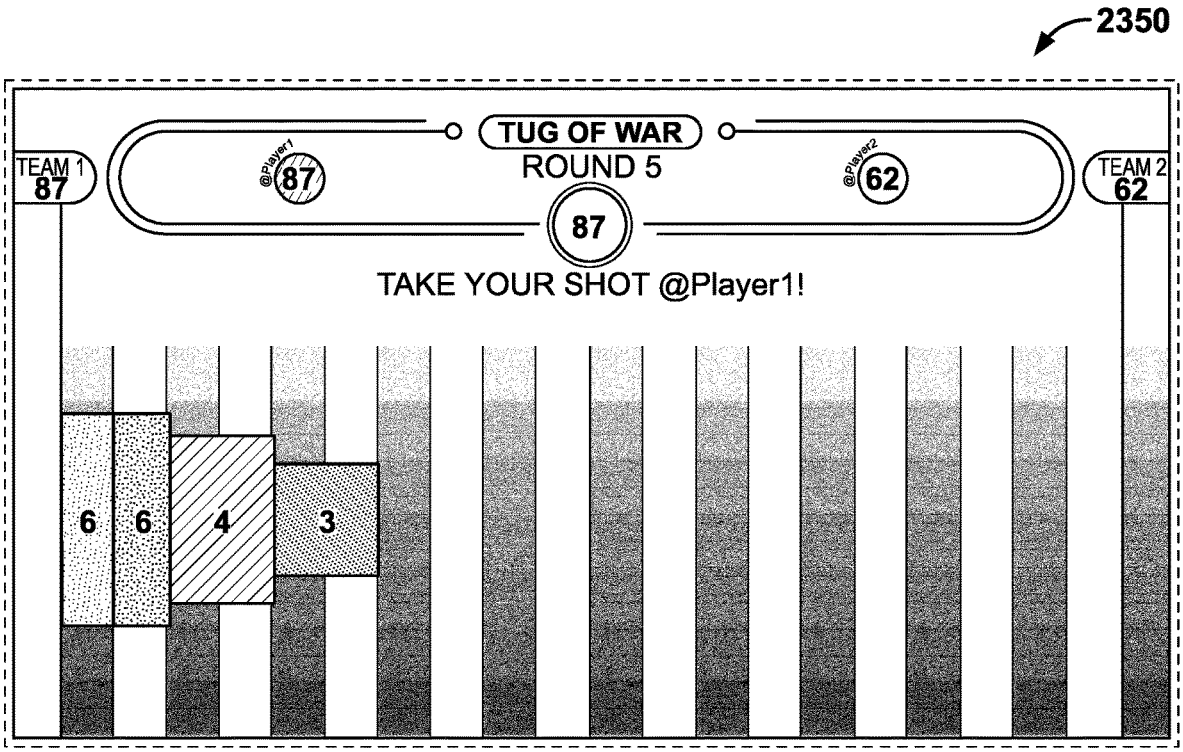
Figure 57:
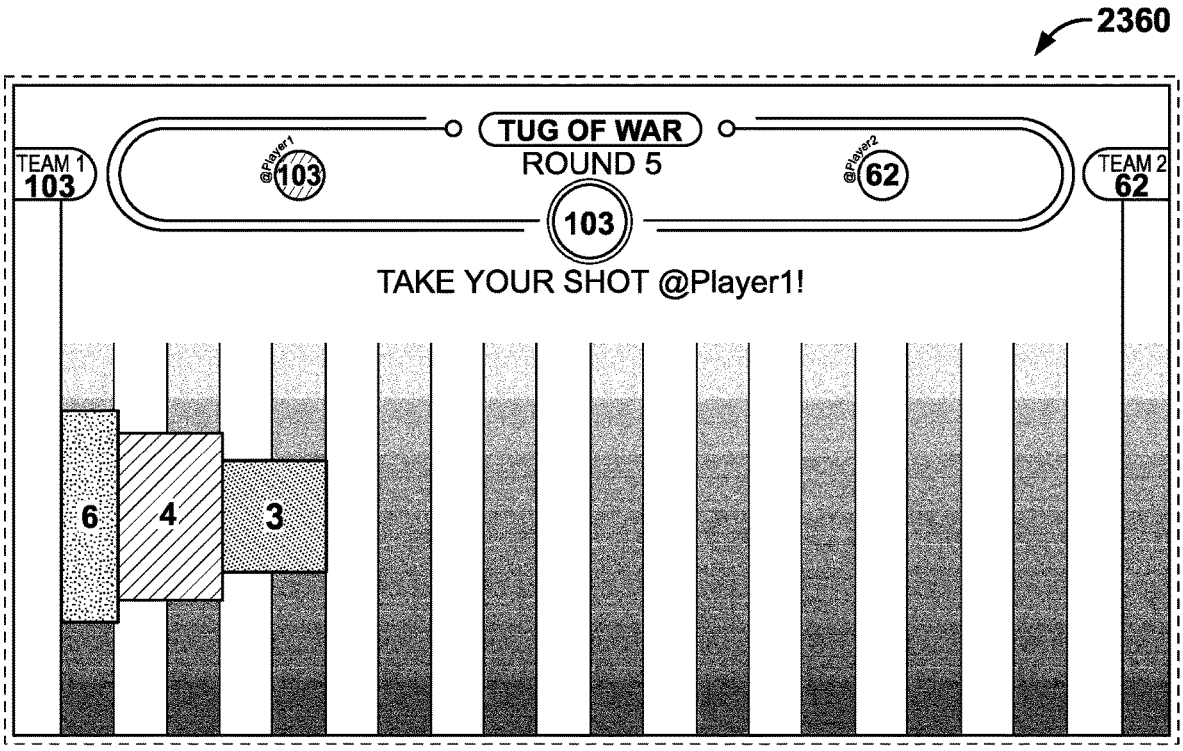
Figure 58:
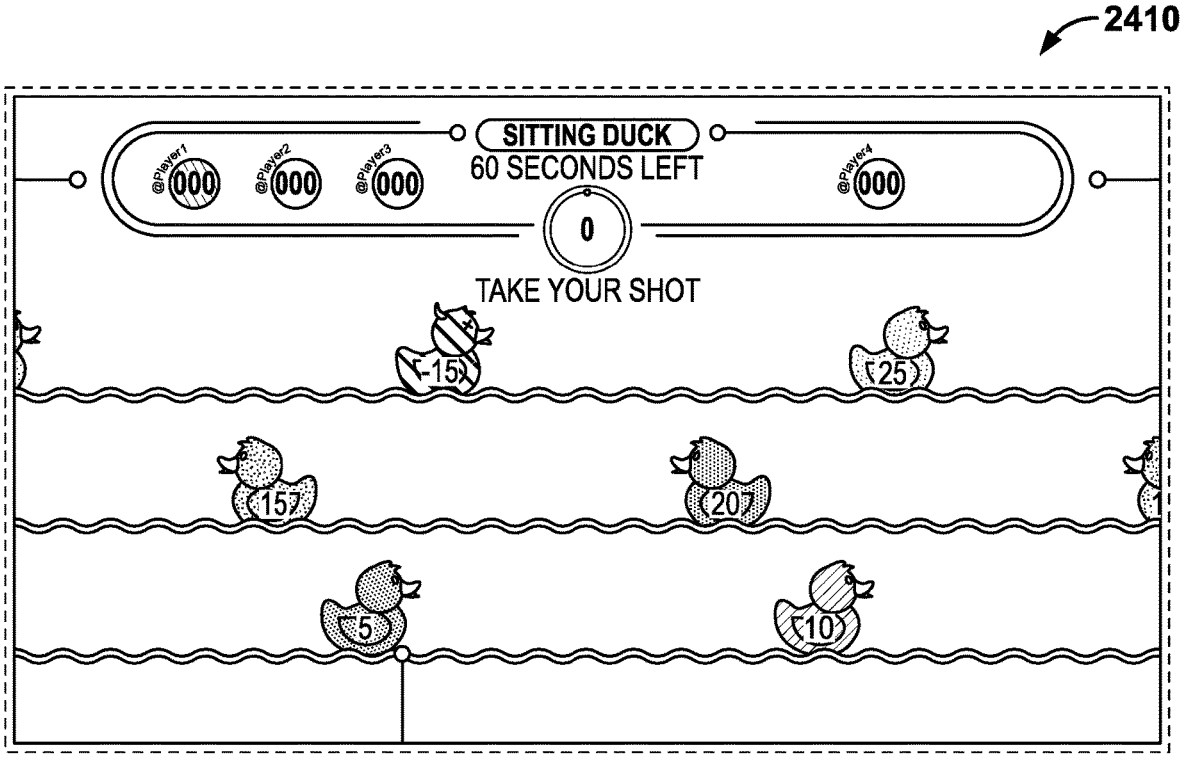
FIGS. 58-61 depict example interfaces presented via a display of the standalone miniature-golf structure of FIG. 1 for the fourth game of FIGS. 37A-37B.
Figure 59:
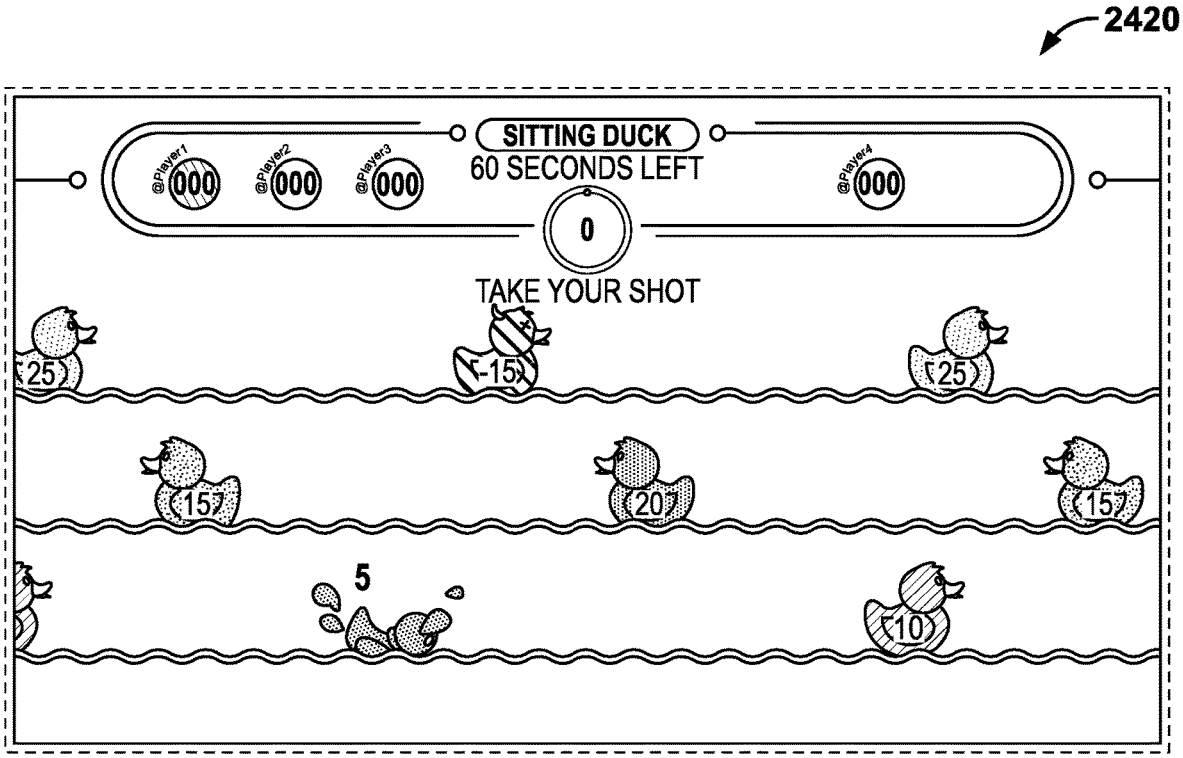
Figure 60:
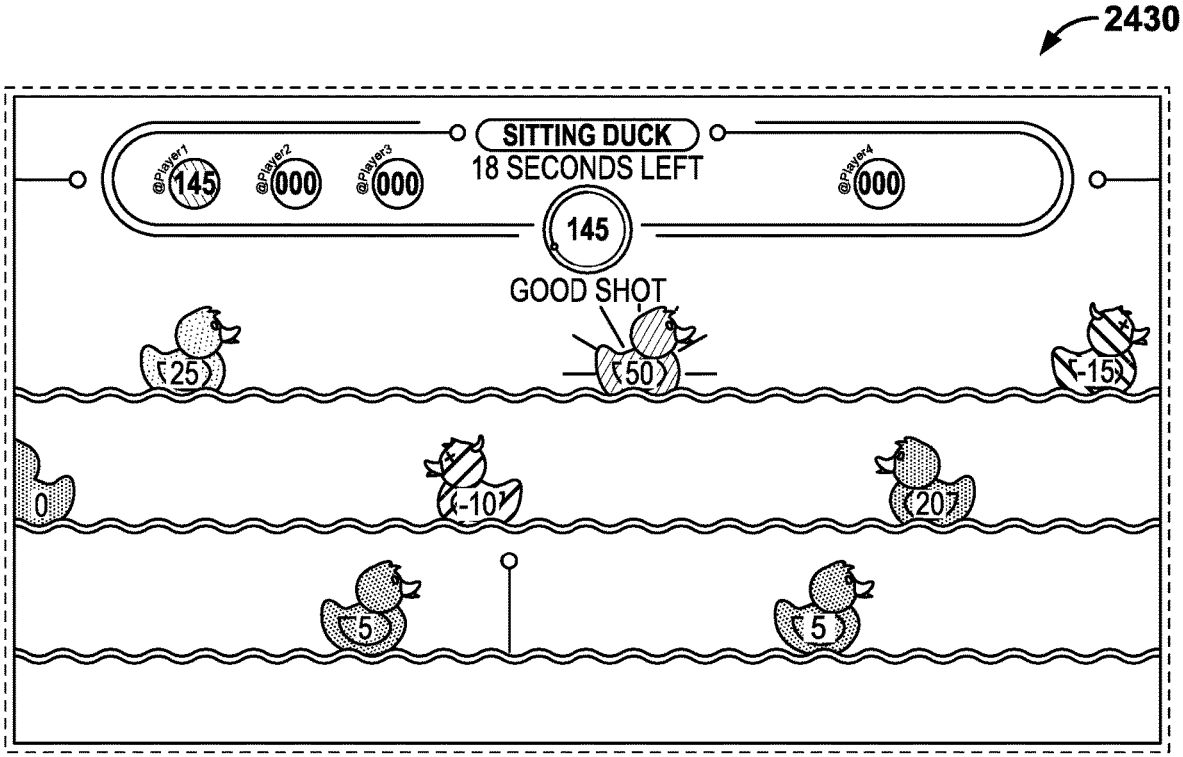
Figure 61:
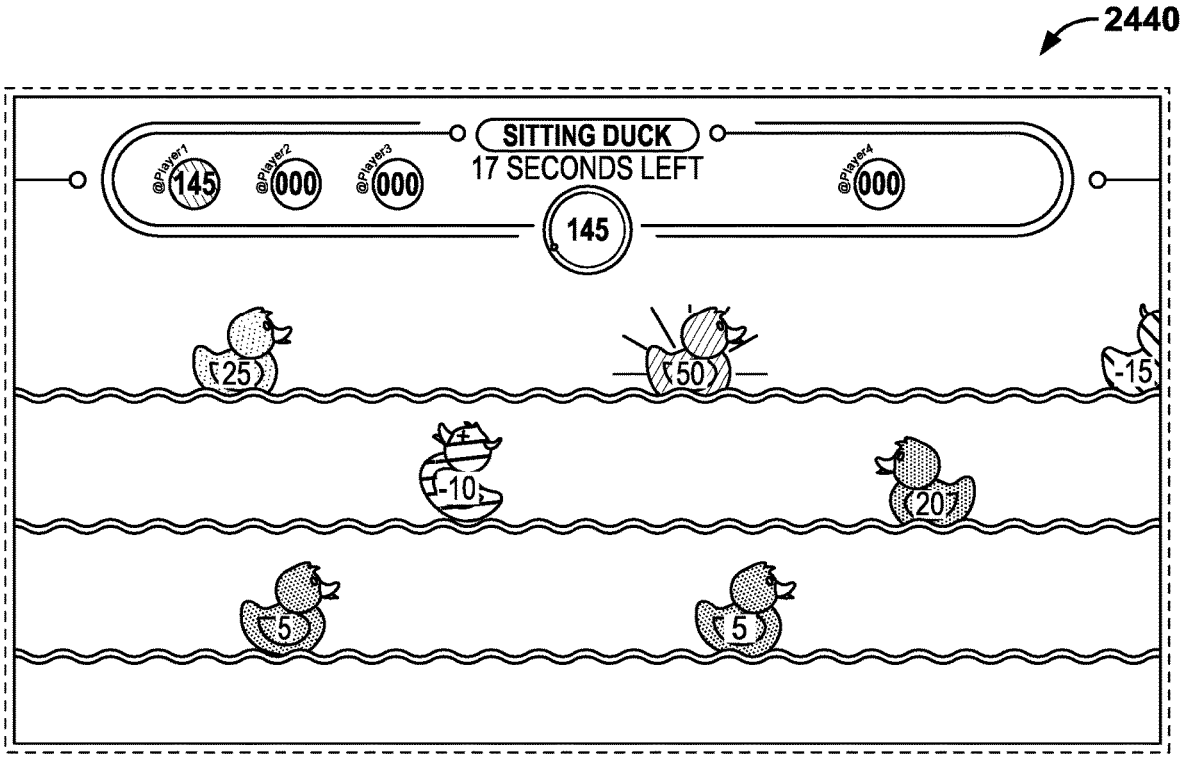
Figure 62:
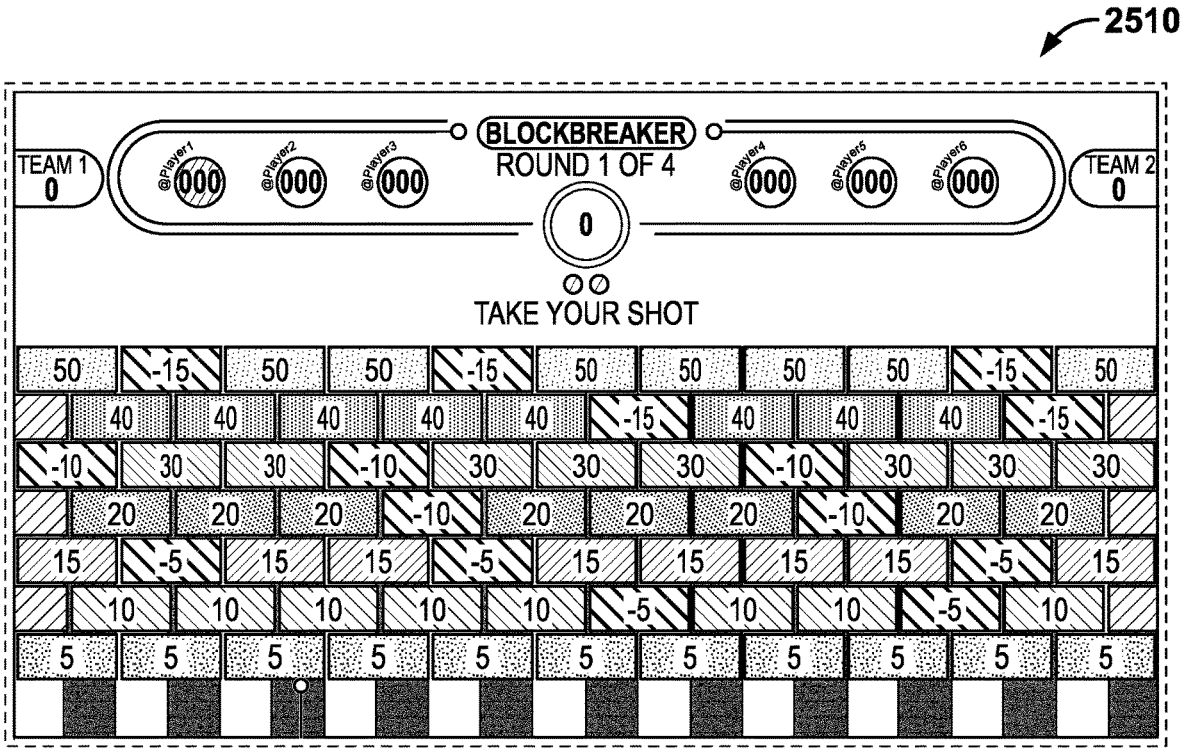
FIGS. 62-65 depict example interfaces presented via a display of the standalone miniature-golf structure of FIG. 1 for the fifth game of FIG. 38.

FIGS. 52-57 depict an respective example interfaces 2310, 2320, 2330, 2340, 2350, 2360 that depict a match of the game. For example, FIG. 52 depicts the beginning of a match, FIG. 57 depicts the end of the match, and FIGS. 53-56 depict portions of the match therebetween. In the example interfaces, each player/team is assigned three targets with a primary target extending from the center line, a secondary target extending from the primary target, and a tertiary target extending from the secondary target. The primary target is worth more points than the secondary target, and the secondary target is worth more than the tertiary target. In other examples, each set of targets may include more or fewer targets and/or the targets may be arranged in another manner.

If a player hits one of their targets with a shot, the center line and the targets move laterally in a direction toward their end line. Additionally, a corresponding point value is awarded for the player. In contrast, if the player hits a target of the other player/team, the center line and the targets move laterally in a direction toward the end line of the other player/team. Additionally, a corresponding point value is deducted for the player. In some examples, the lateral distance of the shift is constant for each target. In other examples, the lateral distance of the shift depends on which target is hit. For example, hitting a primary target results in a greater shift than hitting a secondary target, and hitting a secondary target results in a greater shift than hitting a third target. Each match is played until the center line crosses the end line of one of the teams/players.

Returning to FIG. 35, the method 1050C commences at block 1305 at which the processor(s) 905 identify a number of matches for the game. At block 1310, the processor(s) 905 commence the next match of the game. At block 1315, the processor(s) 905 commence the next round of the current match.

At block 1320, the processor(s) 905 determine the position of the center line and each of the putting targets. For example, the targets include left-sided target(s) to the left of the center line and right-sided target(s) to the right of the center line. In some examples, the left-sided target(s) and the right-sided target(s) are contiguous with each other and/or are mirrored with respect to each other. At block 1325, the processor(s) 905 select a player for the next shot. At block 1900, the processor(s) 905 detect and score the shot of the player. An example method 1900 to detect and score the shot of the player is disclosed below in greater detail with respect to FIG. 40.

At block 1330, the processor(s) 905 update the total points of the player and/or a team of the player based on the recently completed shot. For example, the processor(s) 905 add to the total points if the shot vertically aligned with a putting target. At block 1335, the processor(s) 905 move the position of the center line and the putting targets laterally on the game interface if the shot vertically aligned with one of the putting targets. For example, the processor(s) 905 move the position of the center line and the putting targets laterally by a predefined amount or magnitude and a predefined direction that is designated for the hit putting target. The processor(s) 905 move the center line and the targets rightward in response to determining that the shot aligns vertically with one of the right-sided target(s) and/or move the center line and the targets leftward in response to determining that the shot aligns vertically with one of the left-sided target(s). At block 1340, the processor(s) 905 determine whether either of the end lines (i.e., the right end line or the left end line) has been reached by the center line.

In response to the processor(s) 905 determining that an end line has not been reached by the center line, the method 1050C proceeds to block 1345. At block 1345, the processor(s) 905 determine whether there is another player to shoot in the current round. In response to the processor(s) 905 determining that thre is another player for the round, the method 1050C returns to block 1325. Otherwise in response to the processor(s) 905 determining that there is not another player for the round, the method 1050C returns to block 1315 to commence another round of the current match.

Returning to block 1340, in response to the processor(s) 905 determining that an end line has been reached by the center line, the method 1050C proceeds to block 1345 at which the processor(s) 905 award a predetermined point value to the winning team and/or player.

At block 1355, the processor(s) 905 determine whether there is another match for the game. In response to the processor(s) 905 determining that there is another match, the method 1050C returns to block 1310 to commence the next match. Otherwise, in response to the processor(s) 905 determining that there is not another match, the method 1050C proceeds to block 1360 at which the processor(s) 905 at which the processor(s) 905 determine the total scores and/or the winning player(s) and/or team for the game. Additionally, the digital display screen 200 presents the total scores and/or the winning player(s) and/or team. Upon completing block 1360, the method 1050C ends.

FIGS. 37A-37B is a flowchart of an example method 1050D for conducting a fourth game (also referred to as "Sitting Duck" and the "Sitting Duck game") to perform block 1050 of FIG. 33. The flowchart of FIGS. 37A-37B is representative of machine readable instructions that are stored in memory (such as the memory 910 of FIG. 29) and include one or more programs which, when executed by one or more processors (such as the processor(s) 905 of FIG. 29), cause the standalone miniature golf structure 10 to conduct the fourth game for a group of players. While the example program is described with reference to the flowchart illustrated in FIGS. 37A-37B, many other methods may alternatively be used. For example, the order of execution of the blocks may be rearranged, changed, eliminated, and/or combined to perform the method 1050D. Further, because the method 1050D is disclosed in connection with the components of FIGS. 1-32, some functions of those components will not be described in detail below.

For the fourth game, the goal is to score as many points within a predefined duration of time (e.g., 1 minute). Each player is to putt as many shots as possible during a respective duration of time. That is, the processor(s) enable a player to shoot an unlimited number of shots during a predefined duration of time. When one shot is detected by the processor(s) 905, via the sensor(s), another ball is quickly dispensed by the ball-dispensing assembly 800 to enable the player to quickly take another shot.

The game interface presented via the digital display screen 200 includes moving targets arranged in one or more rows. In each respective example interface 2410, 2420, 2430, 2440 of FIGS. 58-61, there are three rows of targets with each row having a different sequence, compared to the other rows, along which its moving target(s) and/or hazard(s) travel across the interface. That is, one or more of the rows may include hazards. The sequence of a first row (e.g., a bottom row) includes a mixture of 5-point target(s), 10-point target(s), and 5-point hazard(s). The sequence of a second row (e.g., the middle row) includes a mixture of 15-point target(s), 20-point target(s), and 10-point hazard(s). The sequence of a third row (e.g., the upper row) includes a mixture of 25-point target(s), 50-point target(s), and 15-point hazard(s). The rows may move in different directions and/or speeds. In the illustrated example, the targets and hazards of the first and third rows are to move to the right, and the targets and hazards of the second row are to move to the left. The moving targets and hazards of the second row are to move faster than those of the first row, and the moving targets and hazards of the third row are to move faster than those of the second row. That is, for each row, the processor(s) 905 select a range of point values, a direction of travel, and a speed of travel for the corresponding moving targets and/or hazards.

In some instances, two or more moving target(s) and/or hazard(s) may be at the same lateral position (e.g., may align vertically with each other) as a detected shot. In such instances, the lowest target that aligns with the shot is selected as the "hit" target. In turn, the targets of the higher rows are worth more but are harder to hit.

Returning to FIG. 37A, the method 1050D commences at block 1405 at which the processor(s) 905 select the next player to play the game. At block 1410, the processor(s) 905 select a respective sequence for each row of moving targets. In the illustrated example of FIGS. 58-61, there are three rows of targets with each row having a different sequence of moving target(s) and/or hazard(s) compared to the other rows. The processor(s) 905 have selected a sequence for the first row (e.g., the bottom row), the second row (e.g., the middle row), and the third row (e.g., the upper row). Further, the processor(s) 905 select a respective direction and travel speed for each row of moving targets.

At block 1415, the ball-dispensing assembly 800, based on instructions from the processor(s) 905, dispense another golf ball onto the tee surface 110 for the next shot of the current player. At block 1420, the processor(s) 905 generate and the digital display screen 200 presents an interface with rows of moving targets and/or hazards.

At block 1425, the processor(s) 905 determine whether the current player has completed the shot. For example, the processor(s) 905 determine that the player has completed the shot in response to any of the any of the sensors 470, 480, 680 detecting the presence of the golf ball on the sensor assembly 300. In response to the processor(s) 905 determining that the player has not yet completed the shot, the method 1050D proceeds to block 1430.

At block 1430, the processor(s) 905 determine whether any of the rows has reached its last target and/or hazard in the respective previously-selected sequence. In response to the processor(s) 905 determining that none of the rows have reached their last respective target and/or hazard, the method 1050D returns to block 1420 to continue generating and displaying the interface of the game. Otherwise, in response to the processor(s) 905 determining that one or more of the rows has reached their last respective target and/or hazard, the method 1050D proceeds to block 1435 at which the processor(s) 905 reselect a new respective sequence for each of the rows that has reached its last target and/or row. Upon completing block 1435, the method 1050D returns to block 1420.

Returning to block 1425, in response to the processor(s) 905 determining that the player has completed the shot, the method 1050D proceeds to block 1440 of FIG. 37B.

At block 1440, the processor(s) 905 determine whether the shot detected at block 1435 is the first shot of the current player. In response to the processor(s) 905 determining that the most-recently detected shot is not the first of the current player, the method 1050D proceeds to block 1450. Otherwise, in response to the processor(s) 905 determining that the detected shot is the first of the current player, the method 1050D proceeds to block 1445 at which the processor(s) 905 start a timer for a predefined duration of time for the current player. Upon completing block 1445, the method 1050D proceeds to block 1450.

At block 1450, the processor(s) 905 detect the lateral position to which the golf ball was shot by the player. In some examples, the processor(s) 905 detect the lateral position by identifying through which of the ball-detection lanes 450 the golf ball has traveled upon crossing the rear end 125 of the putting surface 120. In examples in which the sensor assembly 300 includes the sensor cartridge 400, the processor(s) 905 determine the lateral position of the shot by (1) identifying which of the sensors 470 detected the presence of the golf ball and (2) subsequently identifying which of the ball-detection lanes 450 correspond with those sensor(s) 470. In examples in which the sensor assembly 300 includes the sensor cartridge 600, the processor(s) 905 determine the lateral position of the shot based on a detected lateral distance between the sensor 680 and the golf ball.

At block 1455, the processor(s) 905 determine the location of the moving target(s) at the time the shot was detected by the sensor(s). At block 1460, the processor(s) 905 determine the processor(s) 905 detecting whether the shot location corresponds with a target and/or a hazard. With the Sitting Ducks game, two or more moving target(s) and/or hazard(s) may be at the same lateral position (e.g., may align vertically with each other) when the shot of the current player is detected. In turn, the shot location may align with multiple moving target(s) and/or hazard(s). For example, the shot location may align with a first target of a first row, a second target of a second row, and a third target of a third row. In such examples, the processor(s) 905 select target and/or hazard of the lowest-positioned row, as presented on the game interface, as the target and/or hazard that is "hit" by the shot of the player. In response to the processor(s) 905 determining that the shot location does not match (e.g., aligned vertically with) target(s) and/or hazard(s), the method 1050D proceeds to block 1470.

Otherwise, in response to the processor(s) 905 determining that the shot location does match (e.g., aligned vertically with) target(s) and/or hazard(s), the method 1050D proceeds to block 1465 at which the processor(s) 905 award points to or deduct points from the user for the shot. For example, in response to the processor(s) 905 determining that the player's shot aligns with a target, the processor(s) 905 award the point value associated with that target to the current player. In response the processor(s) 905 determining that the current player's shot aligns with a hazard, the processor(s) 905 deduct the point value associated with that hazard from the total points of the current player.

In examples in which the shot location aligns with two or more target(s) and/or hazard(s), the processor(s) 905 select the lowest positioned target and/or hazard, as presented on the game interface, as the target and/or hazard that is "hit" by the shot of the player and subsequently awards the corresponding point value to or deducts the corresponding point value from the player. That is, in response to determining that the lateral position of the golf shot aligns vertically both with a first moving target in a lower row and a second moving target in an upper row, the processor(s) 905 award the point value associated with the first moving target in the lower row to the current player.

Upon completing block 1465, the method 1050D proceeds to block 1470 at which the processor(s) 905 determine whether the predefined duration of time of the timer for the current player has been completed. In response to the processor(s) 905 determining that the predefined duration of time has not been completed for the current player, the method 1050D returns to block 1415 of FIG. 37A to conduct another shot for the current player. Otherwise, in response to the processor(s) 905 determining that the predefined duration of time has been completed for the current player, the method 1050D proceeds to block 1475.

At block 1475, the processor(s) 905 determine whether there is another player to putt. In response to the processor(s) 905 determining that there is another player, the method 1050D returns to block 1405 of FIG. 37A to select another player. Otherwise, in response to the processor(s) 905 determining that there is not another player, the method 1050D proceeds to block 1480 at which the processor(s) 905 determine the total scores and/or the winning player(s) and/or team for the game. Additionally, the digital display screen 200 presents the total scores and/or the winning player(s) and/or team. Upon completing block 1480, the method 1050D ends.

FIG. 38 is a flowchart of an example method 1050E for conducting a fifth game (also referred to as "Blockbreaker" and the "Blockbreaker game") to perform block 1050 of FIG. 33. The flowchart of FIG. 38 is representative of machine readable instructions that are stored in memory (such as the memory 910 of FIG. 29) and include one or more programs which, when executed by one or more processors (such as the processor(s) 905 of FIG. 29), cause the standalone miniature golf structure 10 to conduct the fifth game for a group of players. While the example program is described with reference to the flowchart illustrated in FIG. 38, many other methods may alternatively be used. For example, the order of execution of the blocks may be rearranged, changed, eliminated, and/or combined to perform the method 1050E. Further, because the method 1050E is disclosed in connection with the components of FIGS. 1-32, some functions of those components will not be described in detail below.

For the fifth game, the goal is to score as many points over a plurality of rounds. Each player is to putt one or more shots (e.g., 1, 2, 3, etc.) in each round of the game. That is, the processor(s) 905 are configured to conduct a plurality of rounds and conduct one or more shots for each of the players in each of the rounds. A player is awarded points in response to hitting a target and is deducted points in response to hitting a hazard.

As shown in FIGS. 62-65, the game interface initially includes targets and hazards arranged in rows. The digital display screen 200 is configured to display the same interface for the duration of the game, with the interface being updated each time a target or hazard is hit by a shot. FIGS. 62-65 depict example screenshots 2510, 2520, 2530, 2540 as the game interface evolves over time.

Each target and/or hazard may have the same width (e.g., 2 lanes of a 20-lane board). For example, the rows are arranged such that the targets and hazards form a contiguous block at the beginning of the game. When a target or hazard is "hit" by a shot, that target or hazard is removed from the interface. In turn, target(s) and/or hazard(s) of higher rows become exposed to be hit by subsequent shots in the game. That is, in response to determining that the shot has hit a target, the processo(s) 905 remove the hit target from the interface for subsequent shots of the game.

In the illustrated example, the targets and hazards are arranged so that the higher point values become available the longer the game is player. For example, the targets of the first row (e.g., the lowest row) has targets with the lowest point value (e.g., 5 points), the targets of the second row (e.g., the second lowest row) has targets with the second lowest point value (e.g., 10 points), etc. That is, based on the instructions stored in the memory 910, the processor(s) 905 assign a different point value to each of the targets in a first row compared to that of each of the targets in a second row. Similarly, the point values associated with the hazards increases from the first row to the second row, from the second row to the third row, etc.

Returning to FIG. 38, the method 1050E commences at block 1505 at which the processor(s) 905 determine the number of rounds for the game. For example, the processor(s) 905 determine the number of rounds based on the user-selected number of players. The processor(s) 905 may select fewer rounds for parties with more players and/or select more rounds for parties with fewer players. At block 1510, the processor(s) 905 determine the number of shots (e.g., 2, 3, 4, etc.) for each round in the game.

At block 1515, the processor(s) 905 select targets and/or hazards for one or more rows. For example, the processor(s) 905 select a lateral location, a width, and/or a point value for each of the targets and the hazards. At block 1520, the processor(s) 905 commence a round of the game. At block 1525, the processor(s) 905 select one of the players for the next shot in the round.

At block 1900, the processor(s) 905 detect and score the shot of the current player. An example method 1900 to detect and score the shot of the player is disclosed below in greater detail with respect to FIG. 40. As disclosed below in greater detail with respect to FIG. 40, the method 1900 includes the processor(s) 905 detecting whether the shot location corresponds with a target and/or a hazard at block 1960. With respect to the Blockbreaker game of FIG. 38, the targets and/or hazards are stacked together in layers of rows. In turn, the shot location of the player may align with multiple targets and/or hazards. For example, the shot location may align with a first target of a first row, a second target of a second row, a third target of a third row, etc. In such examples, the processor(s) 905 select the lowest positioned target and/or hazard, as presented on the game interface, as the target and/or hazard that is "hit" by the shot of the player. That is, in response to determining that the lateral position of the golf ball aligns vertically both with a first target in a lower row and a second target in an upper row, the processor(s) 905 award a point value associated with the first target in the lower row to the current player.

Figure 63:
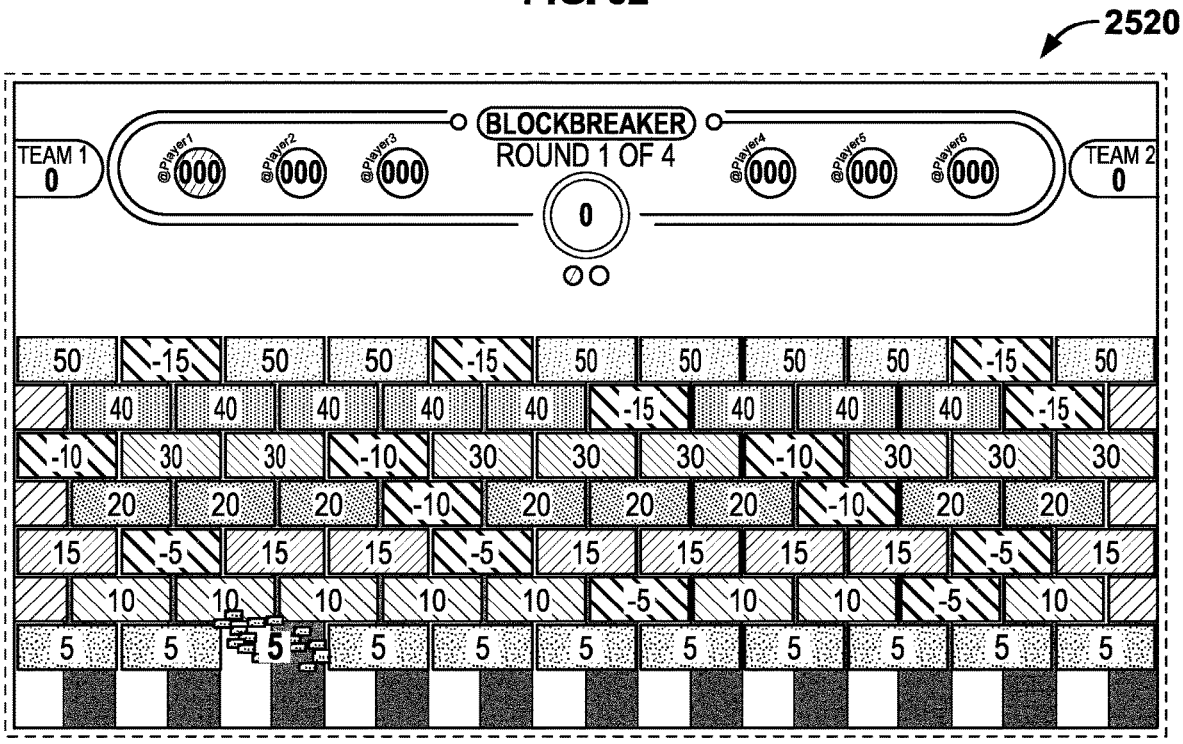
Figure 64:
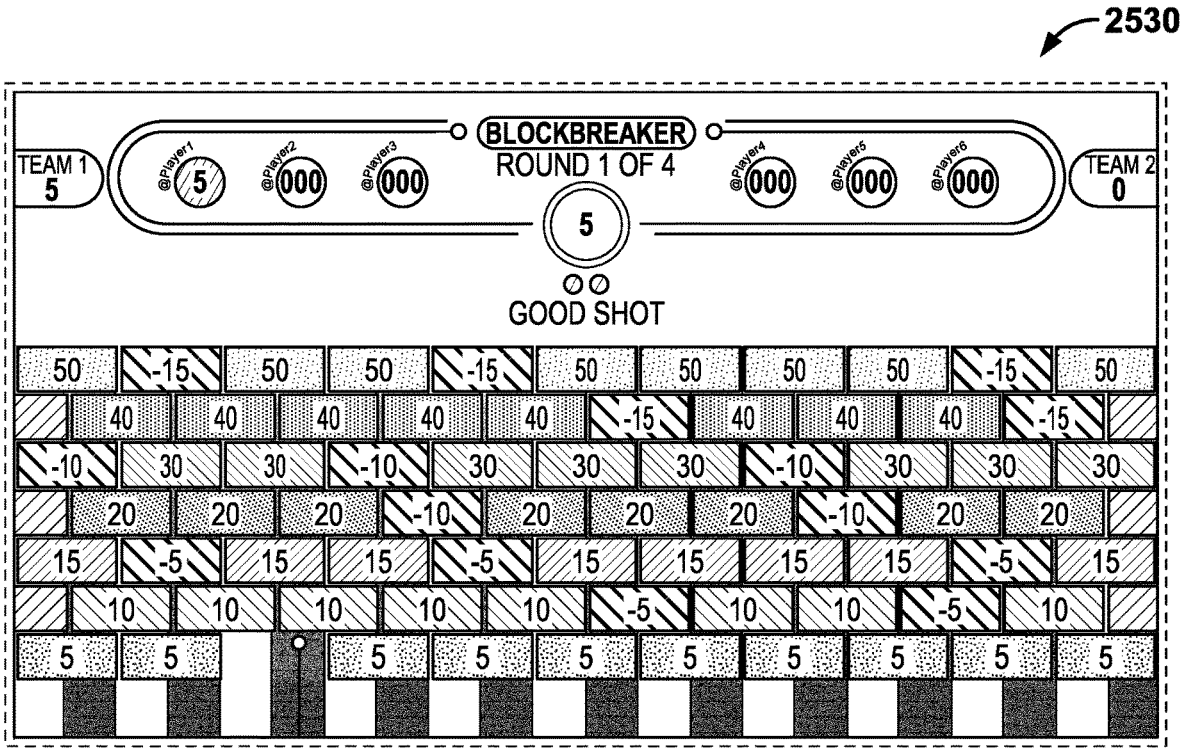
Figure 65:
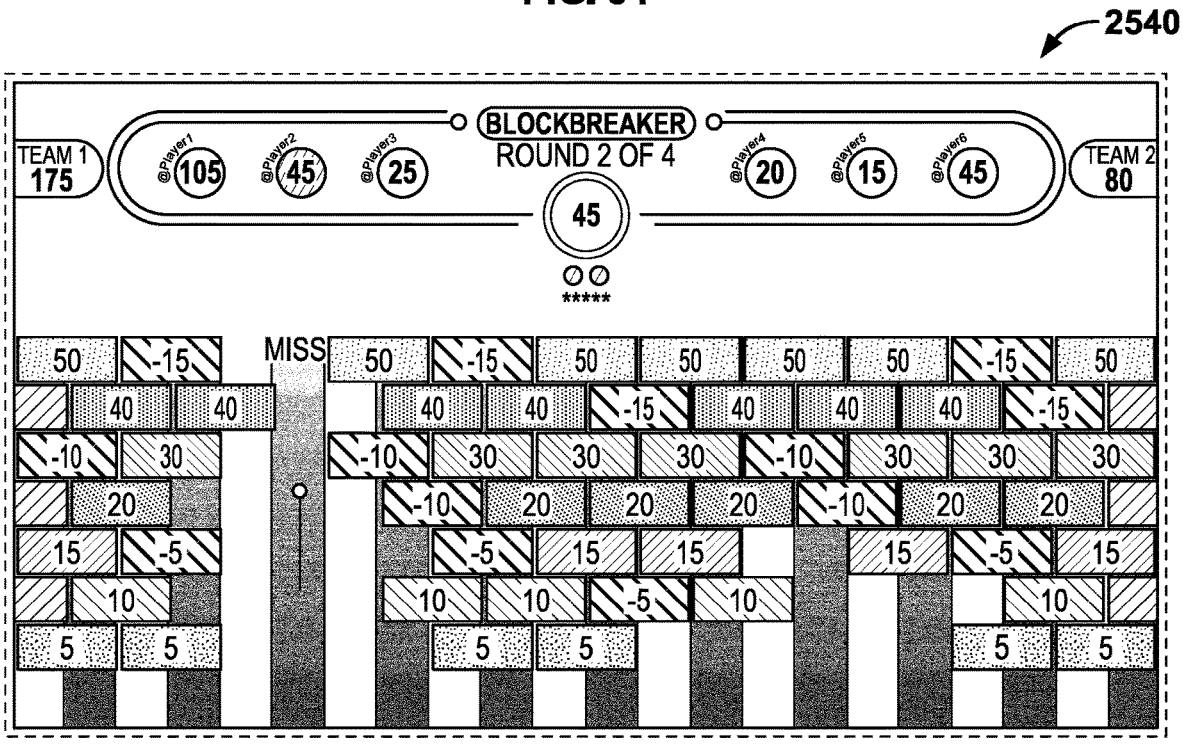
Figure 66:
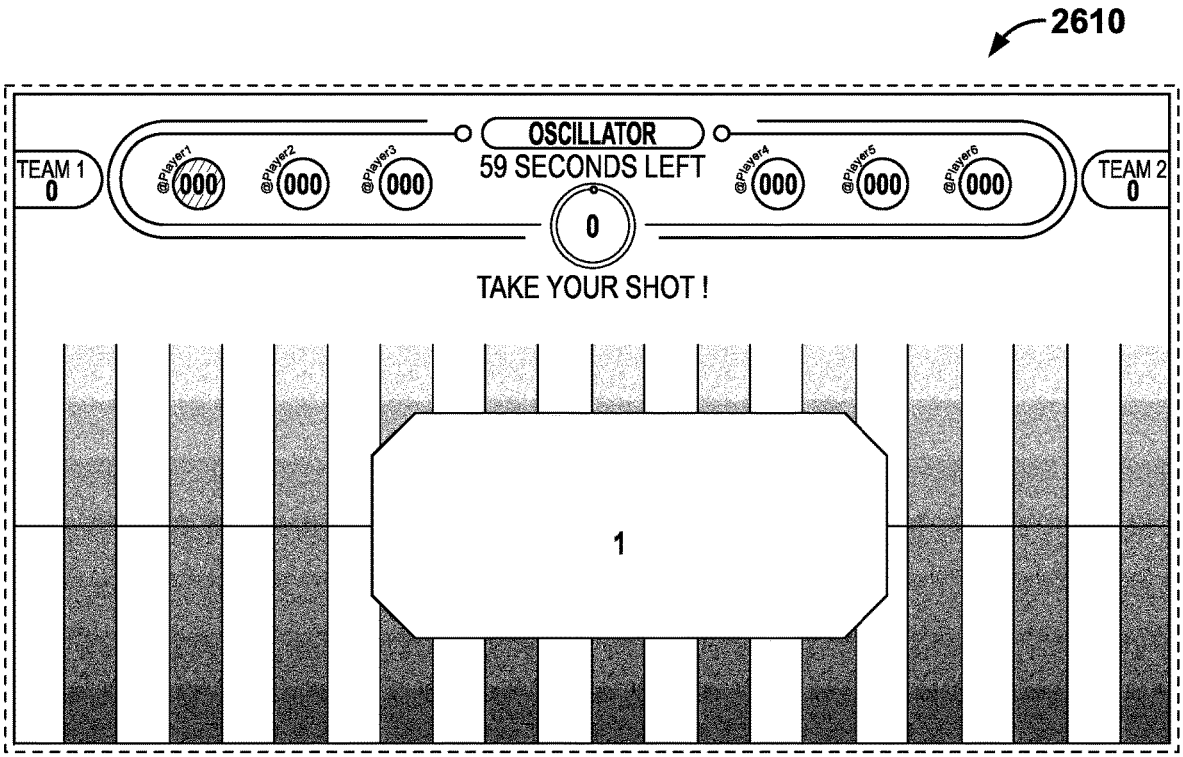
FIGS. 66-69 depict example interfaces presented via a display of the standalone miniature-golf structure of FIG. 1 for the sixth game of FIG. 39.
Figure 67:
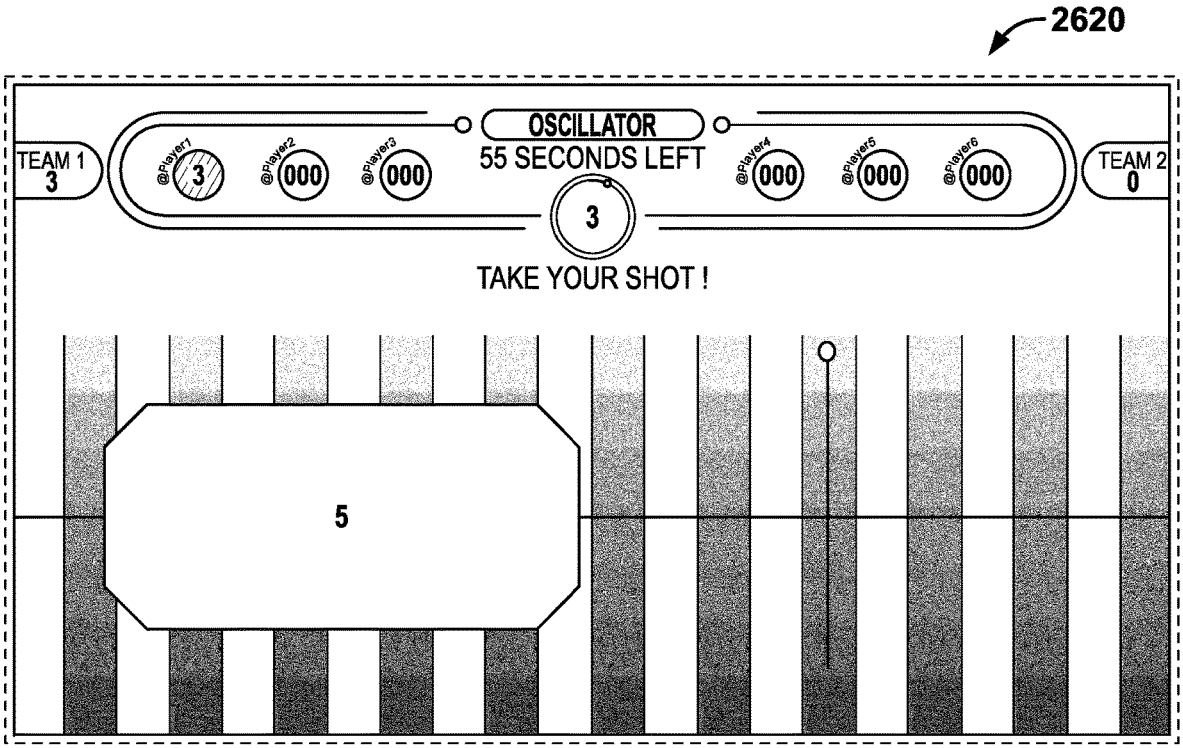
Figure 68:
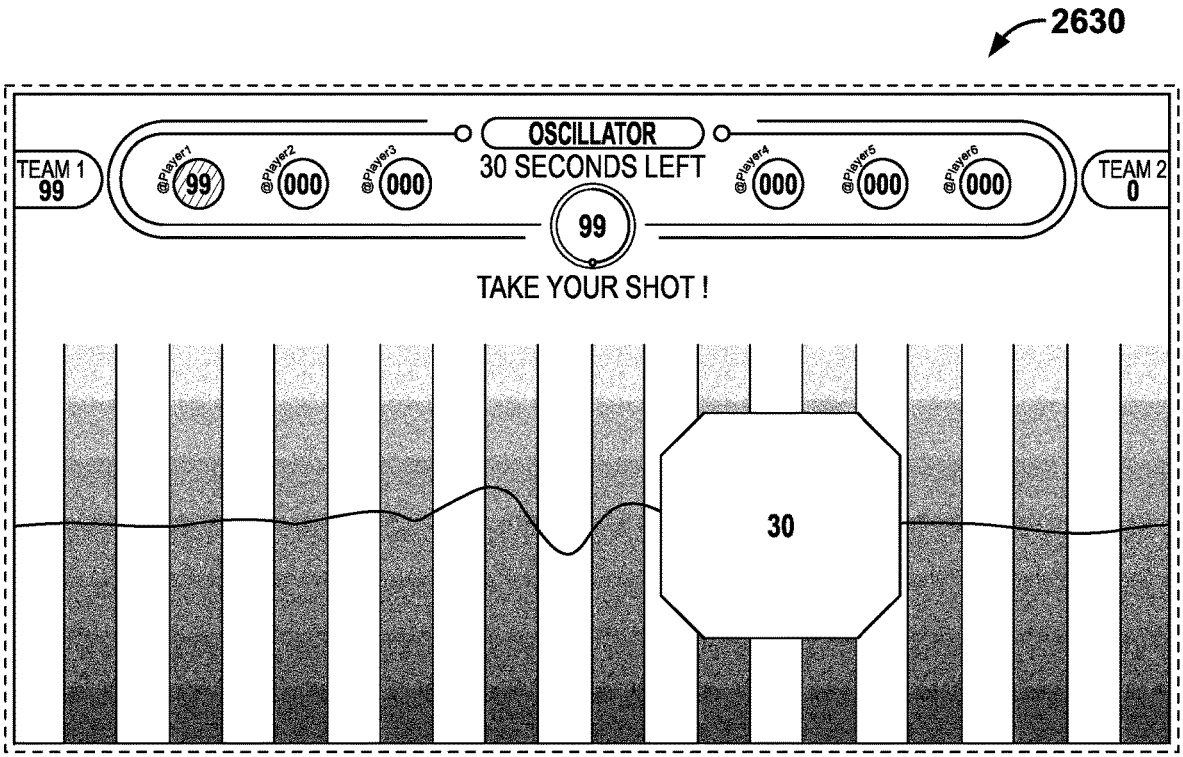
Figure 69:
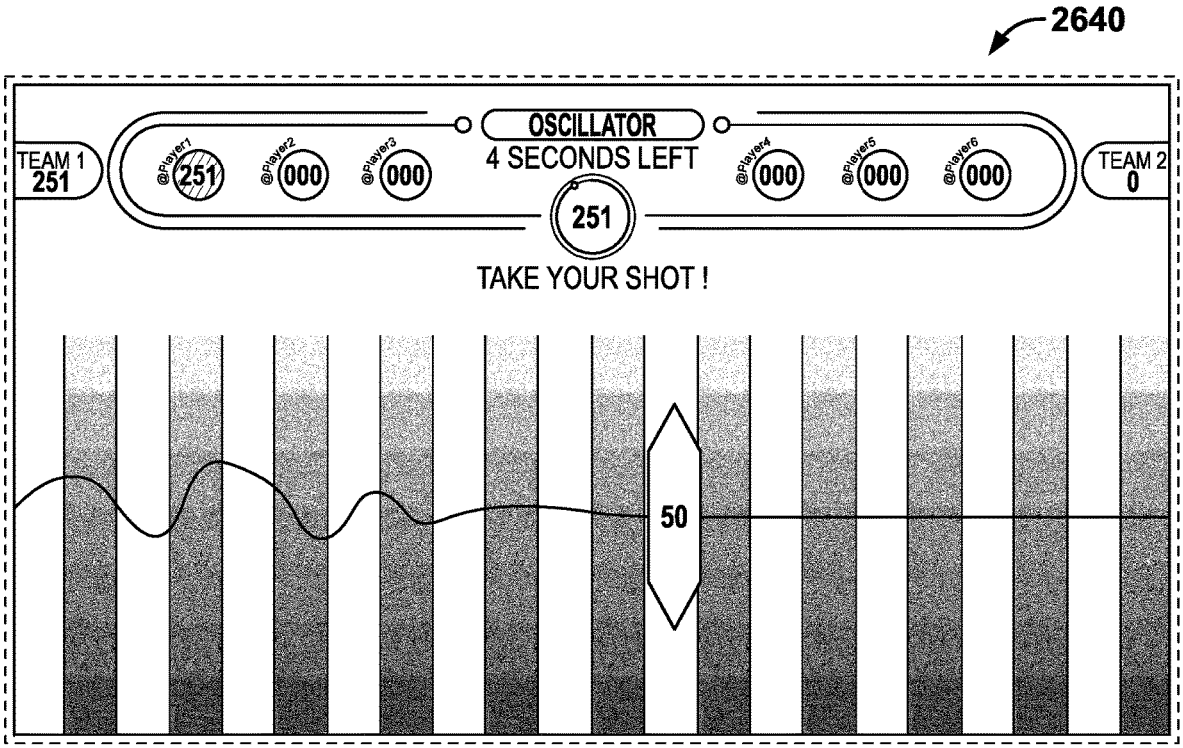

At block 1530, the processor(s) 905 identifies whether the shot of the current player was detected to have hit a target or hazard. In response to the processor(s) 905 determining that the shot of the current player did not hit a target or hazard, the method 1050E proceeds to block 1540. Otherwise, in response to the processor(s) 905 determining that the shot of the current player did hit a target or hazard, the method 1050E proceeds to block 1535 at which the processor(s) remove the hit target or hazard for subsequent shots in the Blockbuster game. For example, as shown in FIGS. 63-64, a 5-point block is removed from the game interface upon being hit by a shot. FIG. 65 depicts the game interface after other hit targets and hazards have been removed.

At block 1540, the processor(s) 905 determine whether there is another shot for the current player in the current round. In response to the processor(s) 905 determining that there is another shot, the method 1050E returns to block 1900 to conduct another shot for the current player. Otherwise, in response to the processor(s) 905 determining that there is not another shot for the current player, the method 1050A proceeds to block 1545.

At block 1545, the processor(s) 905 determine whether there is another player to putt in the current round. In response to the processor(s) 905 determining that there is another player for the current round, the method 1050E returns to block 1525 to select another player for the current round. Otherwise, in response to the processor(s) 905 determining that there is not another player for the current round, the method 1050E proceeds to block 1550.

At block 1550, the processor(s) 905 determine whether there is another round to conduct for the game. In response to the processor(s) 905 determining that there is another round, the method 1050E returns to block 1510 to commence the next round. Otherwise, in response to the processor(s) 905 determining that there is not another round, the method 1050E proceeds to block 1555 at which the processor(s) 905 determine the total scores and/or the winning player(s) and/or team for the game. Additionally, the digital display screen 200 presents the total scores and/or the winning player(s) and/or team. Upon completing block 1555, the method 1050E ends.

FIG. 39 is a flowchart of an example method 1050F for conducting a sixth game (also referred to as "Oscillator" and the "Oscillator game") to perform block 1050 of FIG. 33. The flowchart of FIG. 39 is representative of machine readable instructions that are stored in memory (such as the memory 910 of FIG. 29) and include one or more programs which, when executed by one or more processors (such as the processor(s) 905 of FIG. 29), cause the standalone miniature golf structure 10 to conduct the sixth game for a group of players. While the example program is described with reference to the flowchart illustrated in FIG. 39, many other methods may alternatively be used. For example, the order of execution of the blocks may be rearranged, changed, eliminated, and/or combined to perform the method 1050F. Further, because the method 1050F is disclosed in connection with the components of FIGS. 1-32, some functions of those components will not be described in detail below.

For the sixth game, the goal is to score as many points within a predefined duration of time (e.g., 1 minute). Each player is to putt as many shots as possible during a respective duration of time. That is, the processor(s) enable a player to shoot an unlimited number of shots during a predefined duration of time. When one shot is detected by the processor(s) 905, via the sensor(s), another ball is quickly dispensed by the ball-dispensing assembly 800 to enable the player to quickly take another shot.

As shown in the example interfaces 2610, 2620, 2630, 2640 of FIGS. 66-69, respectively, the game interface presented via the digital display screen 200 includes an target that oscillates laterally across the interface presented via the digital display screen 200. The target oscillates laterally across the interface for the predefined duration of time for the current player. The width of the oscillating target gradually reduces over time and the and the point value of the oscillating target gradually increases over time based on instructions stored in the memory 910. For example, the width decreases and the point value increases as the amount of time remaining in the predefined duration of time decreases. In some examples, the target travels at a constant speed as it oscillates across the interface.

Returning to FIG. 39, the method 1050F commences at block 1605 at which the processor(s) 905 select the next player to play the game. Additionally, the ball-dispensing assembly 800, based on instructions from the processor(s) 905, dispense a golf ball onto the tee surface 110 for the selected player. At block 1610, the processor(s) 905 start a timer for a predefined duration of time (e.g., 60 seconds). The player is permitted to shoot as many shots as possible during the predefined duration of time. At block 1615, the processor(s) 905 identify how much time of the predefined duration of time is remaining.

At block 1620, the processor(s) 905 determine whether there is any remaining time of the timer for the current player. In response to the processor(s) 905 determining that there is time remaining for the current player, the method proceeds to block 1625.

At block 1625, the processor(s) 905 select a width and a point value for the target based on instructions for the game that are stored in the memory 910. For example, the width decreases and the point value increases as the amount of time remaining in the predefined duration of time decreases. Examples of the target width and the point value for various remaining amounts of time are provided below in Table 1.

TABLE 1

| Remaining Time | Target Width (in lanes with an interface of 20 lanes) | Point Value |
|---|---|---|
| 60 | 10 | 1 |
| 55 | 9.1 | 5 |
| 50 | 8.2 | 10 |
| 45 | 7.3 | 15 |
| 40 | 6.4 | 20 |
| 35 | 5.5 | 25 |
| 30 | 4.6 | 30 |
| 25 | 3.7 | 35 |
| 20 | 2.8 | 40 |
| 15 | 1.9 | 45 |
| 10 | 1 | 50 |
| 5 | 1 | 50 |
| 0 | 1 | 50 |

In some examples, the target width decreases continuously until a predefined minimum target width (e.g., 1 lane) is reached and/or the point value of the target increases continuously until a predefined maximum point value (e.g., 50 points) is reached. In the illustrated example, the minimum target width and the maximum point value are reached when there is 10 seconds remaining for the current player. In other examples, the target width decreases and the point value increases at by a predefined amount at predefined intervals (e.g., every 5 seconds until the minimum target width and the maximum point value, respectively, are reached.

At block 1630, the processor(s) 905 generate and the digital display screen 200 presents an interface with an oscillating target. The oscillating target is to continue to oscillate laterally across the interface for the predefined duration of time for the current player. In some examples, the processor(s) 905 cause the oscillating target to travel at a constant predefined speed (e.g., 1.25 lanes per second).

At block 1635, the processor(s) 905 determine whether the player has completed the shot. For example, the processor(s) 905 determine that the player has completed the shot in response to any of the any of the sensors 470, 480, 680 detecting the presence of the golf ball on the sensor assembly 300. In response to the processor(s) 905 determining that the player has not yet completed the shot, the method 1050F returns at block 1615. Otherwise, in response to the processor(s) 905 determining that the player has completed the shot, the method 1050F proceeds to block 1640.

At block 1640, the processor(s) 905 detect the lateral position to which the golf ball was shot by the player. In some examples, the processor(s) 905 detect the lateral position by identifying through which of the ball-detection lanes 450 the golf ball has traveled upon crossing the rear end 125 of the putting surface 120. In examples in which the sensor assembly 300 includes the sensor cartridge 400, the processor(s) 905 determine the lateral position of the shot by (1) identifying which of the sensors 470 detected the presence of the golf ball and (2) subsequently identifying which of the ball-detection lanes 450 correspond with those sensor(s) 470. In examples in which the sensor assembly 300 includes the sensor cartridge 600, the processor(s) 905 determine the lateral position of the shot based on a detected lateral distance between the sensor 680 and the golf ball. Additionally, at block 1640, the ball-dispensing assembly 800, based on instructions from the processor(s) 905, dispense another golf ball onto the tee surface 110 for the next shot of the current player.

At block 1645, the processor(s) 905 determine the location of the oscillating target at the time the shot was detected by the sensor(s). At block 1650, the processor(s) 905 determine whether the shot location corresponds with the oscillating target at the time the shot was detected. For example, the processor(s) 905 determine whether the detected lateral position of the shot matches (e.g., aligns vertically with) the lateral position of the oscillating target at the time the shot was detected.

In response to the processor(s) 905 determining that the lateral position of the shot does not correspond with the lateral position of the oscillating target, the method 1050F returns to block 1615. Otherwise, in response to the processor(s) 905 determining that the lateral position of the shot does correspond with the lateral position of the oscillating target, the method 1050F proceeds to block 1655 at which the processor(s) 905 award points associated with the oscillating target at that time to the user for hitting the oscillating target with the shot.

Returning to block 1620, in response to the processor(s) 905 determining that there is no remaining time for the current player, the method proceeds to block 1660.

At block 1660, the processor(s) 905 determine whether there is another player to putt in the current game. In response to the processor(s) 905 determining that there is another player for the game, the method 1050F returns to block 1605 to select the next player for the game. Otherwise, in response to the processor(s) 905 determining that there is not another player, the method 1050F proceeds to block 1665 at which the processor(s) 905 determine the total scores and/or the winning player(s) and/or team for the game. Additionally, the digital display screen 200 presents the total scores and/or the winning player(s) and/or team. Upon completing block 1665, the method 1050E ends.

Figure 40:
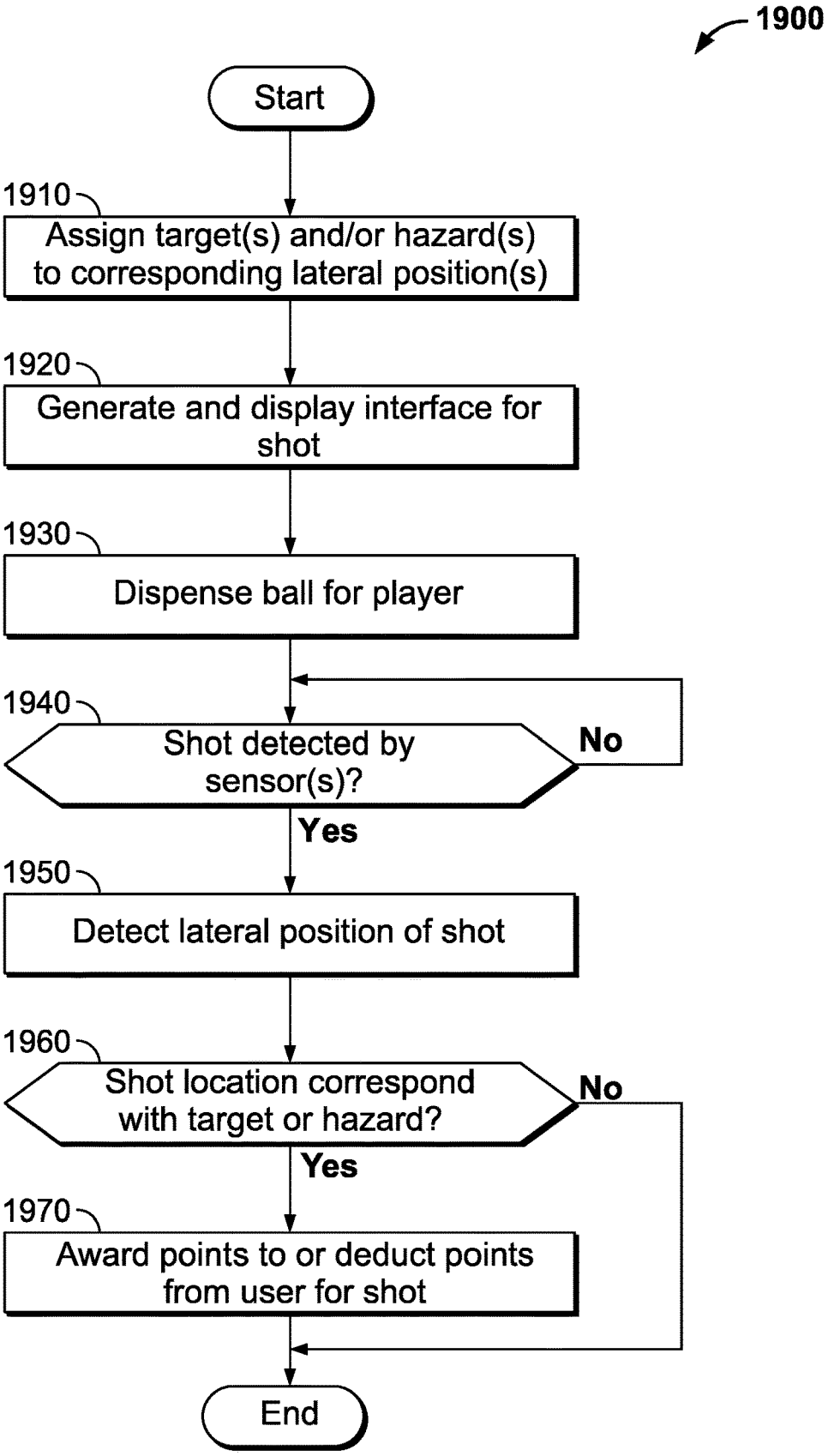
FIG. 40 is a flowchart of an example method of the standalone miniature-golf structure of FIG. 1 detecting and scoring a shot of a player.

FIG. 40 is a flowchart of an example method 1900 for detecting and scoring a shot of a player during a game to perform block 1900 of FIGS. 34-39. The flowchart of FIG. 40 is representative of machine readable instructions that are stored in memory (such as the memory 910 of FIG. 29) and include one or more programs which, when executed by one or more processors (such as the processor(s) 905 of FIG. 29), cause the standalone miniature golf structure 10 to detect and score a shot of a player on the standalone miniature golf structure 10. While the example program is described with reference to the flowchart illustrated in FIG. 40, many other methods may alternatively be used. For example, the order of execution of the blocks may be rearranged, changed, eliminated, and/or combined to perform the method 1900. Further, because the method 1900 is disclosed in connection with the components of FIGS. 1-32, some functions of those components will not be described in detail below.

At block 1910, the processor(s) 905 assign the lateral position for the interface of the digital display screen 200 for each of the selected putting target(s) and/or hazard(s) for the current shot. Additionally, the processor(s) 905 assign the width and the point value for the interface of the digital display screen 200 for each of the selected putting target(s) and/or hazard(s). In examples in which the sensor assembly 300 includes the ball-detection lanes 450 and the interface of the digital display screen 200 includes the digital lanes 2010, the processor(s) 905 assign the lateral position for each putting target and/or hazard of the current shot by assigning each putting target and/or hazard to one or more of the digital lanes 2010 and the respective ball-detection lanes 450. For example, the processor(s) 905 may assign a putting target to one or more contiguous digital lanes 2010 and the corresponding one or more ball-detection lanes 450 that vertically align with the contiguous digital lanes 2010.

At block 1920, the processor(s) 905 generate and the digital display screen 200 presents an interface for the shot. The interface indicates the location, width, and point value for each of the putting target(s) and/or hazard(s) selected for the shot.

At block 1930, the ball-dispensing assembly 800 dispenses a golf ball onto the tee surface 110 for the player. The processor(s) 905 control operation of the ball-dispensing assembly 800. In some examples, the processor(s) 905 instruct the ball-dispensing assembly 800 to release another golf ball onto the tee surface 110 at a predetermined time after a sensor 480, 680 has detected that a golf ball for the preceding shot has crossed the front edge 436, 636 of the sensor cartridge 400, 600 and rolled onto the ball-return surface 150. The memory 910 stores a respective predetermined time for each game playable on the standalone miniature golf structure 10. In some examples, the predetermined time is relatively short for games that are intended to be quickly. In other examples, the predetermined time is relatively long for games that can be played at a slower pace.

At block 1940, the processor(s) 905 determine whether the player has completed the shot. For example, processor(s) determine that the player has completed the shot in response to any of the any of the sensors 470, 480, 680 detecting the presence of the golf ball on the sensor assembly 300. In response to the processor(s) 905 determining that the player has not yet completed the shot, the method 1900 remains at block 1940. Otherwise, in response to the processor(s) 905 determining that the player has completed the shot, the method 1900 proceeds to block 1950.

At block 1950, the processor(s) 905 detect the lateral position to which the golf ball was shot by the player. In some examples, the processor(s) 905 detect the lateral position by identifying through which of the ball-detection lanes 450 the golf ball has traveled upon crossing the rear end 125 of the putting surface 120. In examples in which the sensor assembly 300 includes the sensor cartridge 400, the processor(s) 905 determine the lateral position of the shot by (1) identifying which of the sensors 470 detected the presence of the golf ball and (2) subsequently identifying which of the ball-detection lanes 450 correspond with those sensor(s) 470. In examples in which the sensor assembly 300 includes the sensor cartridge 600, the processor(s) 905 determine the lateral position of the shot based on a detected lateral distance between the sensor 680 and the golf ball.

At block 1960, the processor(s) 905 determine whether the shot location corresponds with any of the putting target(s) and/or hazard(s) presented by the digital display screen 200 for the shot. For example, the processor(s) 905 determine whether the detected lateral position of the shot matches (e.g., aligns vertically with) the assigned lateral position of any target and/or hazard. The processor(s) 905 determine that the shot location does not correspond with any putting target and/or hazard if the player shot misses each of the putting target(s) and/or hazard(s). In response to the processor(s) 905 determining that the lateral position of the shot does not correspond with the lateral position of any putting target and/or hazard, the method 1900 ends. Otherwise, in response to the processor(s) 905 determining that the lateral position of the shot does correspond with the lateral position of a putting target or a hazard, the method 1900 proceeds to block 1970.

At block 1970, the processor(s) 905 award points to or deduct points from the user for the shot. For example, in response to the processor(s) 905 determining that the player's shot corresponds with a putting target, the processor(s) 905 award the point value associated with that putting target to the player. In response the processor(s) 905 determining that the player's shot corresponds with a hazard, the processor(s) 905 deducts the point value associated with that putting hazard from the total points of the player. The method 1900 ends upon completing block 1970.

In some examples, the game (e.g., the Sitting Duck game, the Blockbreaker game, etc.) includes multiple rows of targets that stacked on top on the game interface. In such instances, the shot location of the player may align with multiple targets and/or hazards that each align vertically with each other when the shot of the player is detected by the sensor(s). For example, the shot location may align with a first target of a first row, a second target of a second row, a third target of a third row, etc. In such examples, the processor(s) 905 the target and/or hazard of the lowest-positioned row, as presented on the game interface, as the target and/or hazard that is "hit" by the shot of the player. In turn, the processor(s) 905 awards or deducts the point value of the lowest-positioned target or hazard, respectively, that aligns with the lateral position of the shot to or deducts the corresponding point value to or from the player.

Exemplary embodiments in accordance with the teachings herein are disclosed below.

Embodiment 1. A standalone miniature golf structure includes a putting surface including a front end and a rear end. The standalone miniature golf structure includes one or more sensors configured to detect lateral positions at which balls cross across the rear end. The standalone miniature golf structure includes a digital display screen positioned above the one or more sensors and adjacent to the rear end to align vertically with the rear end of the putting surface, memory to store instructions for a plurality of miniature golf games, and one or more processors. For each shot of the plurality of miniature golf games, the one or more processors are configured to send command signals to the digital display screen to display one or more putting targets based on the instructions stored in the memory; identify, via the one or more sensors, a lateral position at which a golf ball crosses the rear end of the putting surface; determine whether the lateral position of the golf ball aligns vertically with any of the one or more putting targets; and generate a score for the shot based on the lateral position of the golf ball relative to the one or more putting targets.

Embodiment 2. The standalone miniature golf structure of embodiment 1, wherein the instructions stored by the memory enable any of the plurality of miniature golf games to be played by a range of number of players and for a plurality of gameplays.

Embodiment 3. The standalone miniature golf structure of embodiment 2, wherein the plurality of gameplays includes an individual gameplay and a team gameplay.

Embodiment 4. The standalone miniature golf structure of embodiment 1, further including a check-in station with a user interface configured to receive a user selection of one or more of the miniature golf games, a gameplay, and a number of players.

Embodiment 5. The standalone miniature golf structure of any of embodiments 1-4, wherein the one or more processors are configured to change the one or more putting targets for each shot of the plurality of miniature golf games.

Embodiment 6. The standalone miniature golf structure of any of embodiments 1-5, wherein the one or more processors are configured to randomly select a lateral position, a width, and a point value of each of the one or more putting targets for each shot of the plurality of miniature golf games.

Embodiment 7. The standalone miniature golf structure of any of embodiments 1-6, wherein the one or more processors are configured to present one or more hazards with the one or more putting target for one or more shots of the plurality of miniature golf games.

Embodiment 8. The standalone miniature golf structure of any of embodiments 1-7, further including a sensor assembly that includes the one or more sensors. The sensor assembly is positioned adjacent to the rear end of the putting surface.

Embodiment 9. The standalone miniature golf structure of any of embodiments 1-8, further including a tee surface adjacent to the front end of the putting surface and a ball-dispensing assembly configured to return the golf ball to the tee surface for a subsequent shot.

Embodiment 10. The standalone miniature golf structure of embodiment 9, further including a ball-return surface extending between the one or more sensors and the ball-dispensing assembly to direct the golf ball that has been putted by a player to the ball-dispensing assembly.

Embodiment 11. The standalone miniature golf structure of embodiments 9 or 10, wherein the one or more processors are configured to instruct the ball-dispensing assembly to release another golf ball onto the tee surface at a predetermined time after the one or more sensors detect that the golf ball has rolled onto the ball-return surface.

Embodiment 12. An standalone miniature golf structure includes a putting surface including a front end and a rear end, a plurality of ball-detection lanes that are adjacent and extend perpendicular to the rear end of the putting surface, one or more sensors configured to detect into which of the plurality of ball-detection lanes that golf balls are shot, a digital display screen positioned adjacent to and above the rear end to align vertically with the plurality of ball-detection lanes, memory to store instructions for a plurality of miniature golf games, and one or more processors. For each shot of the plurality of miniature golf games, the one or more processors are configured to send command signals to the digital display screen to display one or more putting targets based on the instructions stored in the memory; identify, via the one or more sensors, a putted lane of the plurality of ball-detection lanes into which a golf ball has been shot; determine whether the putted lane aligns vertically with any of the one or more putting targets; and generate a score for the shot based on a position of the putted lane relative to the one or more putting targets.

Embodiment 13. The standalone miniature golf structure of embodiment 12, wherein the instructions stored by the memory enable any of the plurality of miniature golf games to be played by a range of number of players and for a plurality of gameplays.

Embodiment 14. The standalone miniature golf structure of embodiment 13, wherein the plurality of gameplays includes an individual gameplay and a team gameplay.

Embodiment 15. The standalone miniature golf structure of embodiment 12, further including a check-in station with a user interface configured to receive a user selection of one or more of the miniature golf games, a gameplay, and a number of players.

Embodiment 16. The standalone miniature golf structure of any of embodiments 12-15, wherein the one or more processors are configured to change the one or more putting targets for each shot of the plurality of miniature golf games.

Embodiment 17. The standalone miniature golf structure of any of embodiments 12-16, wherein the one or more processors are configured to randomly select a lateral position, a width, and a point value of each of the one or more putting targets for each shot of the plurality of miniature golf games.

Embodiment 18. The standalone miniature golf structure of any of embodiments 12-17, wherein the one or more processors are configured to present one or more hazards with the one or more putting target for one or more shots of the plurality of miniature golf games.

Embodiment 19. The standalone miniature golf structure of any of embodiments 12-18, wherein the digital display screen is configured to display a plurality of digital lanes each of which aligns vertically with a respective one of the plurality of ball-detection lanes to facilitate a player in putting the golf ball in a direction toward the one or more putting targets.

Embodiment 20. The standalone miniature golf structure of any of embodiments 12-19, further including a sensor assembly that includes the plurality of ball-detection lanes and the one or more sensors.

Embodiment 21. The standalone miniature golf structure of any of embodiments 12-20, further including a tee surface adjacent to the front end of the putting surface and a ball-dispensing assembly configured to return the golf ball to the tee surface for a subsequent shot.

Embodiment 22. The standalone miniature golf structure of embodiment 21, further including a ball-return surface extending between the one or more sensors and the ball-dispensing assembly to direct the golf ball that has been putted by a player to the ball-dispensing assembly.

Embodiment 23. The standalone miniature golf structure of embodiments 21 or 22, wherein the one or more processors are configured to instruct the ball-dispensing assembly to release another golf ball onto the tee surface at a predefined duration after the one or more sensors detect the golf ball entering one of the plurality of ball-detection lanes.

Embodiment 24. A putting structure includes a putting surface including a front end and a rear end. The putting structure includes a tee surface adjacent to the front end of the putting surface, a ball-return surface located underneath the putting surface, and a sensor assembly adjacent to the rear end of the putting surface. The sensor assembly includes a sensor cartridge with one or more sensors configured to detect a lateral position at which a golf ball crosses the rear end. The sensor assembly is configured to direct the golf ball from the rear end of the putting surface and to the ball-return surface to return the golf ball back to the tee surface for a subsequent putt.

Embodiment 25. The putting structure of embodiment 24, wherein the sensor cartridge defines an upper surface along which the golf ball is to travel between the putting surface and the ball-return surface.

Embodiment 26. The putting structure of embodiments 24 or 25, wherein the sensor cartridge defines a front edge of the upper surface that is positioned adjacent to the ball-return surface. The upper surface is sloped downward toward the front edge to guide the golf ball to the ball-return surface.

Embodiment 27. The putting structure of embodiment 26, wherein the sensor cartridge further includes one or more second sensors configured to detect when the golf ball crosses the front edge of the sensor cartridge.

Embodiment 28. The putting structure of any of embodiments 24-27, wherein the one or more sensors include a plurality of fork sensors. Each of the plurality of fork sensors is configured to monitor for the golf ball traversing a corresponding predefined lateral position along the rear end of the putting surface.

Embodiment 29. The putting structure of any of embodiments 24-27, wherein the one or more sensors include a lidar sensor configured to detect the lateral position at which the golf ball crosses the rear end of the putting surface.

Embodiment 30. The putting structure of any of embodiments 24-29, wherein the sensor assembly further includes a deflector tray that is positioned above the sensor cartridge.

Embodiment 31. The putting structure of embodiment 30, wherein the deflector tray includes a plurality of deflectors configured to define a plurality of ball-detection lanes that are adjacent and extend perpendicular to the rear end of the putting surface. The plurality of lanes are arranged such that the golf ball is to travel through one of the plurality of lanes to facilitate detection of the lateral position at which the golf ball is putt.

Embodiment 32. The putting structure of embodiments 30 or 31, wherein the sensor assembly further a lighting housing positioned behind the deflector tray.

Embodiment 33. The putting structure of embodiment 32, wherein the lighting housing includes a plurality of lights arranged in a side-by-side manner. Each of the plurality of lights is configured to illuminate a corresponding portion along the rear end of the putting surface associated with at least one of a putting target or the lateral position at which the golf ball is putt.

Embodiment 34. A sensor cartridge for a putting structure includes a body including a top panel that defines an upper surface along which a golf ball is to travel. The upper surface includes a rear edge and a front edge. The sensor cartridge includes a plurality of walls protruding upwardly from the upper surface of the body. The plurality of walls extend between the rear edge and the front edge of the upper surface. The plurality of walls are parallel to and spaced apart from each other to define a plurality of ball-detection lanes for the golf ball that extend perpendicular to the front edge of the upper surface. The sensor cartridge includes a plurality of sensors each of which corresponds with a corresponding ball-detection lane of the plurality of ball-detection lanes. Each of the plurality of sensors is configured to detect when the golf ball travels through the corresponding ball-detection lane.

Embodiment 35. The sensor cartridge of embodiment 34, wherein each of the plurality of ball-detection lanes includes an outlet adjacent to the front edge of the upper surface.

Embodiment 36. The sensor cartridge of embodiment 35, wherein the upper surface is angled downward from the rear edge and to the front edge to guide the golf ball through the outlet of a corresponding one of the plurality of ball-detection lanes.

Embodiment 37. The sensor cartridge of any of embodiments 34-36, wherein the plurality of sensors are arranged such that each of the plurality of ball-detection lanes is monitored by two respective sensors of the plurality of sensors.

Embodiment 38. The sensor cartridge of embodiment 37, wherein the two respective sensors of one of the plurality of ball-detection lanes are staggered relative to the two respective sensors of an adjacent one of the plurality of ball-detection lanes.

Embodiment 39. The sensor cartridge of any of embodiments 34-38, wherein the plurality of sensors includes a plurality of fork sensors each of which includes two prongs.

Embodiment 40. The sensor cartridge of embodiment 39, wherein each of the plurality of walls defines an opening into which one of the two prongs of a corresponding one of the plurality of fork sensors extends to enable the corresponding one of the plurality of fork sensors to monitor an adjacent one of the plurality of ball-detection lanes.

Embodiment 41. The sensor cartridge of embodiments 39 or 40, wherein each of the plurality of fork sensors includes a sensor body that is positioned below the top panel.

Embodiment 42. The sensor cartridge of any of embodiments 34-41, further including one or more second sensors configured to detect when the golf ball crosses the front edge of the upper surface.

Embodiment 43. The sensor cartridge of any of embodiments 34-42, wherein the body includes a first body and a second body that are configured to couple together in a side-by-side manner.

Embodiment 44. The sensor cartridge of embodiment 43, further including a latch configured to enable an operator to selectively couple and decouple the first body and the second body.

Embodiment 45. The sensor cartridge of any of embodiments 34-44, further including a bottom panel that defines one or more grooves each of which is configured to receive a portion of a corresponding roller conveyor to facilitate installation in and removal from a cartridge chamber.

Embodiment 46. A sensor cartridge for a putting structure includes a body including a top panel that defines an upper surface along which a golf ball is to travel. The upper surface includes a rear edge, a front edge, and two opposing ends. Each of the rear edge and the front edge extends between the two opposing ends. The sensor cartridge includes a sensor positioned adjacent to one of the two opposing ends and configured to detect a lateral position of the golf ball travelling along the upper surface toward the front edge.

Embodiment 47. The sensor cartridge of embodiment 46, wherein the upper surface is angled downward from the rear edge and to the front edge to guide the golf ball toward the front edge.

Embodiment 48. The sensor cartridge of embodiments 46 or 47, wherein the sensor includes a lidar sensor.

Embodiment 49. The sensor cartridge of any of embodiments 46-48, further including one or more second sensors configured to detect when the golf ball crosses the front edge of the upper surface.

Embodiment 50. The sensor cartridge of any of embodiments 46-49, wherein the body includes a first body and a second body that are configured to couple together in a side-by-side manner.

Embodiment 51. The sensor cartridge of embodiment 50, further including a latch configured to enable an operator to selectively couple and decouple the first body and the second body.

Embodiment 52. The sensor cartridge of any of embodiments 46-51, further including a bottom panel that defines one or more grooves each of which is configured to receive a portion of a corresponding roller conveyor to facilitate an installation in and removal from a cartridge chamber.

Embodiment 53. A putting structure includes a putting surface including a front end and a rear end. The putting structure includes a tee surface adjacent to the front end of the putting surface, a ball-return surface located underneath the putting surface, a body defining a cartridge chamber that is located adjacent to the rear end of the putting surface and the ball-return surface, and a sensor cartridge configured to be securely housed in and removeable from the cartridge chamber. The sensor cartridge includes one or more sensors configured to detect a lateral position at which a golf ball crosses the rear end of the putting surface. The sensor cartridge is configured to direct the golf ball from the rear end and to the ball-return surface to return the golf ball back to the tee surface for a subsequent putt.

Embodiment 54. The putting structure of embodiment 53, further including one or more access panels configured to be removed from the body to access the cartridge chamber.

Embodiment 55. The putting structure of embodiment 54, wherein the one or more access panels include access panels that are located on opposite ends of the cartridge chamber.

Embodiment 56. The putting structure of any of embodiments 53-55, wherein the body includes a floor of the cartridge chamber.

Embodiment 57. The putting structure of embodiment 56, further including one or more roller conveyors along the floor of the cartridge chamber. The one or more roller conveyors are configured to facilitate the sensor cartridge in sliding in and out of the cartridge chamber.

Embodiment 58. The putting structure of embodiment 57, wherein the sensor cartridge includes a bottom panel that defines one or more grooves each of which is configured to receive a portion of a corresponding one of the one or more roller conveyors to guide the sensor cartridge in being installed into or removed from the cartridge chamber.

Embodiment 59. The putting structure of any of embodiments 53-57 further including one or more stopper blocks. When the sensor cartridge is in the cartridge chamber, the one or more stopper blocks are configured to engage an end of the sensor cartridge and be secured in place to securely position the sensor cartridge in place.

Embodiment 60. The putting structure of any of embodiments 53-59, wherein the sensor cartridge includes a first body and a second body that are configured to couple together in a side-by-side manner.

Embodiment 61. The putting structure of embodiment 60, further including a latch configured to enable an operator to selectively couple and decouple the first body and the second body.

Embodiment 62. The putting structure of embodiment 61, wherein the latch is configured to enable the first body and the second body to be together when in the cartridge chamber. The latch is configured to enable the first body and the second body to be decoupled from each other as the sensor cartridge is being removed the cartridge chamber.

Embodiment 63. A ball-dispensing assembly for a putting structure includes a track along which golf balls are configured to roll. The track extends between an inlet and an outlet. The inlet is downstream of a putting surface of the putting structure. The outlet is positioned to dispense the golf balls onto a tee surface. The ball-dispensing assembly includes a frame adjacent to at least a portion of the track and an actuator including an actuator body and an actuator arm. The actuator body is mounted to the frame. The actuator arm is configured to transition between an extended position and a retracted position. The ball-dispensing assembly includes a pivot arm operatively connected to the actuator arm and configured to transition between a closed position and an open position. The pivot arm is configured to be in the closed position when the actuator arm is in the extended position to block the golf balls from being dispensed. The pivot arm is configured to be in the open position when the actuator arm is in the retracted position to permit the golf balls to be dispensed.

Embodiment 64. The ball-dispensing assembly of embodiment 63, wherein the track includes two rails that extend parallel to each other.

Embodiment 65. The ball-dispensing assembly of embodiments 63 or 64, wherein the track is configured to retain one or more of the golf balls when the pivot arm is in the closed position.

Embodiment 66. The ball-dispensing assembly of any of embodiments 63-65, when the pivot arm is pivotably coupled to the frame.

Embodiment 67. The ball-dispensing assembly of any of embodiments 63-66, wherein the pivot arm includes a proximal end that is hingedly coupled to the actuator arm such that the pivot arm is to pivot as the actuator arm transitions between the extended position and the retracted position.

Embodiment 68. The ball-dispensing assembly of any of embodiments 63-67, wherein the pivot arm includes a distal end that is configured to engage one of the golf balls in the closed position and be disengaged from the golf balls in the open position.

Embodiment 69. The ball-dispensing assembly of embodiment 68, wherein the distal end is configured to rotate downward as the pivot arm transitions to the closed position and rotate upward as the pivot arm transitions to the open position.

Embodiment 70. The ball-dispensing assembly of any of embodiments 63-69, further including a first sensor configured to detect when the ball-dispensing assembly has received one of the golf balls.

Embodiment 71. The ball-dispensing assembly of embodiment 70, wherein the first sensor is a fork sensors positioned adjacent to the inlet.

Embodiment 72. The ball-dispensing assembly of any of embodiments 63-71, further including a second sensor configured to detect when the ball-dispensing assembly has dispensed one of the golf balls.

Embodiment 73. The ball-dispensing assembly of embodiment 72, wherein the second sensor is a fork sensors positioned adjacent to the outlet.

Embodiment 74. The ball-dispensing assembly of any of embodiments 63-73, further including a ramp that extends from the outlet to the tee surface to deliver one or more of the golf balls onto the tee surface when the pivot arm is in the open position.

Embodiment 75. A standalone miniature golf structure includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. For each shot of the miniature golf game, the one or more processors are configured to select a primary target based on the instructions stored in the memory; generate an interface to include the primary target; send command signals to the digital display screen to display the interface; identify, via the one or more sensors, a lateral position at which a golf ball crosses the rear end of the putting surface; and award a first point value associated with the primary target to a corresponding player in response to determining that the lateral position of the golf ball aligns vertically with the primary target.

Embodiment 76. The standalone miniature golf structure of embodiment 75, wherein the one or more processors are configured to change a location of the primary target for each shot of the player.

Embodiment 77. The standalone miniature golf structure of embodiments 75 or 76, wherein, for each shot, the one or more processors are configured to randomly select a position, a width, and the first point value for the primary target.

Embodiment 78. The standalone miniature golf structure of any of embodiments 75-77, wherein, for each shot, the one or more processors are configured to determine whether to include secondary targets based on the instructions, select the secondary targets based on the instructions in response to determining to include the secondary targets, generate the interface to further include the secondary targets, and award a second point value associated with the secondary targets to the corresponding player in response to determining that the lateral position of the golf ball aligns vertically with one of the secondary targets.

Embodiment 79. The standalone miniature golf structure of embodiment 78, wherein the secondary targets are contiguous with the primary target.

Embodiment 80. The standalone miniature golf structure of embodiments 78 or 79, wherein, for each shot, the one or more processors are configured to determine whether to include hazards based on the instructions, select the hazards based on the instructions in response to determining to include the hazards, generate the interface to further include the secondary targets, and award a third point value associated with the hazards to the corresponding player in response to determining that the lateral position of the golf ball aligns vertically with one of the hazards.

Embodiment 81. The standalone miniature golf structure of embodiment 80, wherein the hazards are contiguous with the secondary targets and the primary target.

Embodiment 82. The standalone miniature golf structure of any of embodiments 75-81, wherein, based on the instructions stored in the memory, the one or more processors are configured to conduct a plurality of rounds for the miniature golf game and conduct a plurality of shots in each of the plurality of rounds.

Embodiment 83. The standalone miniature golf structure of any of embodiments 75-82, wherein, based on the instructions stored in the memory, the one or more processors are configured to increase a difficulty for the player throughout the miniature golf game by at least one of changing target locations, narrowing target widths, or introducing hazards for each subsequent shot for the player.

Embodiment 84. The standalone miniature golf structure of any of embodiments 75-83, wherein, based on the instructions stored in the memory, the miniature golf game includes an individual gameplay and a team gameplay.

Embodiment 85. The standalone miniature golf structure of any of embodiments 75-84, wherein the one or more sensors are positioned adjacent to the rear end of the putting surface.

Embodiment 86. The standalone miniature golf structure of any of embodiments 75-85, further including a sensor assembly that defines a plurality of ball-detection lanes. The digital display screen is configured to display a plurality of digital lanes each of which aligns vertically with a respective one of the plurality of ball-detection lanes.

Embodiment 87. A standalone miniature golf structure includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. For each shot of the miniature golf game, the one or more processors are configured to generate an interface with a target based on the instructions stored in the memory; send command signals to the digital display screen to display the interface; identify, via the one or more sensors, a lateral position at which a golf ball crosses the rear end of the putting surface; in response to determining that the lateral position of the golf ball aligns vertically with the target, award a predefined point value associated with the target; and in response to determining that the lateral position of the golf ball does not align vertically with the target, reduce a number of remaining chances for a corresponding player by one.

Embodiment 88. The standalone miniature golf structure of embodiment 87, wherein the one or more processors are configured to assign a predefined number of chances to each player at a start of the miniature golf game.

Embodiment 89. The standalone miniature golf structure of embodiments 87 or 88, wherein the one or more processors are configured to conduct up to a maximum number of rounds based on the instructions stored in the memory.

Embodiment 90. The standalone miniature golf structure of embodiment 89, wherein the one or more processors are configured to award a bonus point value to each player that has at least one remaining chance upon completion of the maximum number of rounds.

Embodiment 91. The standalone miniature golf structure of any of embodiments 87-90, wherein, for each round of the miniature golf game, the one or more processors are configured to conduct the shot for each remaining player.

Embodiment 92. The standalone miniature golf structure of any of embodiments 87-91, wherein the one or more processors are configured to vary a target position of the target for each round of the miniature golf game.

Embodiment 93. The standalone miniature golf structure of any of embodiments 87-92, wherein the one or more processors are configured to reduce a target position of the target for each subsequent round of the miniature golf game.

Embodiment 94. The standalone miniature golf structure of any of embodiments 87-92, wherein the one or more processors are configured to eliminate a player in response to determining that the player has no remaining chances.

Embodiment 95. The standalone miniature golf structure of any of embodiments 87-94, wherein, based on the instructions stored in the memory, the miniature golf game includes an individual gameplay and a team gameplay.

Embodiment 96. The standalone miniature golf structure of any of embodiments 87-95, wherein the one or more sensors are positioned adjacent to the rear end of the putting surface.

Embodiment 97. The standalone miniature golf structure of any of embodiments 87-96, further including a sensor assembly that defines a plurality of ball-detection lanes. The digital display screen is configured to display a plurality of digital lanes each of which aligns vertically with a respective one of the plurality of ball-detection lanes.

Embodiment 98. A standalone miniature golf structure includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. The one or more processors are configured to generate, based on the instructions stored in the memory, an interface with a plurality of targets and a vertical center line of the plurality of targets; send command signals to the digital display screen to display the interface; identify, via the one or more sensors, a lateral position at which a golf ball crosses the rear end of the putting surface; and in response to determining that the lateral position of the golf ball aligns vertically with any of the plurality of targets, move the center line and the plurality of targets laterally on the interface.

Embodiment 99. The standalone miniature golf structure of embodiment 98, wherein the plurality of targets include one or more left-sided targets to the left of the center line and one or more right-sided targets to the right of the center line.

Embodiment 100. The standalone miniature golf structure of embodiment 99, wherein the one more processors are configured to move the center line and the plurality of targets rightward in response to determining that the lateral position of the golf ball aligns vertically with one of the one or more right-sided targets and move the center line and the plurality of targets leftward in response to determining that the lateral position of the golf ball aligns vertically with one of the one or more left-sided targets.

Embodiment 101. The standalone miniature golf structure of embodiments 99 or 100, wherein the one or more left-sided targets and the one or more right-sided targets are mirrored with respect to each other.

Embodiment 102. The standalone miniature golf structure of any of embodiments 98-101, wherein the plurality of targets are contiguous with each other.

Embodiment 103. The standalone miniature golf structure of any of embodiments 98-102, wherein, based on the instructions stored in the memory, the one or more processors are configured to further include a right end line and a left end line in the interface.

Embodiment 104. The standalone miniature golf structure of embodiment 103, wherein the one or more processors are configured to end a match of the miniature golf game when the center line has crossed the left end line or the right end line.

Embodiment 105. The standalone miniature golf structure of any of claims 98-104, wherein, based on the instructions stored in the memory, the one or more processors are configured to designate each of the plurality of targets with a respective combination of magnitude and direction of movement.

Embodiment 106. The standalone miniature golf structure of any of embodiments 98-105, wherein, based on the instructions stored in the memory, the one or more processors are configured to designate each of the plurality of targets with a respective point value.

Embodiment 107. The standalone miniature golf structure of any of embodiments 98-106, wherein, based on the instructions stored in the memory, the miniature golf game includes an individual gameplay and a team gameplay.

Embodiment 108. The standalone miniature golf structure of any of embodiments 98-107, wherein the one or more sensors are positioned adjacent to the rear end of the putting surface.

Embodiment 109. The standalone miniature golf structure of any of embodiments 98-108, further including a sensor assembly that defines a plurality of ball-detection lanes. The digital display screen is configured to display a plurality of digital lanes each of which aligns vertically with a respective one of the plurality of ball-detection lanes.

Embodiment 110. A standalone miniature golf structure includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. The one or more processors are configured to generate, based on the instructions stored in the memory, an interface to include moving targets arranged in rows; send command signals to the digital display screen to display the interface; identify, via the one or more sensors, a lateral position at which a golf ball crosses the rear end of the putting surface; determine positions of the moving targets of the interface when the golf ball is detected to have crossed the rear end of the putting surface; and, in response to determining that the lateral position of the golf ball aligns vertically with a first of the moving targets, award a first point value associated with the first of the moving targets to a current player.

Embodiment 111. The standalone miniature golf structure of embodiment 110, wherein the one or more processors are configured to include hazards in at least one of the rows based on the instructions stored in the memory and deduct a hazard point value associated with a first of the hazards from the current player in response to determining that the lateral position of the golf ball aligns vertically with the first of the hazards.

Embodiment 112. The standalone miniature golf structure of embodiments 110 or 111, wherein, in response to determining that the lateral position of the golf ball aligns vertically both with the first of the moving targets in a lower row of the rows and a second of the moving targets in an upper row of the rows, the one or more processors are configured to award the first point value associated with the first of the moving targets in the lower row to the current player.

Embodiment 113. The standalone miniature golf structure of any of embodiments 110-112, wherein, for each of the rows, the one or more processors are configured to select a range of point values, a direction of travel, and a speed of travel for the corresponding moving targets.

Embodiment 114. The standalone miniature golf structure of any of embodiments 110-113, wherein, for each of the rows, the one or more processors are configured to select a sequence in which the corresponding moving targets are to travel across the interface.

Embodiment 115. The standalone miniature golf structure of embodiment 114, wherein, in response to determining that a last of the moving targets in the sequence for one of the rows has been reached, the one or more processors are configured to reselect the sequence in which the corresponding moving targets are to be travel across the interface.

Embodiment 116. The standalone miniature golf structure of any of embodiments 110-115, wherein the one or more processors are configured to enable the current player to shoot an unlimited number of shots during a predefined duration of time.

Embodiment 117. The standalone miniature golf structure of embodiment 116, wherein the one or more processors are configured to start the predefined duration of time in response to detecting, via the one or more sensors, a first shot of the current player.

Embodiment 118. The standalone miniature golf structure of any of embodiments 110-117, further including a ball-dispensing assembly configured to dispense a second golf ball for a subsequent shot of the current player in response to the one or more processors detecting, via the one or more sensors, a first golf ball of a preceding shot.

Embodiment 119. The standalone miniature golf structure of any of embodiments 110-118, wherein, based on the instructions stored in the memory, the miniature golf game includes an individual gameplay and a team gameplay.

Embodiment 120. The standalone miniature golf structure of any of embodiments 110-119, wherein the one or more sensors are positioned adjacent to the rear end of the putting surface.

Embodiment 121. The standalone miniature golf structure of any of embodiments 110-120, further including a sensor assembly that defines a plurality of ball-detection lanes. The digital display screen is configured to display a plurality of digital lanes each of which aligns vertically with a respective one of the plurality of ball-detection lanes.

Embodiment 122. A standalone miniature golf structure includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. The one or more processors are configured to generate, based on the instructions stored in the memory, an interface to include targets arranged in rows; send command signals to the digital display screen to display the interface; identify, via the one or more sensors, a lateral position at which a golf ball crosses the rear end of the putting surface; and, in response to determining that the lateral position of the golf ball aligns vertically with a first of the targets, award a first point value associated with the first of the targets to a current player.

Embodiment 123. The standalone miniature golf structure of embodiment 122, wherein the digital display screen is configured to display the interface for a duration of the miniature golf game.

Embodiment 124. The standalone miniature golf structure of embodiments 122 or 123, wherein, based on the instructions stored in the memory, the one or more processors are configured to conduct plurality of rounds and conduct a shot for each of a plurality of players for each of the plurality of rounds.

Embodiment 125. The standalone miniature golf structure of any of embodiments 122-124, wherein, in response to determining that the lateral position of the golf ball aligns vertically with the first of the targets, the one or more processors are configured to remove the first of the targets from the interface for subsequent shots of the miniature golf game.

Embodiment 126. The standalone miniature golf structure of any of embodiments 122-125, wherein, in response to determining that the lateral position of the golf ball aligns vertically both with the first of the targets in a lower row of the rows and a second of the targets in an upper row of the rows, the one or more processors are configured to award the first point value associated with the first of the targets in the lower row to the current player.

Embodiment 127. The standalone miniature golf structure of any of embodiments 122-126, wherein, based on the instructions stored in the memory, the one or more processors are configured to initially generate the interface to arrange the rows of the targets in a contiguous block.

Embodiment 128. The standalone miniature golf structure of any of embodiments 122-127, wherein, based on the instructions stored in the memory, the one or more processors are configured to configured to include hazards in one or more of the rows.

Embodiment 129. The standalone miniature golf structure of any of embodiments 122-128, wherein each of the targets have a same width based on the instructions stored in the memory.

Embodiment 130. The standalone miniature golf structure of any of embodiments 122-129, wherein, based on the instructions stored in the memory, the one or more processors are configured to assign a different point value to each of the targets in a first of the rows compared to that of each of the targets in a second of the rows.

Embodiment 131. The standalone miniature golf structure of any of embodiments 122-130, wherein, based on the instructions stored in the memory, the miniature golf game includes an individual gameplay and a team gameplay.

Embodiment 132. The standalone miniature golf structure of any of embodiments 122-131, wherein the one or more sensors are positioned adjacent to the rear end of the putting surface.

Embodiment 133. The standalone miniature golf structure of any of embodiments 122-132, further including a sensor assembly that defines a plurality of ball-detection lanes. The digital display screen is configured to display a plurality of digital lanes each of which aligns vertically with a respective one of the plurality of ball-detection lanes.

Embodiment 134. A standalone miniature golf structure includes a putting surface including a front end and a rear end, one or more sensors configured to detect lateral positions at which balls cross the rear end, a digital display screen positioned above the one or more sensors and adjacent to the rear end to align vertically with the rear end of the putting surface, memory to store instructions for a miniature golf game, and one or more processors. The one or more processors are configured to generate, based on the instructions stored in the memory, an interface to include an oscillating target; send command signals to the digital display screen to display the interface; identify, via the one or more sensors, a lateral position at which a golf ball crosses the rear end of the putting surface; determine a position of the oscillating target of the interface when the golf ball is detected to have crossed the rear end of the putting surface; and in response to determining that the lateral position of the golf ball aligns vertically with the position of the oscillating target, award a point value of the oscillating target to a player.

Embodiment 135. The standalone miniature golf structure of embodiment 134, wherein, based on the instructions stored in the memory, the one or more processors are configured to cause the oscillating target to oscillate laterally across the interface.

Embodiment 136. The standalone miniature golf structure of claim 134 or 135, wherein, based on the instructions stored in the memory, the one or more processors are configured to gradually reduce a width of the oscillating target over time.

Embodiment 137. The standalone miniature golf structure of any of embodiments 134-136, wherein, based on the instructions stored in the memory, the one or more processors are configured to gradually increase the point value associated with the oscillating target over time.

Embodiment 138. The standalone miniature golf structure of any of embodiments 134-137, wherein the one or more processors are configured to enable the player to shoot an unlimited number of shots during a predefined duration of time.

Embodiment 139. The standalone miniature golf structure of any embodiments 134-138, further including a ball-dispensing assembly configured to dispense a second golf ball for a subsequent shot of the current player in response to the one or more processors detecting, via the one or more sensors, a first golf ball of a preceding shot.

Embodiment 140. The standalone miniature golf structure of any of embodiments 134-139, wherein, based on the instructions stored in the memory, the miniature golf game includes an individual gameplay and a team gameplay.

Embodiment 141. The standalone miniature golf structure of any of embodiments 134-140, wherein the one or more sensors are positioned adjacent to the rear end of the putting surface.

Embodiment 142. The standalone miniature golf structure of any of embodiments 134-141, further including a sensor assembly that defines a plurality of ball-detection lanes. The digital display screen is configured to display a plurality of digital lanes each of which aligns vertically with a respective one of the plurality of ball-detection lanes.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A standalone miniature golf structure, comprising:

a putting surface including a front end and a rear end;

one or more sensors configured to detect lateral positions at which balls cross the rear end;

a digital display screen positioned above the one or more sensors and adjacent to the rear end to align vertically with the rear end of the putting surface;

memory to store instructions for a plurality of miniature golf games; and one or more processors that, for each shot of the plurality of miniature golf games, are configured to:

send command signals to the digital display screen to display one or more putting targets based on the instructions stored in the memory;

identify, via the one or more sensors, a lateral position at which a golf ball crosses the rear end of the putting surface;

determine whether the lateral position of the golf ball aligns vertically with any of the one or more putting targets; and generate a score for the shot based on the lateral position of the golf ball relative to the one or more putting targets.

2. The standalone miniature golf structure of claim 1, wherein the instructions stored by the memory enable any of the plurality of miniature golf games to be played by a range of number of players and for a plurality of gameplays.

3. The standalone miniature golf structure of claim 2, wherein the plurality of gameplays includes an individual gameplay and a team gameplay.

4. The standalone miniature golf structure of claim 1, further comprising a check-in station with a user interface configured to receive a user selection of one or more of the miniature golf games, a gameplay, and a number of players.

5. The standalone miniature golf structure of claim 1, wherein the one or more processors are configured to change the one or more putting targets for each shot of the plurality of miniature golf games.

6. The standalone miniature golf structure of claim 1, wherein the one or more processors are configured to randomly select a lateral position, a width, and a point value of each of the one or more putting targets for each shot of the plurality of miniature golf games.

7. The standalone miniature golf structure of claim 1, wherein the one or more processors are configured to present one or more hazards with the one or more putting target for one or more shots of the plurality of miniature golf games.

8. The standalone miniature golf structure of claim 1, further comprising a sensor assembly that includes the one or more sensors, wherein the sensor assembly is positioned adjacent to the rear end of the putting surface.

9. The standalone miniature golf structure of claim 1, further comprising a tee surface adjacent to the front end of the putting surface and a ball-dispensing assembly configured to return the golf ball to the tee surface for a subsequent shot.

10. The standalone miniature golf structure of claim 9, further comprising a ball-return surface extending between the one or more sensors and the ball-dispensing assembly to direct the golf ball that has been putted by a player to the ball-dispensing assembly.

11. The standalone miniature golf structure of claim 10, wherein the one or more processors are configured to instruct the ball-dispensing assembly to release another golf ball onto the tee surface at a predetermined time after the one or more sensors detect that the golf ball has rolled onto the ball-return surface.

12. A standalone miniature golf structure, comprising:

a putting surface including a front end and a rear end;

a plurality of ball-detection lanes that are adjacent and extend perpendicular to the rear end of the putting surface;

one or more sensors configured to detect into which of the plurality of ball-detection lanes that golf balls are shot;

a digital display screen positioned adjacent to and above the rear end to align vertically with the plurality of ball-detection lanes;

memory to store instructions for a plurality of miniature golf games; and one or more processors that, for each shot of the plurality of miniature golf games, are configured to:

send command signals to the digital display screen to display one or more putting targets based on the instructions stored in the memory;

identify, via the one or more sensors, a putted lane of the plurality of ball-detection lanes into which a golf ball has been shot;

determine whether the putted lane aligns vertically with any of the one or more putting targets; and generate a score for the shot based on a position of the putted lane relative to the one or more putting targets.

13. The standalone miniature golf structure of claim 12, wherein the instructions stored by the memory enable any of the plurality of miniature golf games to be played by a range of number of players and for a plurality of gameplays.

14. The standalone miniature golf structure of claim 12, wherein the one or more processors are configured to change the one or more putting targets for each shot of the plurality of miniature golf games.

15. The standalone miniature golf structure of claim 12, wherein the one or more processors are configured to randomly select a lateral position, a width, and a point value of each of the one or more putting targets for each shot of the plurality of miniature golf games.

16. The standalone miniature golf structure of claim 12, wherein the one or more processors are configured to present one or more hazards with the one or more putting target for one or more shots of the plurality of miniature golf games.

17. The standalone miniature golf structure of claim 12, wherein the digital display screen is configured to display a plurality of digital lanes each of which aligns vertically with a respective one of the plurality of ball-detection lanes to facilitate a player in putting the golf ball in a direction toward the one or more putting targets.

18. The standalone miniature golf structure of claim 12, further comprising a sensor assembly that includes the plurality of ball-detection lanes and the one or more sensors.

19. The standalone miniature golf structure of claim 12, further comprising a tee surface adjacent to the front end of the putting surface and a ball-dispensing assembly configured to return the golf ball to the tee surface for a subsequent shot.

20. The standalone miniature golf structure of claim 19, further comprising a ball-return surface extending between the one or more sensors and the ball-dispensing assembly to direct the golf ball that has been putted by a player to the ball-dispensing assembly.

21. The standalone miniature golf structure of claim 20, wherein the one or more processors are configured to instruct the ball-dispensing assembly to release another golf ball onto the tee surface at a predefined duration after the one or more sensors detect the golf ball entering one of the plurality of ball-detection lanes.

22. A putting structure, comprising:

a putting surface including a front end and a rear end;

a tee surface adjacent to the front end of the putting surface;

a ball-return surface located underneath the putting surface;

a sensor assembly adjacent to the rear end of the putting surface, wherein the sensor assembly includes a sensor cartridge with one or more sensors configured to detect a lateral position at which a golf ball crosses the rear end, wherein the sensor assembly is configured to direct the golf ball from the rear end of the putting surface and to the ball-return surface to return the golf ball back to the tee surface for a subsequent putt.

23. The putting structure of claim 22, wherein the sensor cartridge defines an upper surface along which the golf ball is to travel between the putting surface and the ball-return surface.

24. The putting structure of claim 23, wherein the sensor cartridge defines a front edge of the upper surface that is positioned adjacent to the ball-return surface, wherein the upper surface is sloped downward toward the front edge to guide the golf ball to the ball-return surface.

25. The putting structure of claim 24, wherein the sensor cartridge further includes one or more second sensors configured to detect when the golf ball crosses the front edge of the sensor cartridge.

26. The putting structure of claim 22, wherein the one or more sensors include a plurality of fork sensors, wherein each of the plurality of fork sensors is configured to monitor for the golf ball traversing a corresponding predefined lateral position along the rear end of the putting surface.

27. The putting structure of claim 22, wherein the one or more sensors include a lidar sensor configured to detect the lateral position at which the golf ball crosses the rear end of the putting surface.

28. The putting structure of claim 22, wherein the sensor assembly further includes a deflector tray that is positioned above the sensor cartridge.

29. The putting structure of claim 28, wherein the deflector tray includes a plurality of deflectors configured to define a plurality of ball-detection lanes that are adjacent and extend perpendicular to the rear end of the putting surface, wherein the plurality of deflectors are arranged such that the golf ball is to travel through one of the plurality of ball-setection lanes to facilitate detection of the lateral position at which the golf ball is putt.

30. The putting structure of claim 29, wherein the sensor assembly further a lighting housing positioned behind the deflector tray, wherein the lighting housing includes a plurality of lights arranged in a side-by-side manner, wherein each of the plurality of lights is configured to illuminate a corresponding portion along the rear end of the putting surface associated with at least one of a putting target or the lateral position at which the golf ball is putt.

* * * * *